US010347258B2

(12) United States Patent
Sasaki

(10) Patent No.: US 10,347,258 B2
(45) Date of Patent: Jul. 9, 2019

(54) VOICE COMMUNICATION SYSTEM

(71) Applicant: Hitachi Kokusai Electric Inc., Tokyo (JP)

(72) Inventor: Seishi Sasaki, Tokyo (JP)

(73) Assignee: Hitachi Kokusai Electric Inc., Tokyo (JP)

( * ) Notice: Subject to any disclaimer, the term of this patent is extended or adjusted under 35 U.S.C. 154(b) by 0 days.

(21) Appl. No.: 15/775,462

(22) PCT Filed: Mar. 4, 2016

(86) PCT No.: PCT/JP2016/056826
§ 371 (c)(1),
(2) Date: May 11, 2018

(87) PCT Pub. No.: WO2017/081874
PCT Pub. Date: May 18, 2017

(65) Prior Publication Data

US 2018/0358023 A1 Dec. 13, 2018

Related U.S. Application Data

(63) Continuation of application No. PCT/JP2016/056826, filed on Mar. 4, 2016.

(30) Foreign Application Priority Data

Nov. 13, 2015 (JP) ..... 2015-223112

(51) Int. Cl.
*G10L 19/005* (2013.01)
*G10L 19/16* (2013.01)
(Continued)

(52) U.S. Cl.
CPC ..... *G10L 19/005* (2013.01); *G10L 19/0204* (2013.01); *G10L 19/16* (2013.01); *G10L 19/22* (2013.01); *G10L 19/032* (2013.01)

(58) Field of Classification Search
CPC ..... G10L 19/005
See application file for complete search history.

(56) References Cited

U.S. PATENT DOCUMENTS

2010/0153102 A1* 6/2010 Yoshida ..... G10L 19/005 704/227
2011/0026581 A1* 2/2011 Ojala ..... G10L 19/24 375/240
2014/0195253 A1* 7/2014 Vasilache ..... G10L 19/008 704/500

FOREIGN PATENT DOCUMENTS

JP 3292711 B2 6/2002
JP 2012-182672 A 9/2012
(Continued)

OTHER PUBLICATIONS

Nimrod Peleg, "Linear Prediction Coding" (Year: 2009).*
(Continued)

*Primary Examiner* — Douglas Godbold
(74) *Attorney, Agent, or Firm* — Mattingly & Malur, PC

(57) ABSTRACT

A voice communication system is equipped with a voice encoder which classifies respective bits of a voice information bit string in accordance with the degree of importance which is the magnitude of auditory influence when there is an error therein, classifies a group of bits which are high in degree of importance into a core layer and classifies a group of bits which are not high into an extension layer and a voice decoder which decodes a voice by using the bit strings in both of the core layer and the extension layer on the basis of frequency that the error is detected by error detection processing and when the frequency is low and decodes the voice using all bits or only some bets in the core layer when the frequency is high.

5 Claims, 32 Drawing Sheets

(51) Int. Cl.

| | |
|---|---|
| ***G10L 19/02*** | (2013.01) |
| ***G10L 19/22*** | (2013.01) |
| *G10L 19/032* | (2013.01) |

(56) References Cited

FOREIGN PATENT DOCUMENTS

| | | | |
|---|---|---|---|
| JP | 2015-041826 | A | 3/2015 |
| WO | 2012/086141 | A1 | 6/2012 |
| WO | 2015/093011 | A1 | 6/2015 |

OTHER PUBLICATIONS

Seishi Sasaki, et al. "A Low Bit Rate Speech Codec Using Mixed Excitation Linear Prediction for Private Mobile Radio" The Transactions of the Institute of Electronics, Information and Communication Engineers, Apr. 1, 2001, vol. J84-D-II, No. 4, pp. 629-640.
International Search Report of PCT/JP2016/056826 dated May 17, 2016.

* cited by examiner

FIG. 15

| PARAMETER | | NUMBER OF BITS PER 1 FRAME (20ms) | bit (LSB=bit0) | DEGREE OF IMPORTANCE | CLASS ALLOCATION | LAYER ALLOCATION(※) |
|---|---|---|---|---|---|---|
| LSF PARAMETER (g1) | Switch inf. | 1 | bit0 | HIGH | 2 | CORE 1 |
| | Stage1 | 7 | bit6-bit0 | HIGH | 2 | CORE 1 |
| | Stage2 | 6 | bit5-bit0 | LOW | 0 | EXTENSION |
| | Stage3 | 5 | bit4-bit0 | LOW | 0 | EXTENSION |
| GAIN (d1) | | 5 | bit4, bit3 | HIGH | 2 | CORE 1 |
| | | | bit2, bit1 | MODERATE | 1 | CORE 2 |
| | | | bit0 | LOW | 0 | EXTENSION |
| PERIODIC/APERIODIC PITCH, VOICED/VOICELESS INFORMATION CODE (t1) | | 7 | bit6, bit5 | HIGH | 2 | CORE 1 |
| | | | bit4-bit0 | MODERATE | 1 | CORE 2 |
| HIGH RANGE VOICED/VOICELESS FLAG (w1) | | 1 | bit0 | LOW | 0 | EXTENSION |
| TOTAL | | 32 | - | - | - | - |

※ CORE LAYER 1: 12 bits, CORE LAYER 2: 7 bits, EXTENSION LAYER: 13bits

FIG. 16

| CLASS ALLOCATION bits/40ms | CRC bits/40ms | RCPC | | |
|---|---|---|---|---|
| | | INPUT bits/40ms | ENCODING RATIO | OUTPUT bits/40ms |
| CLASS 2: 12×2 | 4 | 36 (8 TAIL BITS INCLUDED) | 4/9 | 81 |
| CLASS 1: 7×2 | - | 14 | 2/3 | 21 |
| CLASS 0: 13×2 | - | 26 | 1 | 26 |
| TOTAL : 64 | 4 | 76 | - | 128 |

FIG. 17

| SCALABLE DECODING MODE | LAYER USED FOR DECODING | NUMBER OF BITS PER 1 FRAME (20 ms) | VOICE ENCODING RATE [kbps] |
|---|---|---|---|
| 1 | CORE 1, CORE 2, EXTENTION | 32 | 1.6 |
| 2 | CORE 1, CORE 2 | 19 | 0.95 |
| 3 | CORE 1 | 12 | 0.6 |

FIG. 22

| PARAMETER | | NUMBER OF BITS PER 1 FRAME (40ms) | bit (LSB=bit0) | DEGREE OF IMPORTANCE | CLASS ALLOCATION | LAYER ALLOCATION(※) |
|---|---|---|---|---|---|---|
| LSF PARAMETER (c8) | Stage1 | 8 | bit7-bit0 | HIGH | 2 | CORE 1 |
| | Stage2 | 6 | bit5-bit0 | MODERATE | 1 | CORE 2 |
| | Stage3 | 6 | bit5-bit0 | LOW | 0 | EXTENSION |
| | Stage4 | 6 | bit5-bit0 | LOW | 0 | EXTENSION |
| GAIN (b8) | | 5 | bit4, bit3 | HIGH | 2 | CORE 1 |
| | | | bit2, bit1 | MODERATE | 1 | CORE 2 |
| | | | bit0 | LOW | 0 | EXTENSION |
| PERIODIC/APERIODIC PITCH, VOICED/VOICELESS INFORMATION CODE (t1) | | 7 | bit6, bit5 | HIGH | 2 | CORE 1 |
| | | | bit4-bit0 | MODERATE | 1 | CORE 2 |
| HIGH RANGE VOICED/VOICELESS FLAG (w1) | | 1 | bit0 | LOW | 0 | EXTENSION |
| GAIN AUXILIARY INFORMATION (AFTER APPLICATION OF BCH(7, 4) + EVEN-NUMBERED PARITY 1 bit) (b8) | | 8 | bit7-bit0 | LOW | 0 | EXTENSION |
| TOTAL | | 47 | - | - | - | - |

※ CORE LAYER 1: 12 bits, CORE LAYER 2: 13 bits, EXTENSION LAYER: 22 bits

FIG.23

| CLASS ALLOCATION bits/40ms | CRC bits/40ms | RCPC | | |
|---|---|---|---|---|
| | | INPUT bits/40ms | ENCODING RATIO | OUTPUT bits/40ms |
| CLASS 2: 12 | 4 | 24 (8 TAIL BITS INCLUDED) | 1/3 | 72 |
| CLASS 1: 13 | - | 13 | 13/34 | 34 |
| CLASS 0: 22 | - | 22 | 1 | 22 |
| TOTAL: 47 | 4 | 59 | - | 128 |

FIG.24

| SCALABLE DECODING MODE | LAYER USED FOR DECODING | NUMBER OF BITS PER 1 FRAME (40 ms) | VOICE ENCODING RATE [kbps] |
|---|---|---|---|
| 1 | CORE 1, CORE 2, EXTENTION | 47 | 1.175 |
| 2 | CORE 1, CORE 2 | 25 | 0.625 |
| 3 | CORE 1 | 12 | 0.3 |

FIG. 29

| LAYER | CLASS bits/40ms | CRC bits/40ms | RCPC | | | TRANSMISSION FREQUENCY | NUMBER OF TRANSMISSION BITS bits/40ms |
|---|---|---|---|---|---|---|---|
| | | | INPUT bits/40ms | ENCODING RATIO | OUTPUT bits/40ms | | |
| CORE 1 | CLASS 2: 12×2 | 4 | 36 (8 TAIL BITS INCLUDED) | 2/5 | 90 | 2 | 180 |
| CORE 2 | CLASS 1: 7×2 | – | 14 | 7/12 | 24 | 2 | 48 |
| EXTENSION | CLASS 0: 13×2 | – | 26 | 1 | 26 | 1 (※) | 28 |
| TOTAL | 64 | 4 | 76 | – | 140 | – | 256 |

※ ONLY HIGH RANGE VOICED/VOICELESS FLAG IN EXTENSION LAYER IS TRANSMITTED TWO TIMES.

FIG. 33

| LAYER | CLASS bits/40ms | CRC bits/40ms | RCPC | | | MULTIPLE OF TRANSMISSION POWER | NUMBER OF TRANSMISSION BITS bits/40ms |
|---|---|---|---|---|---|---|---|
| | | | INPUT bits/40ms | ENCODING RATIO | OUTPUT bits/40ms | | |
| CORE 1 | CLASS 2: 12×2 | 4 | 36 (8 TAIL BITS INCLUDED) | 2/5 | 90 | 2 | 90 |
| CORE 2 | CLASS 1: 7×2 | – | 14 | 7/12 | 24 | 2 | 24 |
| EXTENSION | CLASS 0: 13×2 | – | 26 | 1 | 26 | 2 (※) | 14 |
| TOTAL | 64 | 4 | 76 | – | 140 | – | 128 |

※ ONLY LSP Stage2 AND HIGH RANGE VOICED/VOICELESS FLAG IN EXTENSION LAYER ARE TRANSMITTED.

VOICE COMMUNICATION SYSTEM

TECHNICAL FIELD

The present invention relates to a voice communication system.

BACKGROUND ART

Voice encoding decoding methods of 1.6 kbps in voice information rate which are presented in Patent Literature 1 and Non-Patent Literature 1 will be described as prior art by using FIG. 1 to FIG. 9.

A configuration of a conventional system voice encoder is shown in FIG. 1. A framer 111 is a buffer which stores an input voice sample (a1) which is bandlimited at 100 to 3800 Hz, thereafter is sampled at 8 kHz and is quantized with an accuracy of at least 12 bits and it fetches the voice samples (160 samples) per 1 voice encoding frame (20 ms) and outputs them to a voice encoding processing unit as (b1). In the following, processing which is executed per 1 voice encoding frame will be described.

A gain calculator 112 calculates a logarithm of an RMS (Root Mean Square) value which is level information of (b1) and outputs (c1) which is a result thereof. A quantizer 1_113 lineally quantizes (c1) with 5 bits and outputs (d1) which is a result thereof to a bit packing device 125. A linear prediction analyzer 114 performs linear prediction analysis on (b1) using a Durbin-Levinson method and outputs a 10th-order linear prediction coefficient (e1) which is spectrum envelope information.

An LSF coefficient calculator 115 converts the 10th-order linear prediction coefficient (e1) into a 10th-order LSF (Line Spectrum Frequencies) coefficient (f1).

A quantizer 2_116 is configured to use multi-stage vector quantization of 3 stages (7, 6, 5 bits) and to switchingly use memoryless vector quantization and prediction (memory) vector quantization, and quantizes the 10th-order LSF coefficient (f1) with 19 (=1+7+6+5) bits by allocating 1 bit to switching thereof and outputs an LSF parameter index (g1) which is a result thereof to the bit packing device 125. An LPF (low-pass filter) 120 filters (b1) at a cutoff frequency of 1000 Hz and outputs (k1). A pitch detector 121 obtains a pitch period from (k1) and outputs it as (m1).

Although the pitch period is given as a delay amount that a normalized autocorrelation function is maximized, a maximum value (l1) of the normalized autocorrelation function at that time is also output. The magnitude of the maximum value of the normalized autocorrelation function is information which indicates the strength of periodicity of the input signal (b1) and is used in an aperiodic flag generator 122 which will be described later.

In addition, the maximum value (l1) of the normalized autocorrelation function is corrected by a correlation coefficient corrector 119 which will be described later and then is used for voiced/voiceless decision by a voiced/voiceless decider 126. There, when a maximum value (j1) of the normalized autocorrelation function after correction is not more than a threshold value (=0.6), it is decided to be voiceless and when it is not so, it is decided to be voiced and a voiced/voiceless flag (s1) which is a result thereof is output. Here, the voiced/voiceless flag corresponds to the low frequency band voiced/voiceless discrimination information in claims. A quantizer 3_123 inputs (m1) and performs logarithmic transformation thereon and thereafter linearly quantizes it at 99 levels and outputs a pitch index (o1) which is a result thereof to a periodic/aperiodic pitch and voiced/voiceless information code generator 127.

FIG. 2 is a diagram showing a relation between the pitch period and the index in a conventional system.

The relation between the pitch period (taking a range of 20 to 160 samples) which is an input into the quantizer 3_123 and the index value (taking a range of 0 to 98) which is an output therefrom is shown in FIG. 2.

The aperiodic flag generator 122 inputs the maximum value (l1) of the normalized autocorrelation function, sets an aperiodic flag ON when it is smaller than a threshold value (=0.5) and sets it OFF when it is not so and outputs the aperiodic flag (1 bit) (n1) to the aperiodic pitch index generator 124 and the periodic/aperiodic pitch and voiced/voiceless information code generator 127. When the aperiodic flag (n1) is ON, it means that a current frame is a sound source having aperiodicity. An LPC analysis filter 117 is an all-zero filter which uses the 10th-order linear prediction coefficient (e1) as a coefficient and removes the spectrum envelope information from the input signal (b1) and outputs a residual signal (h1) which is a result thereof. A peakiness calculator 118 inputs the residual signal (h1), calculates a peakiness value and outputs it as (i1). The peakiness value is a parameter which indicates the possibility of presence of a pulsed component (a spike) having a peak in the signal and is given by (Formula

[Numerical Formula 1]

$$\text{Peakiness value } p = \frac{\sqrt{\frac{1}{N}\sum_{n=1}^{N} e_n^2}}{\frac{1}{N}\sum_{n=1}^{N} |e_n|} \qquad \text{(Formula 1)}$$

Here, N is the number of samples in 1 frame and $e_n$ is the residual signal. Since the numerator of (Formula 1) is liable to be influenced by a large value in comparison with the denominator, p has a large value when there exists a large spike in the residual signal. Accordingly, the larger the peakiness value is, the more the possibility that the frame is a voiced frame having jitters which are often observed in a transient part or a plosive frame is increased (because in these frames, although it has partially the spike (a sharp peak), other part is in the form of a signal of the property which is close to that of the white noise).

When the peakiness value (i1) is larger than "1.34", the correlation coefficient corrector 119 sets the maximum value (l1) of the normalized autocorrelation function to "1.0" (indicating the voiced one) and outputs (j1). Calculation of the peakiness value and correlation function correction processing are processing adapted to detect the voiced frame having the jitters or the plosive frame and correct the maximum value of the normalized autocorrelation function to "1.0" (the value indicating the voiced one).

Although the voiced frame having the jitters or the plosive frame partially has the spike (the sharp peak), the other part is in the form of the signal of the property which is close to that of the white noise and therefore the possibility that the normalized autocorrelation function before correction becomes smaller than "0.5" is large (that is, the possibility that the aperiodic flag is set ON is large). On the other hand, the peakiness value becomes large. Accordingly, when the voiced frame having the jitters or the plosive frame is detected in accordance with the peakiness value and the normalized autocorrelation function is corrected to "1.0", it is decided to be voiced in later voiced/voiceless decision by the voiced/voiceless decider 126 and an aperiodic pulse is used in the sound source when decoding and therefore the sound quality of the voiced frame having the jitters or the plosive frame is improved.

An aperiodic pitch index generator 124 non-uniformly quantizes the pitch period (m1) in the aperiodic frame at 28 levels and outputs an index (p1). The details of the processing thereof will be shown in the following. First, a result that the frequency of the pitch period has been examined for the frame (corresponding to the voiced frame having the jitters in the transient part or the plosive frame) that the voiced/voiceless flag (s1) is set to the voiced one and the aperiodic flag (n1) is set ON is shown in FIG. 3 and the cumulative frequency thereof is shown in FIG. 4.

FIG. 3 is a diagram showing the frequency of the pitch period of the conventional system. FIG. 4 is a diagram showing the cumulative frequency of the pitch period of the conventional system.

FIG. 3 and FIG. 4 are results of measurement of voice data which is configured by four men and four women (6 voice samples/per person) and adds up to 112.12 [s] (5606 frames). As the frame which satisfies the above-described conditions (the voiced/voiceless flag (s1) is the voiced one and the aperiodic flag (n1) is ON), there existed 425 frames in 5606 frames. It is seen from FIG. 3 that a distribution of the pitch period in the frame (hereinafter, referred to as the aperiodic frame) which satisfies that condition is concentrated on around 25 to 100. Accordingly, it can be highly efficiently transmitted by performing nonuniform quantization based on the frequency (the appearance frequency), that is, by quantizing more finely the pitch period which is larger in frequency and more roughly the pitch period which is smaller in it. In addition, the pitch period of the aperiodic frame is calculated from (Formula 2) in a decoder.

$$\text{Pitch period of aperiodic frame} = \text{Transmitted pitch period } (1.0+0.25\times\text{Random number value}) \quad \text{(Formula 2)}$$

The transmitted pitch period in (Formula 2) is the pitch period which is transmitted in accordance with an index which is an output from the aperiodic pitch index generator 124 and the jitter is added per pitch period by multiplying (1.0+0.25×the random number value). Accordingly, the larger the pitch period is, the more the amount of the jitters is increased and therefore rough quantization is allowed. A quantization table for the pitch period of the aperiodic frame which is based on the above is shown in Table 1. In Table 1, the input pitch period which is within a range from 20 to 24 is quantized at 1 level, the one which is within a range from 25 to 50 is quantized at 13 levels (2 steps in width), the one which is within a range from 51 to 95 is quantized at 9 levels (5 steps in width), the one which is within a range from 95 to 135 is quantized at 4 levels (10 steps in width) and the one which is within a range from 136 to 160 is quantized at 1 level and the indexes (Aperiodic 0 to 27) are output. 64 levels or more are necessary for quantization of a general pitch period. On the other hand, as for quantization of the pitch period of the aperiodic frame, it becomes possible to quantize it at 28 levels by taking the frequency, the decoding method into consideration.

TABLE 1

| Pitch period of aperiodic frame | Pitch period of aperiodic frame after quantization | Index |
|---|---|---|
| 20-24 | 24 | Aperiodic 0 |
| 25, 26 | 26 | Aperiodic 1 |
| 27, 28 | 28 | Aperiodic 2 |
| 29, 30 | 30 | Aperiodic 3 |
| 31, 32 | 32 | Aperiodic 4 |
| 33, 34 | 34 | Aperiodic 5 |
| 35, 36 | 36 | Aperiodic 6 |
| 37, 38 | 38 | Aperiodic 7 |
| 39, 40 | 40 | Aperiodic 8 |
| 41, 42 | 42 | Aperiodic 9 |
| 43, 44 | 44 | Aperiodic 10 |
| 45, 46 | 46 | Aperiodic 11 |
| 47, 48 | 48 | Aperiodic 12 |
| 49, 50 | 50 | Aperiodic 13 |
| 51-55 | 55 | Aperiodic 14 |
| 56-60 | 60 | Aperiodic 15 |
| 61-65 | 65 | Aperiodic 16 |
| 66-70 | 70 | Aperiodic 17 |
| 71-75 | 75 | Aperiodic 18 |
| 76-80 | 80 | Aperiodic 19 |
| 81-85 | 85 | Aperiodic 20 |
| 86-90 | 90 | Aperiodic 21 |
| 91-95 | 95 | Aperiodic 22 |
| 96-105 | 100 | Aperiodic 23 |
| 106-115 | 110 | Aperiodic 24 |
| 116-125 | 120 | Aperiodic 25 |
| 126-135 | 130 | Aperiodic 26 |
| 136-160 | 140 | Aperiodic 28 |

The periodic/aperiodic pitch and voiced/voiceless information code generator 127 inputs the voiced/voiceless flag (s1), the aperiodic flag (n1), the pitch index (o1), the aperiodic pitch index (p1) and outputs a 7-bit (128-level) periodic/aperiodic pitch-voiced/voiceless information code (t1). Processing performed here will be described in the following.

In a case where the voiced/voiceless flag (s1) shows the voiceless one, a codeword that 7 bits are all 0s is allocated in the 7-bit code (having 128 kinds of codewords). In a case where the flag shows the voiced one, the remaining codewords (127 kinds) are allocated to the pitch indexes (o1) or the aperiodic pitch indexes (p1) on the basis of the aperiodic flag (n1). When the aperiodic flag (n1) is ON, the codewords (28 kinds) that 1 bit and 2 bits become(s) 1(s) in 7 bits are allocated to the aperiodic pitch indexes (p1) (Aperiodic 0 to 27). Other codewords (99 kinds) are allocated to the periodic pitch indexes (Periodic 0 to 98). A generation table for the periodic/aperiodic pitch-voiced/voiceless information codes which are based on the above is shown in Table 2.

In general, in a case where an error occurs in the voiced/voiceless information due to transmission error and the voiceless frame is erroneously decoded as the voiced frame, the periodic sound source is used and therefore the quality of the reproduced voice is remarkably deteriorated. Since the sound source signal is made by an aperiodic pitch pulse by allocating the aperiodic pitch indexes (p1) (Aperiodic 0 to 27) to the codewords (28 kinds) that 1 bit and 2 bits become(s) 1(s) in 7 bits, it is possible to reduce the influence of the transmission error even when 1-bit or 2-bit error occurs in a voiceless codeword (0x0) due to the transmission error.

TABLE 2

| Code | Index |
|---|---|
| 0 × 0 | Voiceless |
| 0 × 1 | Aperiodic 0 |
| 0 × 2 | Aperiodic 1 |
| 0 × 3 | Aperiodic 2 |
| 0 × 4 | Aperiodic 3 |
| 0 × 5 | Aperiodic 4 |
| 0 × 6 | Aperiodic 5 |
| 0 × 7 | Periodic 0 |
| 0 × 8 | Aperiodic 6 |
| 0 × 9 | Aperiodic 7 |
| 0 × A | Aperiodic 8 |
| 0 × B | Periodic 1 |
| 0 × C | Aperiodic 9 |
| 0 × D | Periodic 2 |
| 0 × E | Periodic 3 |
| 0 × F | Periodic 4 |
| 0 × 10 | Aperiodic 10 |
| 0 × 11 | Aperiodic 11 |
| 0 × 12 | Aperiodic 12 |
| 0 × 13 | Periodic 5 |
| 0 × 14 | Aperiodic 13 |
| 0 × 15 | Periodic 6 |
| 0 × 16 | Periodic 7 |
| 0 × 17 | Periodic 8 |
| 0 × 18 | Aperiodic 14 |
| 0 × 19 | Periodic 9 |
| 0 × 1A | Periodic 10 |
| 0 × 1B | Periodic 11 |
| 0 × 1C | Periodic 12 |
| 0 × 1D | Periodic 13 |
| 0 × 1E | Periodic 14 |
| 0 × 1F | Periodic 15 |
| 0 × 20 | Aperiodic 15 |
| 0 × 21 | Aperiodic 16 |
| 0 × 22 | Aperiodic 17 |
| 0 × 23 | Periodic 16 |
| 0 × 24 | Aperiodic 18 |
| 0 × 25 | Periodic 17 |
| 0 × 26 | Periodic 18 |
| 0 × 27 | Periodic 19 |
| 0 × 28 | Aperiodic 19 |
| 0 × 29 | Periodic 20 |
| 0 × 2A | Periodic 21 |
| 0 × 2B | Periodic 22 |
| 0 × 2C | Periodic 23 |
| 0 × 2D | Periodic |
| 0 × 2E | Periodic 24 |
| 0 × 2F | Periodic 26 |
| 0 × 30 | Aperiodic 20 |
| 0 × 31 | Periodic 27 |
| 0 × 32 | Periodic 28 |
| 0 × 33 | Periodic 29 |
| 0 × 34 | Periodic 30 |
| 0 × 35 | Periodic 31 |
| 0 × 36 | Periodic 32 |
| 0 × 37 | Periodic 33 |
| 0 × 38 | Periodic 34 |
| 0 × 39 | Periodic 35 |
| 0 × 3A | Periodic 36 |
| 0 × 3B | Periodic 37 |
| 0 × 3C | Periodic 38 |
| 0 × 3D | Periodic 39 |
| 0 × 3E | Periodic 40 |
| 0 × 3F | Periodic 41 |
| 0 × 40 | Aperiodic 21 |
| 0 × 41 | Aperiodic 22 |
| 0 × 42 | Aperiodic 23 |
| 0 × 43 | Periodic 42 |
| 0 × 44 | Aperiodic 24 |
| 0 × 45 | Periodic 43 |
| 0 × 46 | Periodic 44 |
| 0 × 47 | Periodic 45 |
| 0 × 48 | Aperiodic 25 |
| 0 × 49 | Periodic 46 |
| 0 × 4A | Periodic 47 |
| 0 × 4B | Periodic 48 |
| 0 × 4C | Periodic 49 |
| 0 × 4D | Periodic 50 |

TABLE 2-continued

| Code | Index |
|---|---|
| 0 × 4E | Periodic 51 |
| 0 × 4F | Periodic 52 |
| 0 × 50 | Aperiodic 26 |
| 0 × 51 | Periodic 53 |
| 0 × 52 | Periodic 54 |
| 0 × 53 | Periodic 55 |
| 0 × 54 | Periodic 56 |
| 0 × 55 | Periodic 57 |
| 0 × 56 | Periodic 58 |
| 0 × 57 | Periodic 59 |
| 0 × 58 | Periodic 60 |
| 0 × 59 | Periodic 61 |
| 0 × 5A | Periodic 62 |
| 0 × 5B | Periodic 63 |
| 0 × 5C | Periodic 64 |
| 0 × 5D | Periodic 65 |
| 0 × 5E | Periodic 66 |
| 0 × 5F | Periodic 67 |
| 0 × 60 | Aperiodic 27 |
| 0 × 61 | Periodic 68 |
| 0 × 62 | Periodic 69 |
| 0 × 63 | Periodic 70 |
| 0 × 64 | Periodic 71 |
| 0 × 65 | Periodic 72 |
| 0 × 66 | Periodic 73 |
| 0 × 67 | Periodic 74 |
| 0 × 68 | Periodic 75 |
| 0 × 69 | Periodic 76 |
| 0 × 6A | Periodic 77 |
| 0 × 6B | Periodic 78 |
| 0 × 6C | Periodic 79 |
| 0 × 6D | Periodic 80 |
| 0 × 6E | Periodic 81 |
| 0 × 6F | Periodic 82 |
| 0 × 70 | Periodic 83 |
| 0 × 71 | Periodic 84 |
| 0 × 72 | Periodic 85 |
| 0 × 73 | Periodic 86 |
| 0 × 74 | Periodic 87 |
| 0 × 75 | Periodic 88 |
| 0 × 76 | Periodic 89 |
| 0 × 77 | Periodic 90 |
| 0 × 78 | Periodic 91 |
| 0 × 79 | Periodic 92 |
| 0 × 7A | Periodic 93 |
| 0 × 7B | Periodic 94 |
| 0 × 7C | Periodic 95 |
| 0 × 7D | Periodic 96 |
| 0 × 7E | Periodic 97 |
| 0 × 7F | Periodic 98 |

An HPF (high-pass filter) 128 filters (b1) at a cutoff frequency of 1000 Hz and outputs a high frequency component (the component of at least 1000 Hz) (u1). A correlation coefficient calculator 129 calculates and outputs a normalized autocorrelation function (v1) in a delay amount which is given to (u1) in the pitch period (m1). A voiced/voiceless decider 130 decides to be voiceless when the normalized autocorrelation function (v1) is not more than the threshold value (=0.5) and decides to be voiced when it is not so and outputs a high range voiced/voiceless flag (w1) which is a result thereof. Here, the high range voiced/voiceless flag corresponds to high frequency band voiced/voiceless discrimination information in claims.

The bit packing device 125 inputs the quantized RMS value (the gain information) (d1), the LSF parameter index (g1), the voiced/voiceless pitch-voiced/voiceless information code (f1) and the high range voiced/voiceless flag (w1) and outputs a voice information bit string (q1) of 32 bits per 1 frame (20 ms) (Table 3).

TABLE 3

| Parameter | Number of bits |
|---|---|
| LSF parameter | 19 |
| Gain/frame | 5 |
| Periodic/aperiodic pitch-voiced/voiceless information code | 7 |
| High range voiced/voiceless flag | 1 |
| Total bits/20 ms frame | 32 |

Next, a configuration of a conventional voice decoder will be described by using FIG. 5. FIG. 5 is a diagram showing one example of the conventional system voice decoder.

A bit separator (131) separates a 32-bit voice information bit string (a2) which is received per 1 frame into each parameter and outputs a periodic/aperiodic pitch-voiced/voiceless information code (b2), a high range voiced/voiceless flag (f2), gain information (m2) and an LSF parameter index (h2). A voiced/voiceless information-pitch period decoder 132 inputs the periodic/aperiodic pitch-voiced/voiceless information code (b2), seeks which one of Voiceless/Periodic/Aperiodic is indicated on the basis of Table 2, sets a pitch period (c2) to "50" and sets the voiced/voiceless flag (d2) to "0" when Voiceless is indicated and outputs them.

In a case of Periodic and Aperiodic, it performs decoding processing on the pitch period (c2) (in a case of Aperiodic, Table 1 is used) and outputs it and sets the voiced/voiceless flag (d2) to "1.0" and outputs it.

A jitter setter 133 inputs the periodic/aperiodic pitch-voiced/voiceless information code (b2), seeks which one of Voiceless/Periodic/Aperiodic is indicated on the basis of Table 2 and in a case where Voiceless or Aperiodic is indicated, sets a jitter value (e2) to "0.25" and outputs it. In a case where Periodic is indicated, it sets the jitter value (e2) to "0" and outputs it.

An LSF decoder 138 decodes a 10th-order LSF coefficient (i2) from the LSF parameter index (h2) and outputs it. An inclination correction coefficient calculator 137 calculates an inclination correction coefficient (j2) from the 10th-order LSF coefficient (i2). The inclination correction coefficient is a coefficient adapted to correct inclination of a spectrum and to reduce muffling of a sound in an adaptive spectrum enhancement filter 145 which will be described later.

A gain decoder 139 decodes gain information (m2) and outputs a gain (n2). A linear prediction coefficient calculator 1_136 converts the LSF coefficient (i2) into a linear prediction coefficient and outputs a linear prediction coefficient (k2).

A spectrum envelope amplitude calculator 135 calculates a spectrum envelope amplitude (l2) from the linear prediction coefficient (k2). Here, the voiced/voiceless flag (d2), the high range voiced/voiceless flag (f2) respectively correspond to the low frequency band voiced/voiceless discrimination information, the high frequency band voiced/voiceless discrimination information in claims.

In the following, a configuration of a pulse sound source/noise sound source mixing ratio calculator 134 will be described using FIG. 6.

FIG. 6 shows the configuration of the pulse sound source/noise sound source mixing ratio calculator and it inputs the voiced/voiceless flag (d2), the spectrum envelope amplitude (l2) and the high range voiced/voiceless flag (f2) in FIG. 5 and determines and outputs a mixing ratio (g2) in each band (sub-band).

In mixing ratio determination in FIG. 6 and decoding processing in FIG. 5, it is divided into 4 bands on a frequency axis and the mixing ratio of the pulse sound source to the noise sound source and a mixed signal thereof are obtained in each band. As the 4 bands, a sub-band 1 (0 to 1000 Hz), a sub-band 2 (1000 to 2000 Hz), a sub-band 3 (2000 to 3000 Hz) and a sub-band 4 (3000 to 4000 Hz) are set. The sub-band 1 corresponds to a low frequency band and the sub-bands 2, 3, 4 respectively correspond to respective bands of high frequencies.

A sub-band 1 voiced strength setter 160 in FIG. 6 inputs the voiced/voiceless flag (d2) and sets a voiced strength (a4) of the sub-band 1. Here, when the voiced/voiceless flag (d2) is "1.0", the voiced strength (a4) is set to "1.0" and when the voiced/voiceless flag (d2) is "0", the voiced strength (a4) is set to "0". A sub-bands 2, 3, 4 average amplitude calculator 161 inputs the spectrum envelope amplitude (l2), calculates average values of the spectrum envelope amplitudes in the sub-bands 2, 3, 4 and outputs them as (b4), (c4) and (d4) respectively. A sub-band selector 162 inputs (b4), (c4) and (d4) and outputs a sub-band number (e4) that the average value of the spectrum envelope amplitudes is maximized.

A sub-bands 2, 3, 4 voiced strength table (for the voiced one) 163 stores 3 three-dimensional vectors (f41), (f42), (f43) and each three-dimensional vector is configured by the voiced strengths of the sub-bands 2, 3, 4 when it is the voiced frame.

A switch 1_165 selects 1 vector (h4) from within the 3 three-dimensional vectors in accordance with the sub-band number (e4) and outputs it. A sub-bands 2, 3, 4 voiced strength table (for the voiceless one) 164 stores 3 three-dimensional vectors (g41), (g42), (g43) in the same way and each three-dimensional vector is configured by the voiced strengths of the sub-bands 2, 3, 4 when it is the voiceless frame.

A switch 2_166 selects 1 vector (i4) from within the 3 three-dimensional vectors in accordance with the sub-band number (e4) and outputs it. A switch 3_167 inputs the high range voiced/voiceless flag (f2) and selects (h4) when it indicates the voiced one and selects (i4) when it indicates the voiceless one and outputs it as (j4).

A mixing ratio calculator 168 inputs the voiced strength (a4) of the sub-band 1 and the voiced strength (j4) of the sub-bands 2, 3, 4 and outputs the mixing ratio (g2) in each sub-band. The mixing ratio (g2) is configured by sb1_p, sb2_p, sb3_p, sb4_p which indicate ratios of the pulse sound source in the respective sub-bands and sb1_n, sb2_n, sb3_n, sb4_n which indicate ratios of the noise sound source therein (here, in sbx_y, x indicates a sub-band number, and indicates the pulse sound source when y is p and the noise sound source when y is n). As sb1_p, sb2_p, sb3_p, sb4_p, the values of the voiced strength (a4) of the sub-band 1 and the voiced strengths (j4) of the sub-bands 2, 3, 4 are used as they are respectively. sbx_n (x=1, . . . 4) is set such that sbx_n=(1.0−sbx_p) (x=1, . . . 4).

Next, a determination method for the sub-bands 2, 3, 4 voiced strength table (for the voiced one) will be described. Values of the table in Table 4 are determined on the basis of a result of voiced strength measurement of the sub-bands 2, 3, 4 in the voiced frame in FIG. 7.

A measurement method in FIG. 7 will be described in the following.

Average values of the spectrum envelope amplitudes in the respective sub-bands 2, 3, 4 are calculated per frame (20 ms) for an input voice and they are classified into 3 frame groups of a group (expressed as fg_sb2) of the frames in which that of the sub-band 2 is maximized, a group (expressed as fg_sb3) of the frames in which that of the sub-band 3 is maximized and a group (expressed as fg_sb4) of the frames in which that of the sub-band 4 is maximized.

Next, the voiced frame which belongs to the frame group fg_sb2 is divided into sub-band signals corresponding to the sub-bands 2, 3, 4, normalized autocorrelation functions of the respective sub-band signals in the pitch period are obtained and an average value thereof is obtained per sub-band.

FIG. 7 is a graph showing the voiced strengths (when it is voiced) of the sub-bands 2, 3, 4 in the conventional system.

The horizontal axis in FIG. 7 shows the sub-band number thereof. Since the normalized autocorrelation function is a parameter which indicates the strength of periodicity of an input signal, that is, the strength of voicing perception, it means the voiced strength. The vertical axis in FIG. 7 indicates the voiced strength (the normalized autocorrelation) of each sub-band signal. In the drawing, a curved line which is marked with ♦ (diamond) shows a result of measurement of fg_sh2. Likewise, a result of measurement of the frame group fg_sb3 is shown by a curved line which is marked with ■ (square) and a result of measurement of the frame group fg_sb4 is shown by a curved line which is marked with ▲ (triangle). The input voce signals used in the measurement are configured by voices from a voice database CD-ROM and voices recorded from FM broadcasts. It is seen from FIG. 7 that there is a tendency as follows.

In the frames (the mark ♦ and the mark ■) that the average value of the spectrum envelope amplitudes in the sub-band 2 or 3 is maximized, the voiced strength is monotonically reduced as the frequency of the sub-band becomes high.

In the frame (the mark ▲) that the average value of the spectrum envelope amplitudes in the sub-band 4 is maximized, the voiced strength is not monotonically reduced and the voiced strength of the sub-band 4 is comparatively strengthened as the frequency of the sub-band becomes high. In addition, the voiced strengths of the sub-bands 2, 3 are weakened (in comparison with cases (the mark ♦ and the mark ■) where the average value of the spectrum envelope amplitudes in the sub-band 2 or 3 is maximized).

The voiced strength of the sub-band 2 of the frame (the mark ♦) that the average value of the spectrum envelope amplitudes of the sub-band 2 is maximized becomes larger than the voiced strengths of the sub-band 2 marked with ■ and ▲. Likewise, the voiced strength of the sub-band 3 of the frame (the mark ■) that the average value of the spectrum envelope amplitudes of the sub-band 3 is maximized becomes larger than the voiced strengths of the sub-band 3 marked with ♦ and ▲. Likewise, the voiced strength of the sub-band 3 of the frame (the mark ▲) that the average value of the spectrum envelope amplitudes of the sub-band 4 is maximized becomes larger than the voiced strengths of the sub-band 4 marked with ♦ and ■.

Accordingly, a value of the voiced strength of the curved line which is marked with ♦ is stored as (f41) in FIG. 6, a value of the voiced strength of the curved line which is marked with ■ is stored as (f42), a value of the voiced strength of the curved line which is marked with ▲ is stored as (f43) and they are selected on the basis of the sub-band number that (e4) indicates, and thereby an appropriate voiced strength can be set in accordance with the spectrum envelope amplitude. Details of the voiced strength table (for the voiced one) of the sub-bands 2, 3, 4 are shown in Table 4.

TABLE 4

| | Voiced strength | | |
|---|---|---|---|
| Vector number | Sub-band 2 | Sub-band 3 | Sub-band 4 |
| (f41) | 0.285 | 0.713 | 0.627 |
| (f42) | 0.81 | 0.75 | 0.67 |
| (f43) | 0.773 | 0.691 | 0.695 |

FIG. 8 is a graph showing the voiced strengths (when it is voiceless) of the sub-bands 2, 3, 4 in the conventional system.

The sub-bands 2, 3, 4 voiced strength table (for the voiceless one) 164 makes determination on the basis of a result of measurement of the voiced strengths of the sub-bands 2, 3, 4 in the voiceless frame in FIG. 8. The measurement method in FIG. 8 and the method of determining the details of the table are exactly the same as those in the case of the above-described voiced frame. It is seen from FIG. 8 that there is the following tendency.

The voiced strength of the sub-band 2 of the frame (the mark ♦) that the average value of the spectrum envelope amplitudes of the sub-band 2 is maximized becomes smaller than the voiced strengths of the sub-band 2 marked with ■ and ▲. Likewise, the voiced strength of the sub-band 3 of the frame (the mark ■) that the average value of the spectrum envelope amplitudes of the sub-band 3 is maximized becomes smaller than the voiced strengths of the sub-band 3 marked with ♦ and ▲. Likewise, the voiced strength of the sub-band 3 of the frame (the mark ♦) that the average value of the spectrum envelope amplitudes of the sub-band 4 is maximized becomes smaller than the voiced strengths of the sub-band 4 marked with ♦ and ■. Details of the table in FIG. 8 are shown in Table 5.

TABLE 5

| | Voiced strength | | |
|---|---|---|---|
| Vector number | Sub-band 2 | Sub-band 3 | Sub-band 4 |
| (g101) | 0.247 | 0.263 | 0.301 |
| (g102) | 0.34 | 0.253 | 0.317 |
| (g103) | 0.324 | 0.266 | 0.29 |

A parameter interpolator 140 linearly interpolates the respective parameters (c2), (a2), (g2), (j2) (i2) and (n2) in synchronization with the pitch period respectively and outputs (o2), (p2), (r2), (s2), (t2) and (u2). Linear interpolation processing which is performed here is performed in accordance with (Formula 3).

$$\text{Parameter after interpolation} = \text{Parameter of current frame} \times \text{int} + \text{Parameter of previous frame} \times (1.0 - \text{int}) \quad \text{(Formula 3)}$$

Here, the parameter of the current frame corresponds to each of (c2), (e2), (g2), (j2), (i2) and (n2) and the parameter after interpolation corresponds to each of (o2), (p2), (r2), (s2), (t2) and (u2). The parameter of the previous frame is given by holding (c2), (e2), (g2), (j2), (i2) and (n2) in the previous frame.

int is an interpolation coefficient and is obtained using (Formula 4).

$$\text{int} = \text{to}/160 \quad \text{(Formula 4)}$$

Here, 160 is the number of samples per voice decoding frame length (20 ms) and to is a start sample point of 1 pitch period in a decoding frame and is updated by adding the pitch period every time a reproduced voice for 1 pitch period is decoded. When to exceeds "160", it means termination of decoding processing of that frame and "160" is subtracted from to. A pitch period calculator 141 inputs interpolated pitch period (o2) and jitter value (p2) and calculates a pitch period (q2) using (Formula 5).

$$\text{Pitch period } (q2) = \text{Pitch period } (o2) \times (1.0 - \text{Jitter value } (p2) \times \text{Random number value}) \quad \text{(Formula 5)}$$

Here, the random number value takes a value within a range from −1.0 to 1.0. Although the pitch period (q2) has a numerical figure after the decimal point, it is rounded off and is converted into an integer. In the following, the pitch period (q2) which is converted into the integer will be expressed as an integer pitch period (q2). Since the jitter value is set to "0.25" in the voiceless or aperiodic frame from (Formula 5), the jitter is added and since the jitter value is set to "0" in a perfectly periodic frame, the jitter is not added. However, since the jitter value is subjected to interpolation processing per pitch, there also exists a pitch section to which an intermediate jitter amount for obtaining a range from 0 to 0.25 is added.

To generate the aperiodic pitch (the pitch with the jitter being added) in this way is effective in reducing a tone-like noise by expressing an irregular (aperiodic) glottic pulse which generates in the transient part, the plosive.

A 1-pitch waveform decoder 150 decodes and outputs a reproduced voice (b3) per integer pitch period (q2). Accordingly, all blocks included in this block input the integer pitch period (q2) and operate in synchronization therewith.

A pulse generator 142 outputs a single pulse signal (v2) in a term of the integer pitch period (q2). A noise generator 143 outputs a white noise (w2) which has a length of the integer pitch period (q2). A mixed sound source generator 144 mixes the single pulse signal (v2) with the white noise (m2) on the basis of a mixing ratio (r2) of each sub-band after interpolation and outputs a mixed sound source signal (x2).

A configuration of the mixed sound source generator 144 is shown in FIG. 9. FIG. 9 is a diagram showing the mixed sound source generator of the conventional system.

First, a course of generating a mixed signal (q5) of the sub-band 1 will be described. An LPF 1_170 bandlimits the single pulse signal (v2) at 0 to 1 kHz and outputs (a5). An LPF 2_171 bandlimits the white noise (w2) at 0 to 1 kHz and outputs (b5). A multiplier 1_178, a multiplier 2_179 multiply (a5), (b5) by sb1_p, sb1_n included in the mixing ratio information (r2) and output (i5), (j5) respectively.

An adder 1_186 adds (i5) and (j5) together and outputs the mixed signal (q5) of the sub-band 1. Also, a mixed signal (r5) of the sub-band 2 is formed by using a BPF 1_172, a BPF 2_173, a multiplier 3_180, a multiplier 4_181, and an adder 2_189 similarly. Also, a mixed signal (s5) of the sub-band 3 is formed by using a BPF 3_174, a BPF 4_175, a multiplier 5_182, a multiplier 6_183, and an adder 3_190 similarly. Also, a mixed signal (t5) of the sub-band 4 is formed by using an HPF 1_176 a HF 2_177 a multiplier 7_184, a multiplier 8_185, and an adder 4_191 similarly. An adder 5_192 adds the mixed signals (q5), (r5), (s5) and (t5) of the respective sub-bands together and synthesizes a mixed sound source signal (x2).

A linear prediction coefficient calculator 2_147 converts the LSF coefficient (t2) after interpolation into a linear prediction coefficient and outputs a liner prediction coefficient (c3). An adaptive spectrum enhancement filter 145 is an adaptive pole-zero filter which uses the one that bandwidth extension processing is performed on the linear prediction coefficient (c3) as a coefficient and improves the naturality of the reproduced voice by making resonance of formants sharp and thereby improving the degree of approximation of a natural voice to the formants. Further, it corrects the inclination of the spectrum by using an interpolated inclination correction coefficient (s2) and thereby reduces muffling of the sound. The mixed sound source signal (x2) is filtered by the adaptive spectrum enhancement filter 145 and (y2) which is a result thereof is output. An LPC synthesis filter 146 is an all-pole filter which uses the linear prediction coefficient (c3) as the coefficient and adds the spectrum envelope information to the sound source signal (y2) and outputs a signal (z2) which is a result thereof. A gain adjustor 148 performs gain adjustment on (z2) by using gain information (u2) and outputs (a3). A pulse diffusion filter 149 is a filter adapted to improve the degree of approximation of the pulse sound source waveform to the glottic pulse waveform of the natural voice and filters (a3) and outputs a reproduced signal (b3) which is improved in naturality.

CITATION LIST

Patent Literature

PTL 1: Japanese Patent No 3292711

Non-Patent Literature

Non-Patent Literature 1: Seiji Sasaki, Teruo Roku, "Commercial-Mobile-Communication-Oriented Low-Bit-Rate Voice CODEC Using Mixed Excitation Linear Prediction Encoding", IEICE (D-II), Vol. J84-D-II, No. 4, pp. 629-640, April 2001.

SUMMARY OF INVENTION

Technical Problem

Sound articulation of at least 80% can be maintained by using a 3.2 kbps voice encoding Codec technology including conventional error correction, irrespective of occurrence of the transmission error of 7%. However, in a case where a transmission error rate exceeds 7%, influence of the transmission error which occurs in a bit which belongs to a class on which no error protection is performed or a bit which belongs to a class to which an error correction code which is weak in correcting capability is applied is increased and quality deterioration of the reproduced voice becomes remarkable.

An object of the present invention is to provide a voice communication system which makes it possible to reduce the quality deterioration of the reproduced voice.

Solution to Problem

Summary of the representative one in the present disclosure will be briefly described as follows.

That is, the voice communication system is equipped with a voice encoder which performs encoding processing on a voice signal per frame which is a predetermined time unit and outputs voice information bits, an error detection/error correction encoder which adds error detection codes to all or some of the voice information bits and sends a bit string that error correction encoding is performed on a string of the bits to which the error detection codes are added, an error correction decoding/error detector which receives the bit string which is subjected to error correction encoding, performs error correction decoding on the received bit string which is subjected to error correction encoding and performs error detection on the voice information bit string obtained after error correction decoding and a voice decoder which reproduces a voice signal from the voice information bit string after error correction decoding and, on that occasion, in a case where an error is detected as a result of error detection by the error correction decoding/error detector, replaces the voice information bit string after error correction decoding with a voice information bit string in a past error-free frame and thereafter reproduces the voice signal, in which the voice encoder performs classification in accordance with a degree of importance which is the magnitude of auditory influence when an error occurs in each bit of the voice information bit string, classifies a group of bits which are high in degree of importance into a core layer and classifies a group of bits which are not high into an extension layer, the error detection/error correction encoder sends the bit string which is subjected to error correction encoding after addition of the error detection codes as for the bits which are classified into the core layer and sends the bit string without performing addition of the error detection codes and error correction encoding as for the bits which are classified into the extension layer, the error correction decoding/error detector receives the bit string sent from the error detection/error correction encoder and performs error correction decoding-error detection processing on the bit string in the core layer, and the voice decoder decodes a voice by using the bit strings in both of the core layer and the extension layer on the basis of frequency that the error is detected by the error detection processing and when the frequency is low and decodes the voice using all bits or only some bets in the core layer when the frequency is high.

Advantageous Effects of Invention

According to the above-described voice communication system, it becomes possible to reduce the quality deterioration of the reproduced voice.

BRIEF DESCRIPTION OF DRAWINGS

FIG. 15 is a diagram showing layer allocation of voice information bits.

FIG. 16 is a diagram showing specifications of error detection/error correction encoding.

FIG. 17 is a diagram showing layers used in respective scalable decoding modes.

FIG. 22 is a diagram showing layer allocation of voice information bits.

FIG. 23 is a diagram showing specifications of error detection/error correction encoding.

FIG. 24 is a diagram showing layers used in the respective scalable decoding modes.

FIG. 29 is a diagram showing specifications of error detection/error correction encoding/repetitive transmission.

FIG. 33 is a diagram showing specifications of error detection/error correction encoding/transmission power.

DESCRIPTION OF EMBODIMENTS

<Embodiment 1>

In the following, the embodiment 1 of the present invention will be described by using FIG. 10 to FIG. 13.

Figure 10:
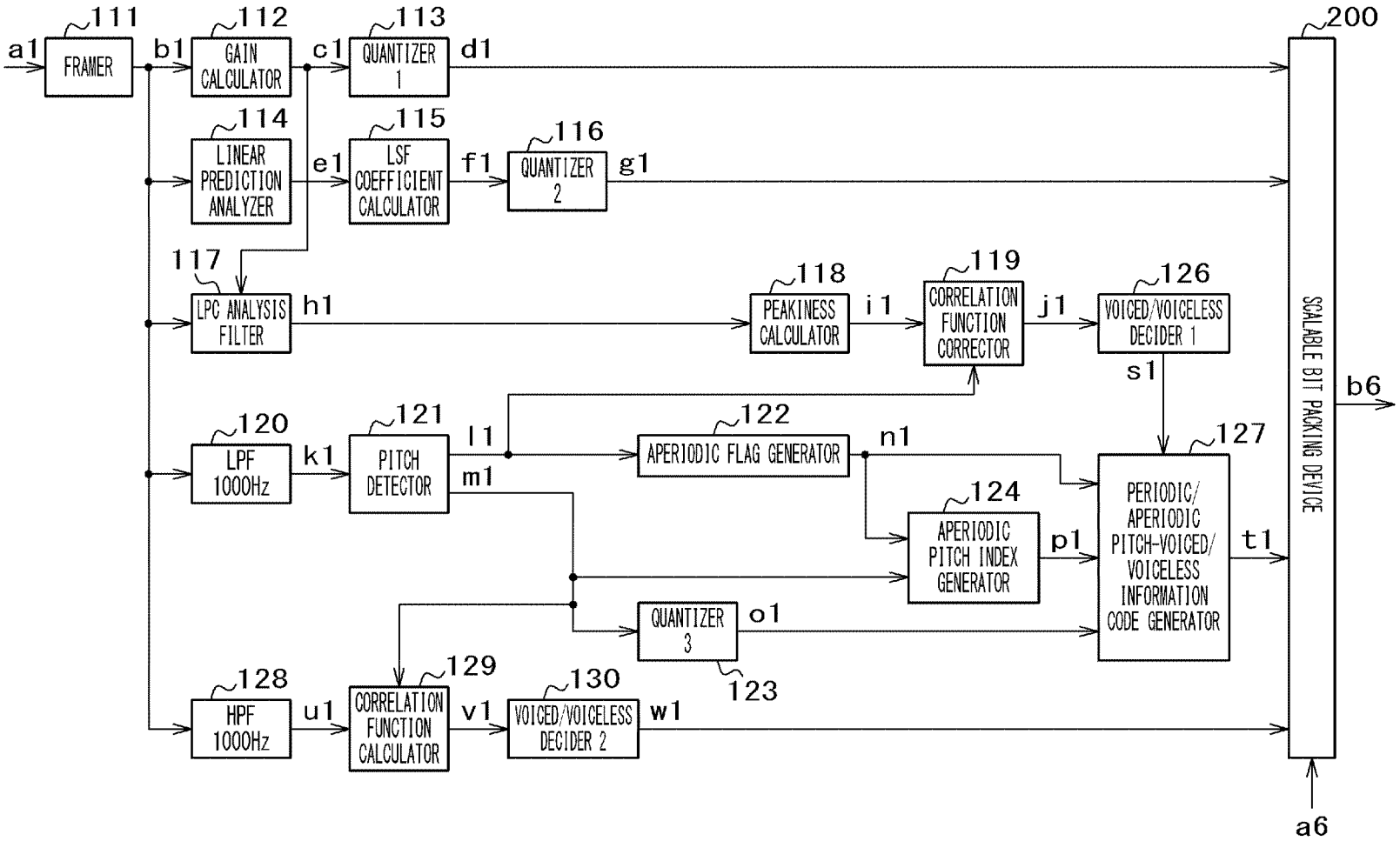
FIG. 10 is a diagram showing a voice encoder according to an embodiment 1 of the present invention.

FIG. 10 is a diagram showing a voice encoder according to an embodiment 1 of the present invention.

Figure 11:
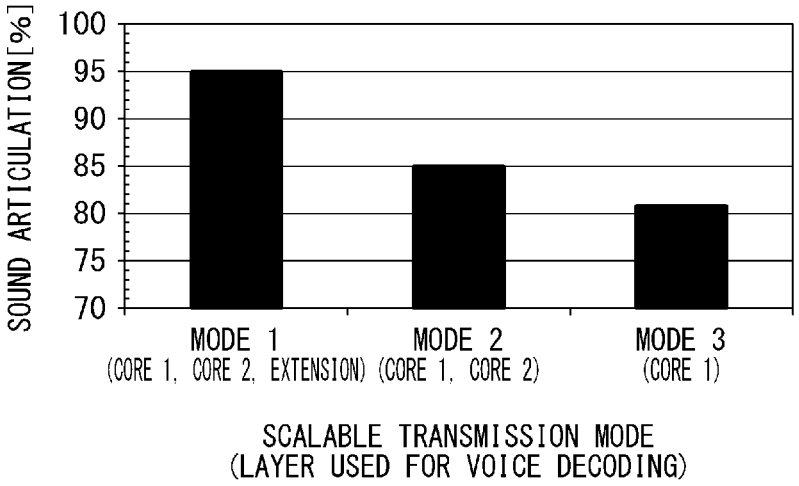
FIG. 11 is a graph showing a result of sound articulation measurement in respective scalable transmission modes.

FIG. 11 is a graph showing a result of sound articulation measurement in respective scalable transmission modes.

Figure 12:
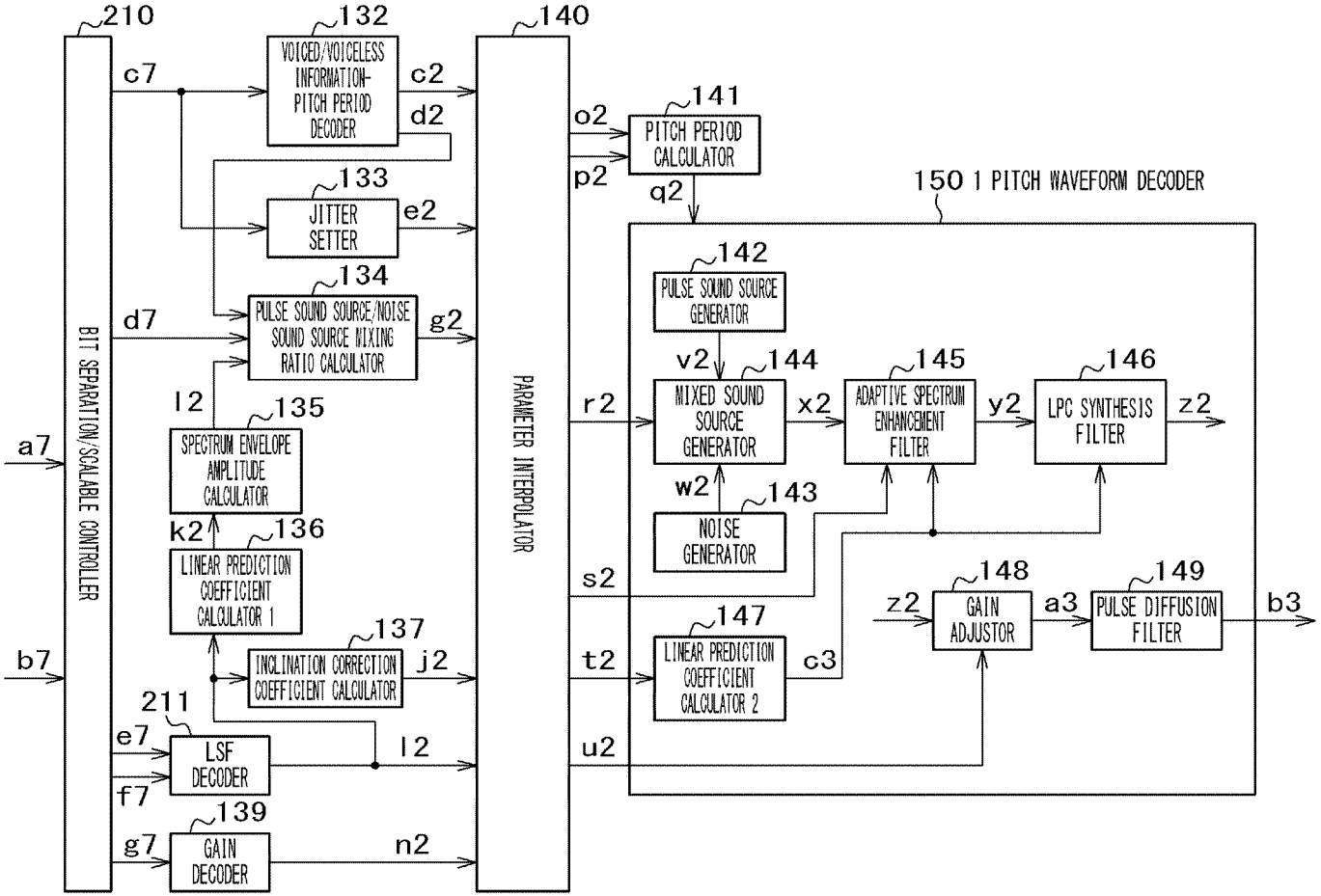
FIG. 12 is a diagram showing a voice decoder according to the embodiment 1 of the present invention.

FIG. 12 is a diagram showing a voice decoder according to the embodiment 1 of the present invention.

Figure 13:
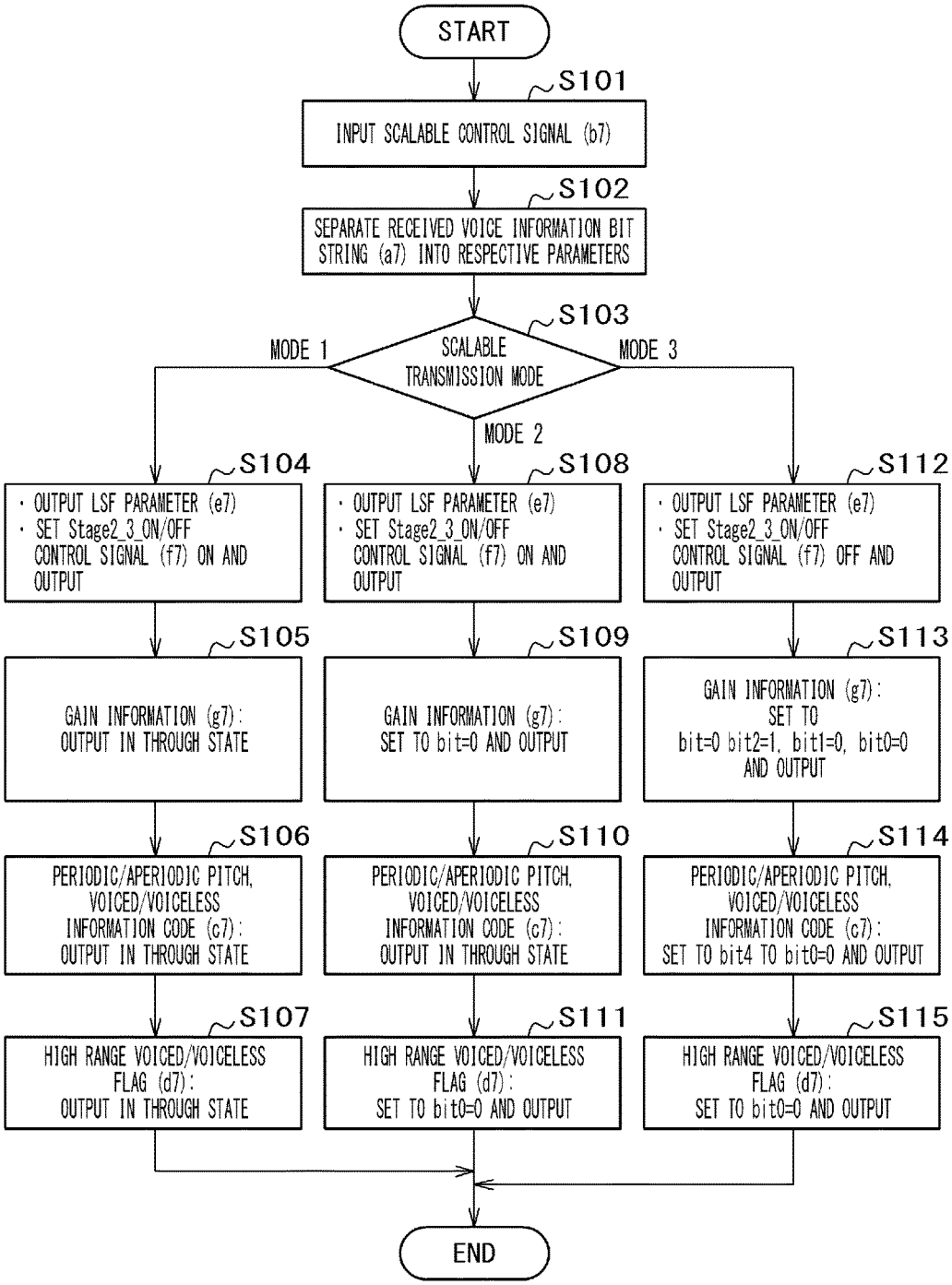
FIG. 13 is a flowchart showing an operation of a bit separator/scalable decoding controller according to the embodiment 1 of the present invention.

FIG. 13 is a flowchart showing an operation of a bit separator/scalable decoding controller according to the embodiment 1 of the present invention.

Figure 1:
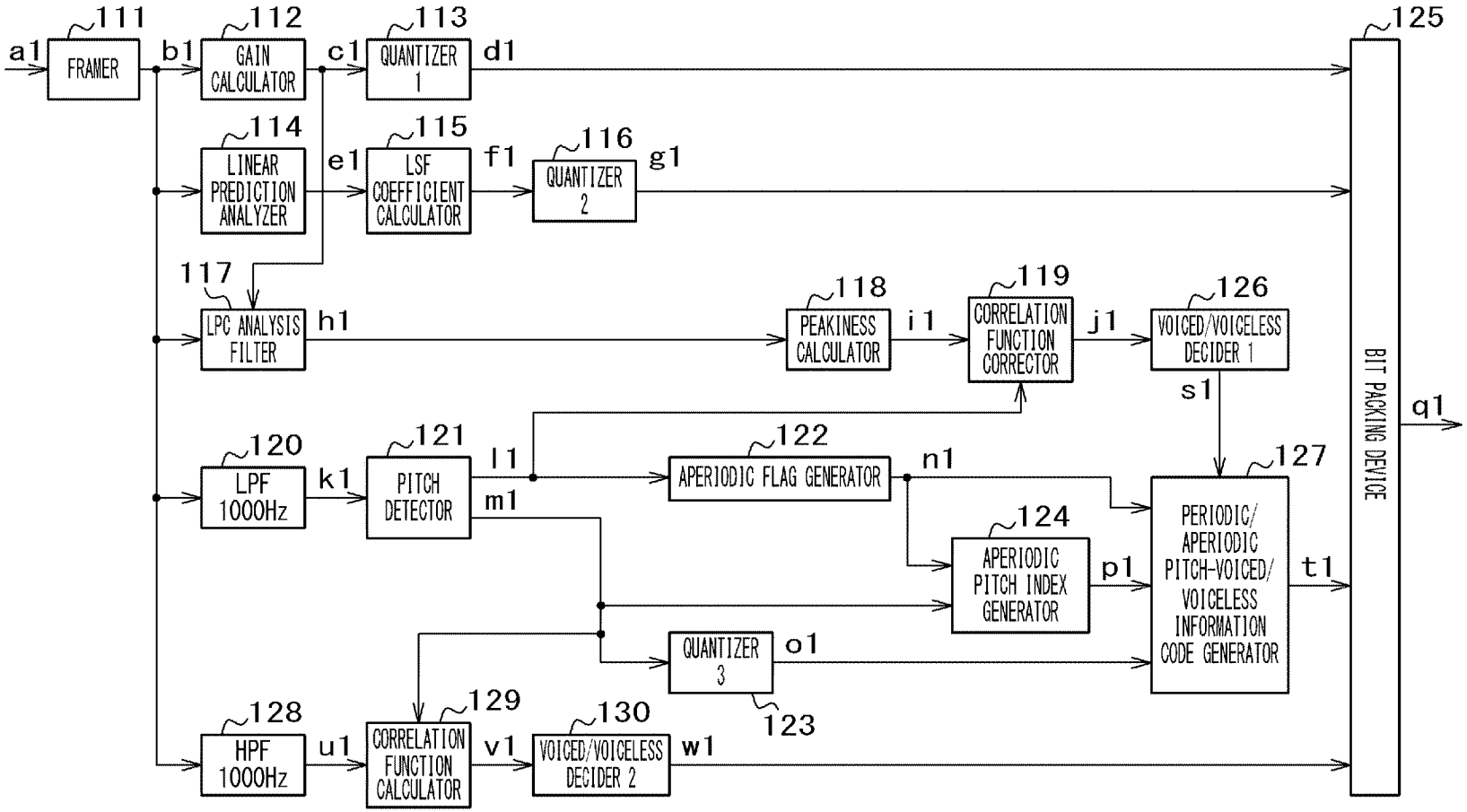
FIG. 1 is a diagram showing one example of a voice encoder of a conventional system.
Figure 2:
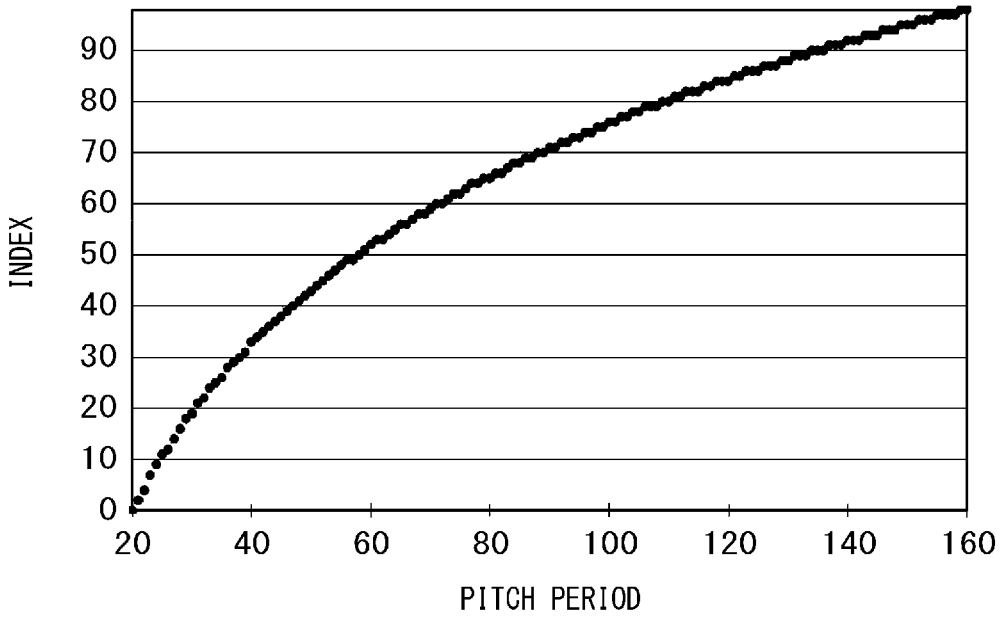
FIG. 2 is a diagram showing a relation between a pitch period and an index in the conventional system.
Figure 3:
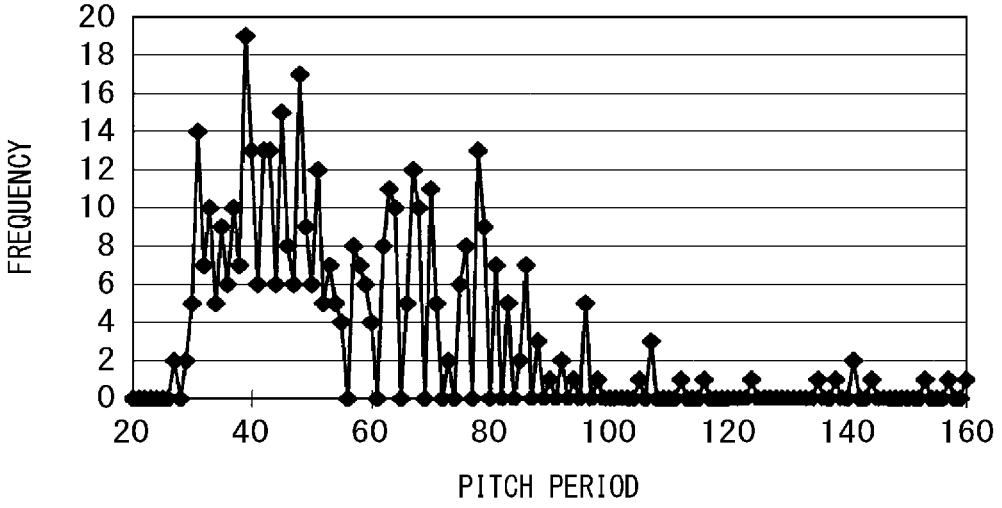
FIG. 3 is a diagram showing frequency of the pitch period in the conventional system.
Figure 4:
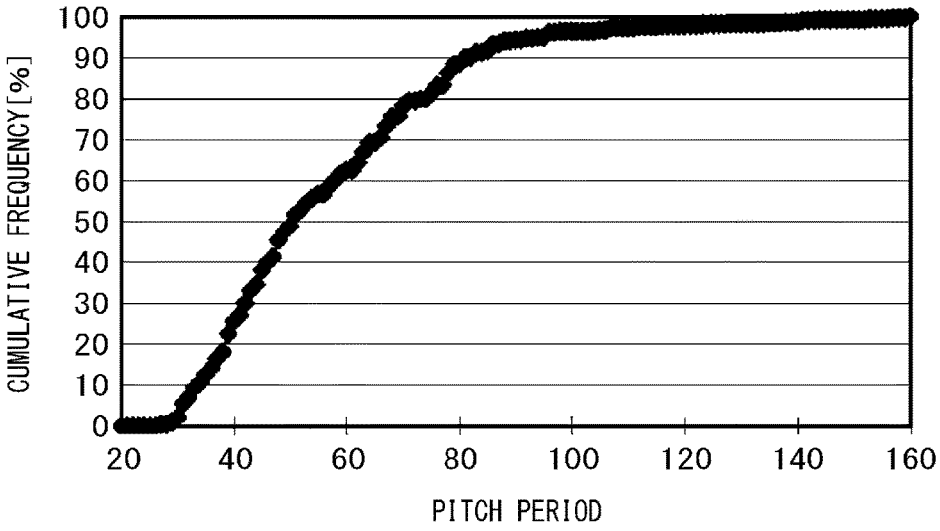
FIG. 4 is a diagram showing cumulative frequency of the pitch period in the conventional system.

In FIG. 10, the point which is different from that of the conventional voice encoder in FIG. 1 is the point that the bit packing device 125 in FIG. 1 is replaced with a scalable bit packing device 200.

In the following, the scalable bit packing device 200 will be described.

The scalable bit packing device 200 selects a transmission layer in each scalable transmission mode, as shown in Table 6, on the basis of a scalable control signal (a6) which indicates the scalable transmission mode and sends it as (b6). Thereby, it becomes possible to set a voice encoding rate to three stages as shown in Table 6.

Incidentally, the scalable control signal (a6) can be determined in a state of shifting up and down a number (1, 2, 3) of each mode on the basis of a storage amount of a not shown transmission buffer which temporarily stores b6, a delay and an error rate which are acquired in a lower layer (for example, RTCP) of a protocol stack or can be also uniquely determined in accordance with a transmission rate and a current rate of a wireless layer which are determined at start of a session by SIP and so forth. In this case, it may be given from an application which has an I/F of the wireless layer and grasps a transmission state.

Allocation of voice information bits to the respective layers will be described using Table 7.

As shown in Table 7, classification is performed in accordance with a degree of importance (high, moderate, low) which is the magnitude of auditory influence when an error occurs in each bit of a voice information parameter, a group of bits which are "high" in degree of importance is classified into a core layer 1, a group of bits which are "moderate" in degree of importance is classified into a core layer 2 and a group of bits which are "low" in degree of importance is classified into an extension layer. In the table, Switch inf. which is an LSF parameter is information on switching between memoryless vector quantization and prediction (memory) vector quantization in a quantizer 2_116 of the aforementioned LSF.

In addition, Stage1, Stage2, Stage3 are indexes in multi-stage vector quantization of 3 stages (7, 6, 5 bits). This 3-stage vector quantization is executed in 3 quantization stages as will be described in the following. Here, a quantization target vector in the following description corresponds to a 10th-order LSF coefficient (f1) vector in the memoryless vector quantization and corresponds to a prediction residual vector when predicting the 10th-order LSF coefficient (f1) vector by using a reproduction vector (i2) of the LSF coefficient in a previous frame in the prediction (memory) vector quantization.

First, in a quantization stage 1, the quantization target vector is quantized with 7 bits by using a codebook 1 having 128 vectors and the index (Stage1) is output. Here, in 128 vectors included in the codebook, the index of the vector whose distance from the quantization target vector is minimized is selected as Stage1.

Next, in a quantization stage 2, a difference vector 1 that a vector in a codebook 1 which corresponds to the index (Stage1) is subtracted from the quantization target vector is quantized with 6 bits by using a codebook 2 having 64 vectors and the index (Stage2) is output. Here, in 64 vectors included in the codebook, the index of the vector whose distance from the above-described difference vector 1 is minimized is selected as Stage2.

Further, in a quantization stage 3, a difference vector 2 that the sum of the vector in the codebook 1 which corresponds to the index (Stage1) and the vector in the codebook 2 which corresponds to the index (Stage2) is subtracted from the quantization target vector is quantized with 5 bits by using a codebook 3 having 32 vectors and the index (Stage3) is output. Here, in 32 vectors included in the codebook, the index of the vector whose distance from the above-described difference vector 2 is minimized is selected as Stage3.

In the column "bit" in Table 7, bit0 means LSB (Least Significant Bit). For example, in the gain information (5 bits), bit0 means the least significant bit, bit4 means the most significant bit. bit4, bit3 are "high" in degree of importance and therefore are allocated to the core layer 1, bit2, bit1 are "moderate" in degree of importance and therefore are allocated to the core layer 2, and bit0 is "low" in degree of importance and therefore is allocated to the extension core layer. The number of bits in the core layer 1 per 1 voice encoding frame (20 ms) is 12 bits, it amounts to 7 bits in the core layer 2 and amounts to 13 bits in the extension layer (32 bits in total).

TABLE 6

| Scalable transmission mode | Transmission layer | Number of bits per 1 frame | Voice encoding rate [kbps] |
|---|---|---|---|
| 1 | Core 1, Core 2, Extension | 32 | 1.6 |
| 2 | Core 1, Core 2 | 19 | 0.95 |
| 3 | Core 1 | 12 | 0.6 |

TABLE 7

| Parameter | | Number of bits per 1 frame | bit (LSB = bit0) | Degree of importance | Layer allocation (*) |
|---|---|---|---|---|---|
| LSF parameter (FIG. 10, g1) | Switch inf. | 1 | bit0 | High | Core 1 |
| | Stage1 | 7 | bit6-bit0 | High | Core 1 |
| | Stage2 | 6 | bit5-bit0 | Low | Extension |
| | Stage3 | 5 | bit4-bit0 | Low | Extension |
| Gain (FIG. 10, d1) | | 5 | bit4, bit3 | High | Core 1 |
| | | | bit2, bit1 | Moderate | Core 2 |
| | | | bit0 | Low | Extension |
| Periodic/aperiodic pitch-voiced/voiceless information code (FIG. 10, t1) | | 7 | bit6, bit5 | High | Core 1 |
| | | | bit4-bit0 | Moderate | Core 2 |
| High range voiced/voiceless flag (FIG. 10, w1) | | 13 | bit0 | Low | Extension |
| Total | | 32 | — | — | Extension |

(*) The core layer 1: 12 bits, the core layer 2: 7 bits, the extension layer: 13 bits An example of a result of measurement of the voice quality in respective scalable transmission modes in Table 6 is shown in FIG. 11. FIG. 11 shows the result of measurement of the sound articulation in absence of transmission error in the respective scalable transmission modes.

The sound articulation is a correct hearing rate in the single sound (a vowel or a consonant) unit when research subjects heard 100 Japanese syllables which are randomly arranged and subjected to encoding processing and a hearing investigation was performed on them. When the sound articulation is at least 80%, it is regarded as having the quality of such an extent that no trouble occurs in a general telephone call. It can be confirmed from FIG. 11 that the sound articulation of at least 80% is obtained in the respective scalable transmission modes. However, as will be described in the following, there is a restriction in regard to the naturality of the reproduced voice and therefore it is not suitable for use by generals users that the naturality of the reproduced voice is seen as being important and it is desirable to apply it to a radio transceiver for business use and so forth that intelligibility is seen as being important.

In the scalable transmission mode 2, although it becomes slightly close to a synthetic voice in comparison with that in the scalable transmission mode 1, it has the quality with which no trouble occurs in the telephone call. However, the sound articulation thereof is deteriorated about 10%. It is thought to be due to an increase in strain of the LSF coefficient which is a characteristic parameter for expressing articulation characteristics in voice generation due to no use of Stage2, Stage3 of the LSF parameter.

In addition, in the scalable transmission mode 3, since voice decoding is performed without using bit4 to bit0 of the periodic/aperiodic pitch-voiced/voiceless information code, information on pitch components for expressing the pitch of the voice is lost and therefore the reproduced voice which is monotonous and poor in naturality is made.

Next, a configuration of a voice decoder according o the embodiment 1 of the present invention will be described by using FIG. 12.

Figure 5:
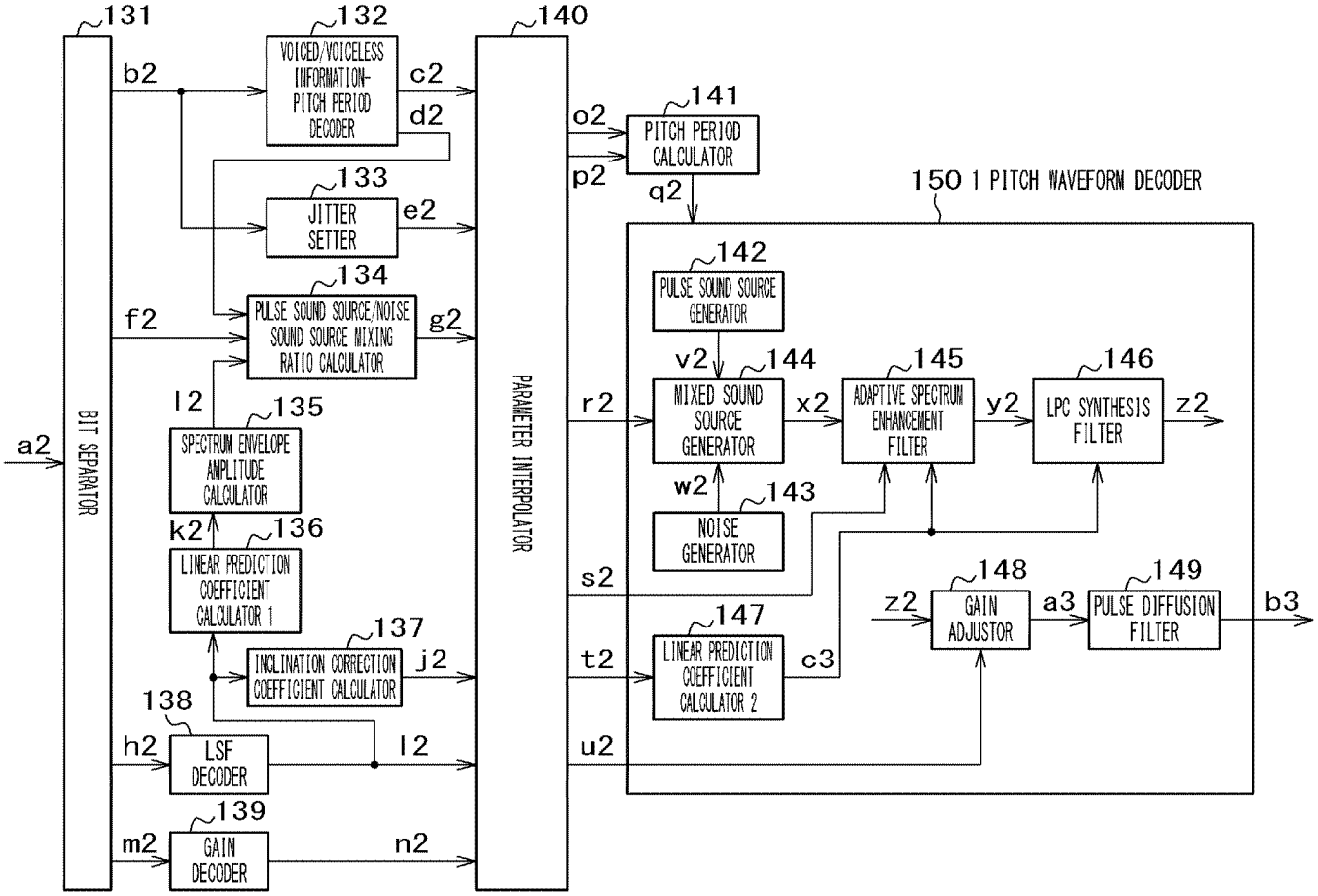
FIG. 5 is a diagram showing one example of a voice decoder of the conventional system.
Figure 6:
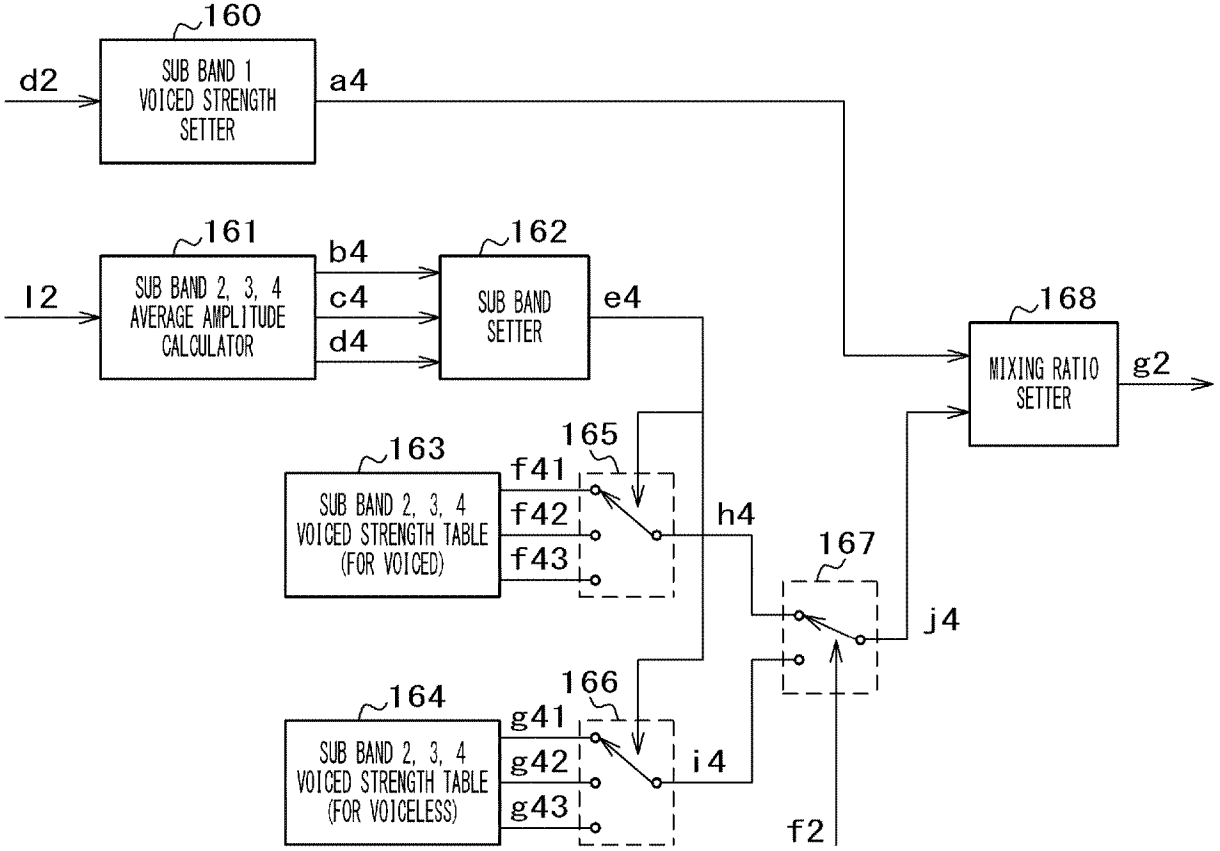
FIG. 6 is a diagram showing a pulse sound source/noise sound source mixing ratio calculator of the conventional system.
Figure 7:
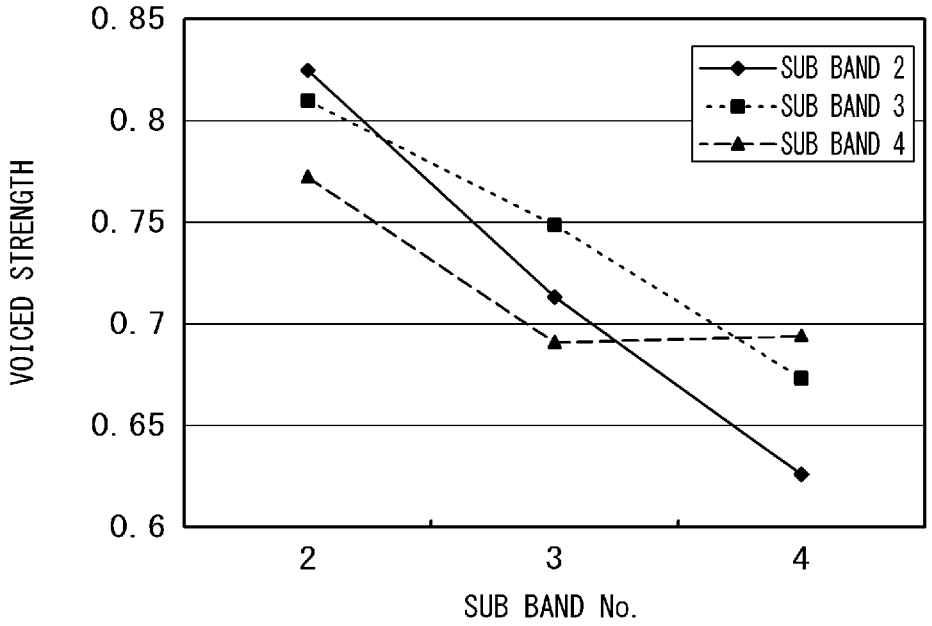
FIG. 7 is a graph showing voiced strengths (when it is voiced) of sub-bands 2, 3, 4 in the conventional system.
Figure 8:
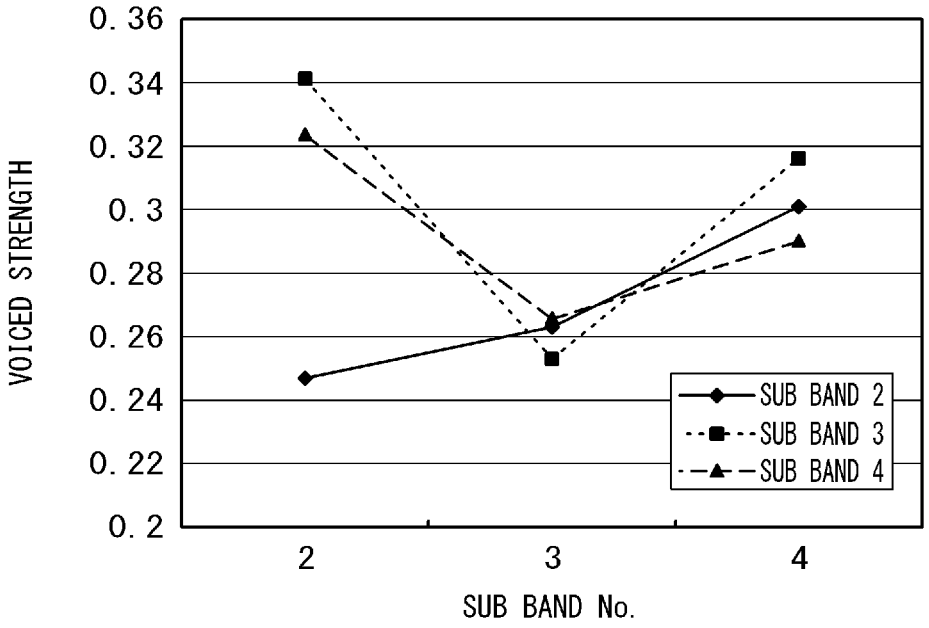
FIG. 8 is a graph showing the voiced strengths (when it is voiceless) of the sub-bands 2, 3, 4 in the conventional system.
Figure 9:
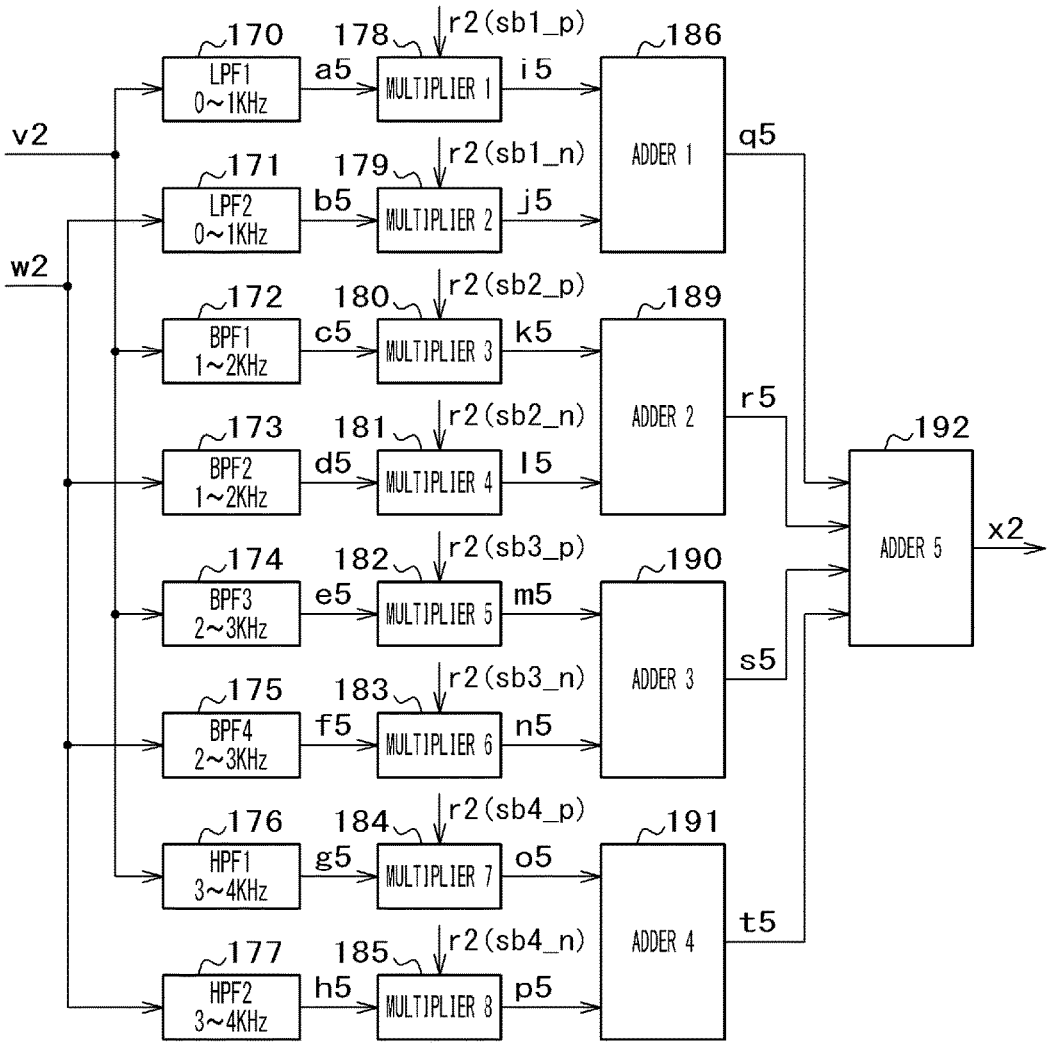
FIG. 9 is a diagram showing a mixed sound source generator of the conventional system.

In FIG. 12, the point which is different from that of the conventional voice decoder (FIG. 5) is only the point that the bit separator 131 in FIG. 5 is replaced with a bit separator/scalable decoding controller 210 and the LSF decoder 138 is replaced with an LSF decoder 211.

Next, an operation of the bit separator/scalable decoding controller 210 will be described by using FIG. 13.

First, a scalable control signal (b7) which indicates the scalable transmission mode is input (step S101) and a received voice information bit string (a7) is separated into respective parameters on the basis of a mode that it indicates (step S102). Here, in a case of the scalable transmission mode 1, the voiced information bits in all the layers are received and therefore a periodic/aperiodic pitch-voiced/voiceless information code (c7), a high range voiced/voiceless flag (d7), an LSF parameter index (e7), gain information (g7) are separated therefrom as the parameters.

In addition, in a case of the scalable transmission mode 2, the parameters corresponding to the voice information bits in only the core layer 1 and the core layer 2 are separated and in a case of the scalable transmission mode 3, the parameters corresponding to the voice information bit in only the core layer 1 are separated. Thereafter, the following scalable control processing is executed.

In the scalable control processing, the following processes are executed per salable transmission mode that the scalable control signal (b7) indicates (step S103).

In a case of the scalable transmission mode 1 in which the voice is decoded by using the information in all the layers, the following processes are executed.

In the process in step S104, Switch inf., Stage1, Stage2 and Stage3 are output as the LSF parameter index (e7). In addition, a Stage2_3_ON/OFF control signal (f7) is set ON and it is informed to the LSF decoder 211, and thereby the LSF coefficient is decoded in the LSF decoder 211 by using Switch inf., Stage1, Stage2 and Stage3. That is, the sum of the vector in the codebook 1 which corresponds to the aforementioned Stage1, the vector in the codebook 2 which corresponds to Stage2 and the vector in the codebook 3 which corresponds Stage3 is set as a reproduction vector.

In the process in step S105, the gain information (g7) is output in through state.

In the process in step S106, the periodic/aperiodic pitch-voiced/voiceless information code (c7) is output in through state.

In the process in step S107, the high range voiced/voiceless flag (d7) is output in through state.

In a case of the scalable transmission mode 2, the following processes are executed in order to make voice decoding which uses the voice information bits in only the core layer 1 and the core layer 2 possible.

In the process in step S108, Switch inf., Stage1 are output as the LSF parameter index (e7). In addition, the Stage2_3_ON/OFF control signal (f7) is set OFF and it is informed to the LSF decoder 211, and thereby it is decoded using only Switch inf. and Stage1 without using Stage2, Stage3 in the LSF decoder 211. Here, the LSF decoder 211 has a function that it can decode the LSF coefficient without using Stage2, Stage3. That is, it has the function of preparing the reproduction vector using only the vector in the codebook 1 which corresponds to the aforementioned Stage1.

In the process in step S109, bit0 which has not been transmitted in the gain information is set to "0" and (g7) is output.

In the process in step S110, the periodic/aperiodic pitch-voiced/voiceless information code (c7) is output in through state.

In the process in step S111, bit0 of the high range voiced/voiceless flag which has not been transmitted in the gain information is set to "0" and (d7) is output.

In a case of the scalable decode mode 3, the following processes are executed in order to make voice decoding possible by using the voice information bit in only the core layer 1.

In the process in step S112, Switch inf., Stage1 are output as the LSF parameter index (e7). In addition, the Stage2_3_ON/OFF control signal (f7) is set OFF and it is informed to the LSF decoder 211, and thereby the LSF coefficient is decoded using only Switch inf. and Stage1 without using Stage2, Stage3 in the LSF decoder 211. Here, the LSF decoder 211 has the function that it can decode the LSF coefficient without using Stage2, Stage3. That is, it has the function of preparing the reproduction vector using only the vector in the codebook 1 which corresponds to the aforementioned Stage1.

In the process in step S113, bit2, bit1, bit0 which have not been transmitted in the gain information are set to 1, "0", "0" respectively and (g7) is output. Avoidance of a reduction in power (loudness of the sound) of the reproduced voice is the reason why bit2 is set to "1".

In the process in step S114, bit4 to bit0 which have not been transmitted in the periodic/aperiodic pitch-voiced/voiceless information code are set to "0s" and (c7 ) is output.

In the process in step S115, bit0 of the high range voiced/voiceless flag which has not been transmitted is set to "0" and (d7) is output.

Although a transmission method for the scalable control signals (a6 in FIG. 10, b7 in FIG. 12) in the above description is not defined, it is ealized by being separately transmitted as control information and so forth.

Voice encoding decoding method and device which are the embodiment 1 of the present invention can provide a voice encoding decoder whose transmission rate can be more flexibly set in accordance with a usage environment in a case where a voice transmission rate is restricted in a wireless system and so forth. A voice encoder performs classification in accordance with the degree of importance which is the magnitude of auditory influence when an error occurs in each bit of the voice information bit string, classifies the group of bits which are high in degree of importance into the core layer, the group of bits which are not high into the extension layer, and sends only the core layer or both of the core layer and the extension layer in accordance with control information which indicates the layer(s) to be transmitted, and thereby in a case where the voice information bit string that the voice decoder receives is the one in only the core layer, it can be applied to a use that voice decoding is made possible with the use of only the voice information bit string in the core layer.

In the following, the embodiment 1 will be summarized.

Improvement of frequency utilization efficiency is promoted while maintaining the quality of the reproduced voice by using the conventional 1.6 kbps voice encoding Codec technology in the wireless communication. However, since the encoding rate is fixed, there is such an issue that in a case where the voice information transmission rate is restricted in the wireless system for some reason and so forth, it cannot cope with it flexibly.

The embodiment 1 provides the voice encoding decoder which can flexibly set the transmission rate in accordance with the usage environment.

The voice encoding decoding method of the embodiment 1 is a voice encoding decoding method of performing encoding processing by a linear prediction analysis-synthetic system voice encoder and reproducing a voice signal from the voice information bit string which is an output that the voice signal is subjected to encoding processing by a voice decoder and is characterized by performing classification in accordance with the degree of importance which is the magnitude of auditory influence when an error occurs in each bit of the voice information bit string, classifying the group of bits which are high in degree of importance into the core layer, classifying the group of bits which are not high into the extension layer, performing encoding processing on it/them in only the core layer or both of the core layer and the extension layer in accordance with control information which indicates the layer(s) to be transmitted and sending it/them, receiving the voice information on which the encoding processing is performed and performing voice decoding with the use of the voice information bit string in the core layer in a case where the received voice information bit string is that in only the core layer.

In addition, the voice encoding decoding method of the embodiment 1 is the above-described voice encoding decoding method and is characterized in that the voice encoder obtains spectrum envelope information, low frequency band voiced/voiceless discrimination information, high frequency band voiced/voiceless discrimination information, pitch period information and gain information and outputs the voice information bit string which is a result of encoding thereof.

In addition, the voice encoding decoding method of the embodiment 1 is the above-described voice encoding decoding method and is characterized in that a voice decoder separates and decodes respective parameters of the spectrum envelope information, the low frequency band voiced/voiceless discrimination information, the high frequency band voiced/voiceless discrimination information, the pitch period information and the gain information included in the voice information bit string, in a low frequency band, determines a mixing ratio when mixing a pitch pulse which is generated in a pitch period that the pitch period information indicates with a white noise and prepares a mixed signal in the low frequency band on the basis of the low frequency band voiced/voiceless discrimination information, in a high frequency band, obtains a spectrum envelope amplitude from the spectrum envelope information, obtains an average value of the spectrum envelope amplitudes per band which is divided on a frequency axis, determines the mixing ratio when mixing the pitch pulse with the white noise per band on the basis of a result of determination of the band that the average value of the spectrum envelope amplitudes is maximized and the high frequency band voiced/voiceless discrimination information and generates a mixed signal, adds together the mixed signals in all the bands which are divided in the high frequency band and generates a mixed signal in the high frequency band, adds together the mixed signal in the low frequency band and the mixed signal in the high frequency band and generates a mixed sound source signal, adds the spectrum envelope information and the gain information to the mixed sound source signal and generates a reproduced signal.

In addition, the voice encoding decoding device of the embodiment 1 is a voice encoding decoding device which is equipped with a voice encoder and a voice decoder and is characterized in that the voice encoder has a scalable bit packing device and the scalable bit packing device sets a voice encoding rate to 3 stages.

Further, the voice encoding decoding device of the embodiment 1 is the above-described voice encoding decoding device and is characterized in that the voice decoder has a bit separation/scalable controller, the bit separation/scalable controller separates respective parameters of the spectrum envelope information, the low frequency band voiced/voiceless discrimination information, the high frequency band voiced/voiceless discrimination information, the pitch period information and the gain information from the received voice information bit string on the basis of a scalable control signal which indicates a scalable transmission mode, outputs them and decodes the voice.

According to the embodiment 1, there can be provided the voice encoding decoder which can flexibly set the transmission rate in accordance with the usage environment in a case where the voice information transmission rate is restricted in the wireless system and so forth.

<Embodiment 2>

Figure 14:
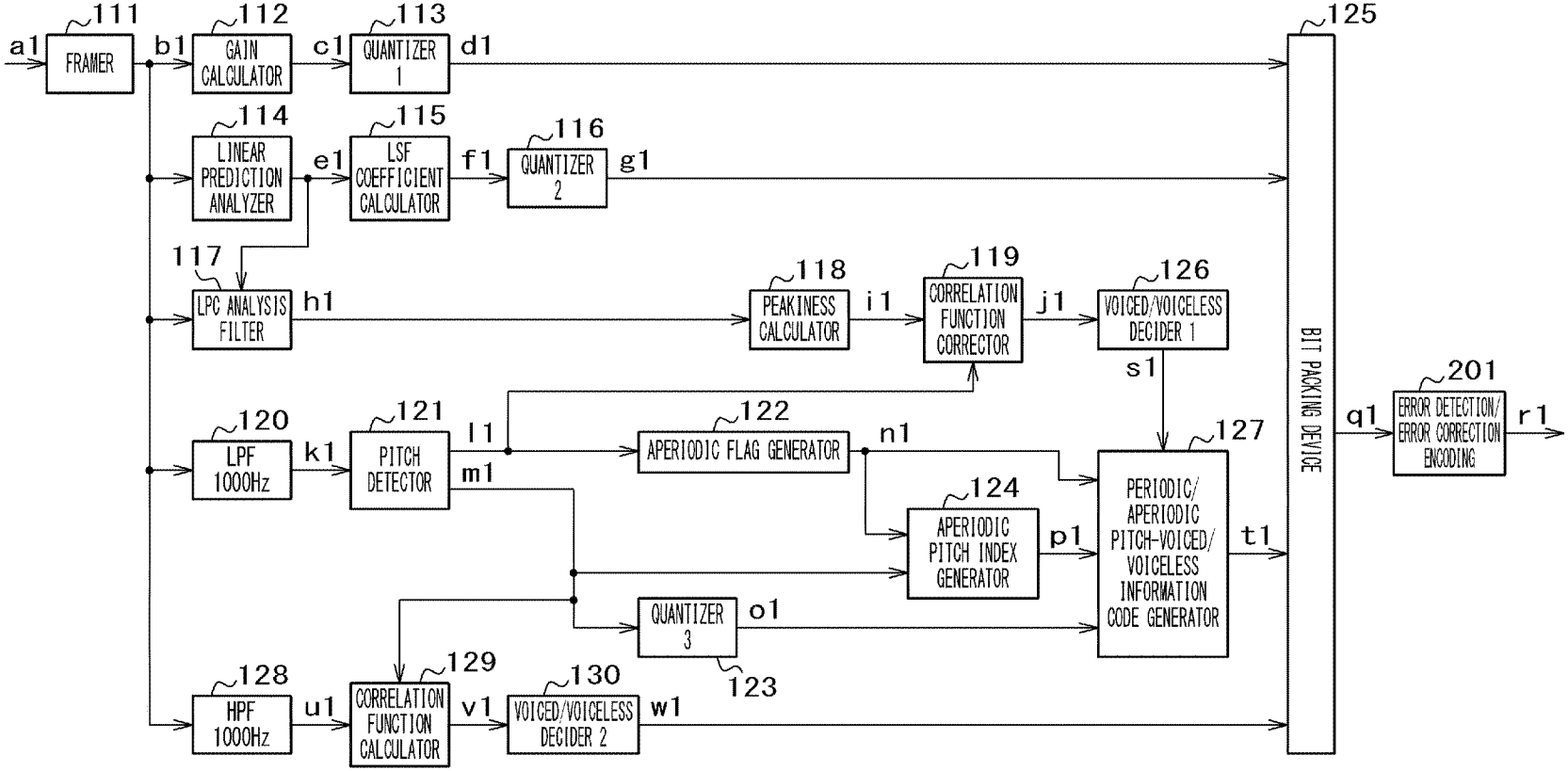
FIG. 14 is a diagram showing one example of a voice encoder and an error detection/error correction encoder according to an embodiment 2 of the present invention.
Figure 18:
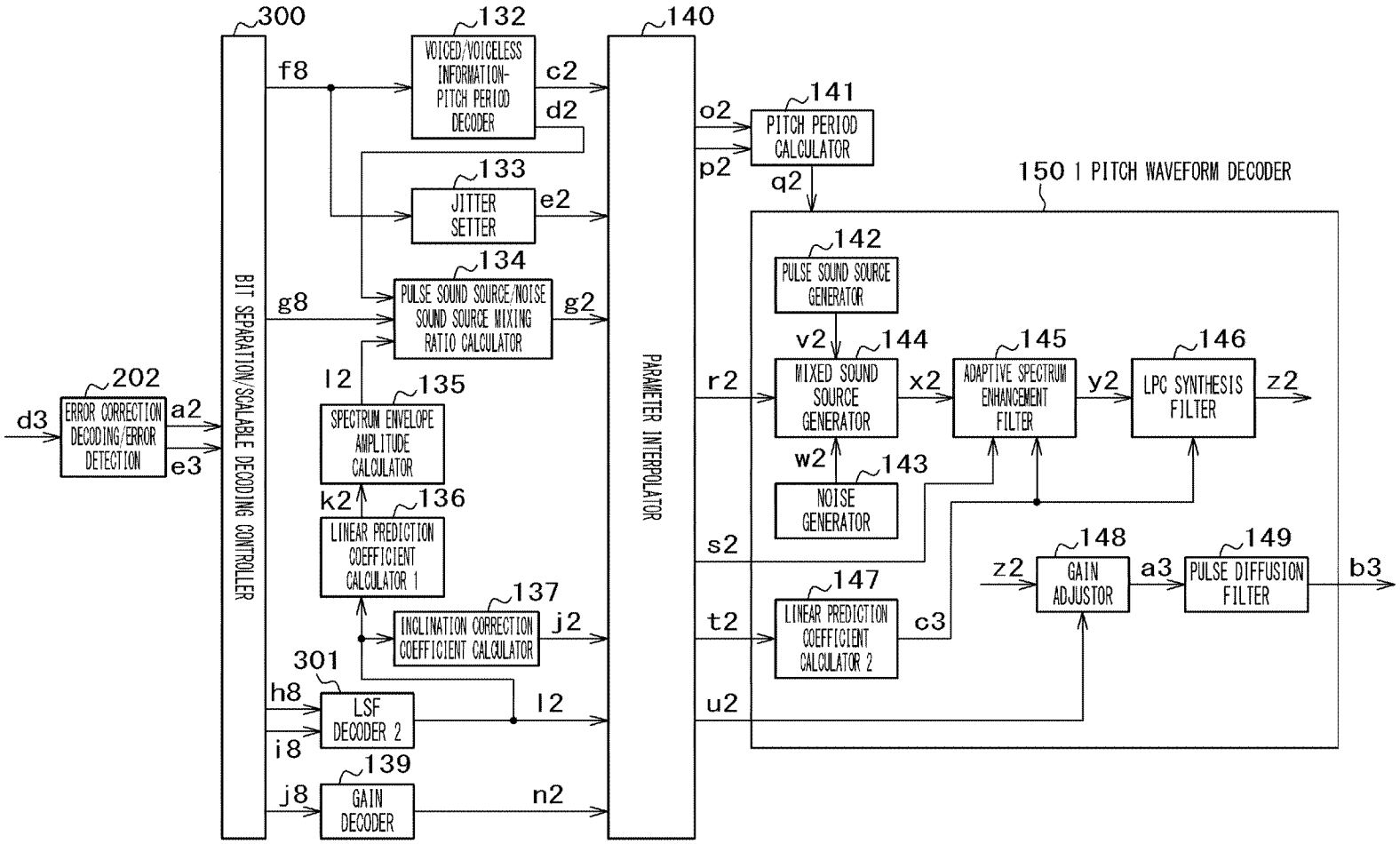
FIG. 18 is a diagram showing one example of a voice decoder and an error correction decoding/error detector according to the embodiment 2 of the present invention.
Figure 19:
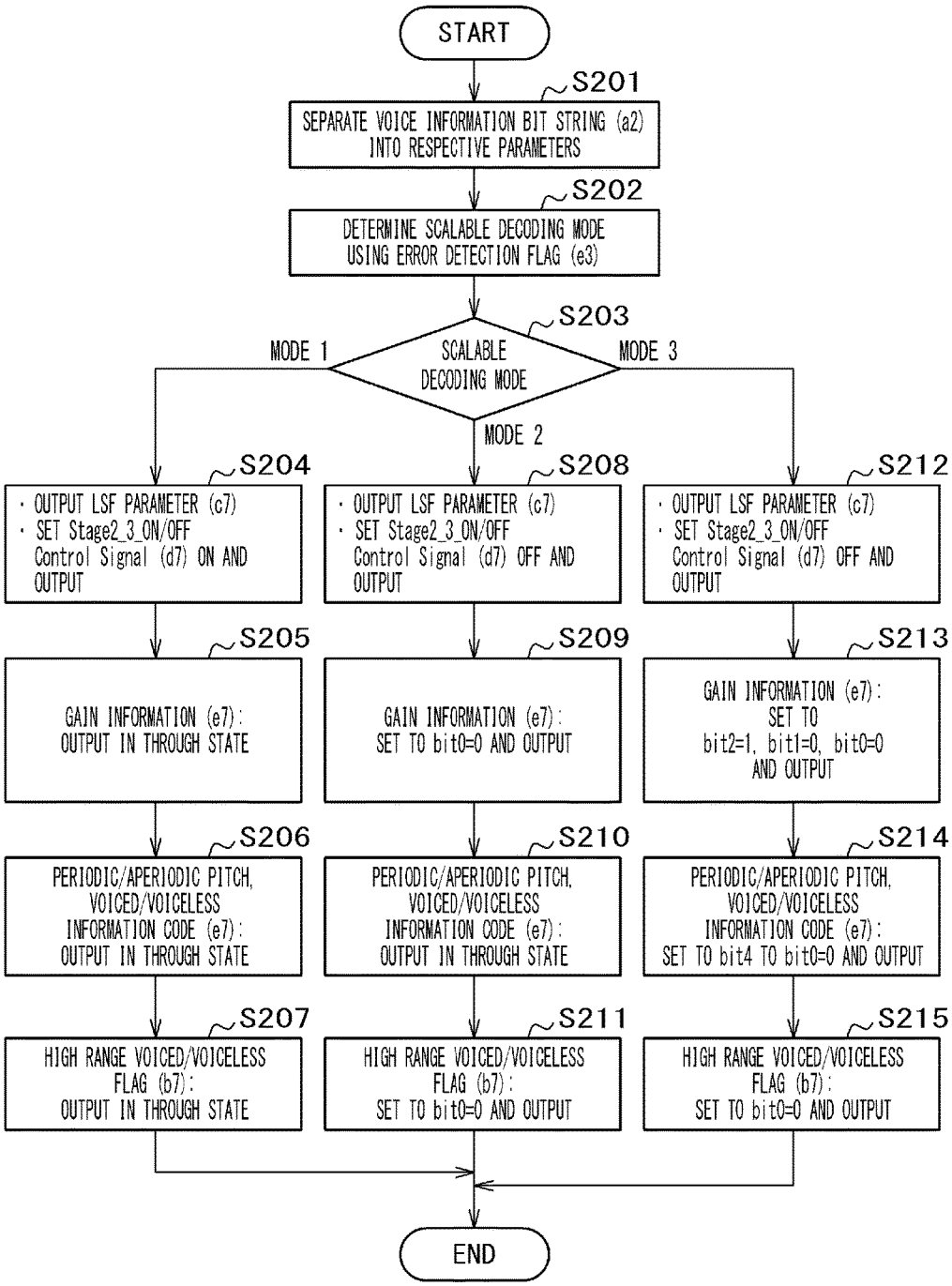
FIG. 19 is a flowchart showing an operation of a bit separator/scalable decoding controller according to the embodiment 2 of the present invention.
Figure 20:
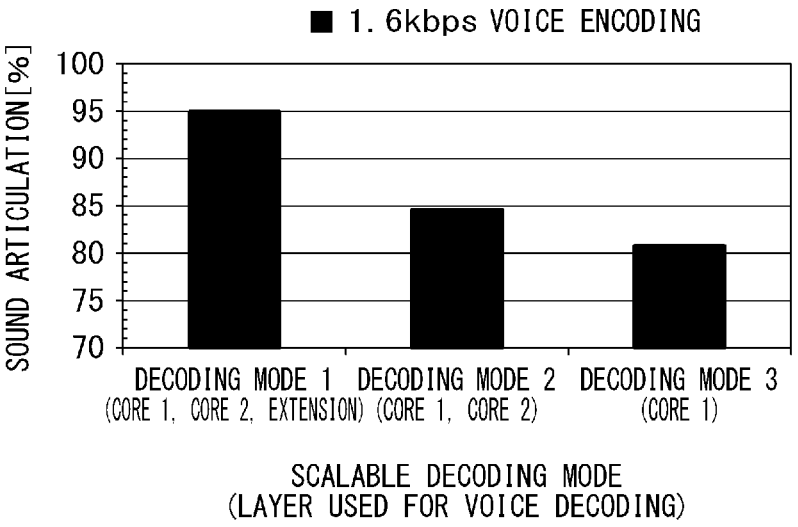
FIG. 20 is a graph showing a result of sound articulation measurement in respective scalable decoding modes.

A first example of the embodiment 2 of the present invention will be described using FIG. 14 to FIG. 20. FIG. 14 is a diagram showing one example of a voice encoder and an error detection/error correction encoder according to an embodiment 2 of the present invention. FIG. 15 is a diagram showing layer allocation of voice information bits. FIG. 16 is a diagram showing specifications of error detection/error correction encoding. FIG. 17 is a diagram showing layers used in respective scalable decoding modes. FIG. 18 is a diagram showing one example of a voice decoder and an error correction decoding/error detector according to the embodiment 2 of the present invention. FIG. 19 is a flowchart showing an operation of a bit separator/scalable decoding controller according to the embodiment 2 of the present invention. FIG. 20 is a graph showing a result of sound articulation measurement in respective scalable decoding modes.

FIG. 14 is the one that an error detection/error correction encoder 201 is added to the voice encoder in FIG. 1.

Error detection and error correction encoding processing is performed on a voice information bit string (q1) by the error detection/error correction encoder 201 as will be described in the following.

As shown in FIG. 15, the voice information bit string (q1) of 32 bits per voice encoding frame (20 ms) is classified into three sensitivity classes (a class 0 to a lass 2) on the basis of the error sensitivity (the degree of importance). Here, 12 bits are allocated to the class (the class 2) which is the highest in error sensitivity, 7 bits are allocated to the class 1 and 13 bits are allocated to the class 0.

In the drawing, Switch inf. of the LSF parameter is the information on switching between the memoryless vector quantization and the prediction (memory) vector quantization in the quantizer 2_116 of the aforementioned LSF.

In addition, Stage1, Stage2, Stage3 are the indexes in the multistage vector quantization of 3 stages (7, 6, 5 bits). This 3-stage vector quantization is executed in 3 quantization stages as will be described in the following. Here, the quantization target vector in the following description corresponds to the 10th-order LSF coefficient (f1) vector in the memoryless vector quantization and corresponds to the prediction residual vector when predicting to 10th-order LSF coefficient (f1) vector by using a reproduction vector of the LSF coefficient in the previous frame in the prediction (memory) vector quantization.

First, in the quantization stage 1, the quantization target vector is quantized with 7 bits by using the codebook 1 having 128 vectors and the index (Stage1) is output. Here, in 128 vectors included in the codebook, the index of the vector whose distance from the quantization target vector is minimized is selected as Stage1.

Next, in the quantization stage 2, the difference vector 1 that the vector in the codebook 1 which corresponds to the index (Stage1) is subtracted from the quantization target vector is quantized with 6 bits by using the codebook 2 having 64 vectors and the index (Stage2) is output. Here, in 64 vectors included in the codebook, the index of the vector whose distance from the above-described difference vector 1 is minimized is selected as Stage2.

Further, in the quantization stage 3, the difference vector 2 that the sum of the vector in the codebook 1 which corresponds to the index (Stage1) and the vector in the codebook 2 which corresponds to the index (Stage2) is subtracted from the quantization target vector is quantized with 5 bits by using the codebook 3 having 32 vectors and the index (Stage3) is output. Here, in 32 vectors included in the codebook, the index of the vector whose distance from the above-described difference vector 2 is minimized is selected as Stage3.

In the column "bit" in FIG. 15, bit0 means the LSB (Least Significant Bit). For example, in the gain information (5 bits), bit0 means the least significant bit, bit4 means the most significant bit. bit4, bit 3 are "high" in degree of importance and therefore are allocated to the class 2, bit2, bit1 are "moderate" in degree of importance and therefore are allocated to the class 1, bit0 is "low" in degree of importance and therefore is allocated to the class 0.

Next, pieces of voice data for 2 frames are collected per 40 ms and addition of an error detection code using a CRC (Cyclic Redundancy Check) code and error correction encoding using an RCPC (Rate Compatible Punctured Convolutional) code are performed. The specifications of error detection/error correction encoding are shown in FIG. 16. Error protection is not performed on the class (the class 0) which is the lowest in error sensitivity. An encoding ratio of the 4-bit CRC code to the RCPC code including 8 tail bits (the bits for zero termination which become necessary in Convolutional encoding/Viterbi decoding) for protection of the class 2 is 4/9, the encoding ratio for the class 1 which is moderate in error sensitivity is 2/3, the number of bits output from the RCPC encoder becomes 125 bits/40 ms, and the bit rate becomes 3.2 kbps. A bit string (r1) which is subjected to error detection/error correction encoding processing by the above-described processes is output. Although illustration thereof is omitted in FIG. 14, the transmission bit string (r1) is then sent to the reception side through interleave processing unit, digital modulation processing unit, a wireless unit, a transmission antenna.

In the first example of the embodiment 2, layer allocation which will be described in the following is performed on the voice information bit string (g1). Allocation of the voice information bits to the respective layers will be described by using FIG. 15. As shown in the drawing, classification is performed in accordance with the degree of importance (high, moderate, low) which is the magnitude of auditory influence when an error occurs in each bit of the voice information parameter and the group of bits which are "high" in degree of importance is classified into the core layer 1, the group of bits which are "moderate" in degree of importance is classified into the core layer 2, the group of bits which are "low" in degree of importance is classified into the extension layer. That is, in this example, the class 2, the class 1 and the class 0 are allocated to the core layer 1, the core layer 2 and the extension layer respectively. Here, a difference between class allocation and layer allocation will be described. The class allocation is classification of bits for changing the strength of error correction in accordance with the degree of importance of each bit when performing transmission error protection. On the other hand, the layer allocation is classification for defining the bit to be used for voice decoding on the reception side and the classification for realizing scalable decoding which will be described in the following. Accordingly, bits which are different from each other may be allocated in the class allocation and the layer allocation.

The layers used in the respective scalable decoding modes in the first example of the embodiment 2 are shown in FIG. 17. In the first example of the embodiment 2, error detection processing is performed on the bit string in the core layer 1 (the same as the class 2) after error correction decoding on the reception side, on the basis of frequency that the error is detected, when the frequency is low, the voice is decoded by using all the bits in the core layer 1, the core layer 2 and the extension layer (a scalable decoding mode 1), when the frequency is moderate, the voice is decoded by using only the bits in the core layer 1 and the core layer 2 (a scalable decoding mode 2), when the frequency is high, the voice is decoded by using those in only the core layer 1 (a scalable decoding mode 3).

Next, configurations of a voice decoder and an error correction decoding/error detector of the first example of the embodiment 2 will be described using FIG. 18. FIG. 18 is a diagram showing one example of the configurations of the voice decoder and the error correction decoding/error detector according to the first example of the embodiment 2. In the drawing, the point which is different from that of the voice decoder (FIG. 12) of the embodiment 1 is the point that an error correction decoding/error detector 202 is added to the front stage of a bit separator/scalable decoding controller 300. Here, in FIG. 18, all the blocks other than the error correction decoding/error detector 202 are constitutional elements of the voice decoder. In the following, an operation of the error correction decoding/error detector 202 will be described by using FIG. 18.

A transmission signal from the transmission side shown in FIG. 14 is received via a reception antenna, a wireless unit, digital demodulation processing unit, deinterleave processing unit (illustration of them is omitted in FIG. 18), is input into the error correction decoding/error detector 202 as a signal (d3) and is subjected to error correction decoding and error detection processing as will be described in the following. In the error correction decoding, soft decision Viterbi decoding is executed per error correction encoding frame 40 [ms] and a voice information bit string (a2) for 2 voice encoding frames (20 [ms]) (32 bits×2) is output. In addition, error detection is performed on the voice information bit string of the class 2 which has been subjected to error correction decoding and an error detection flag (e3) which is a result thereof is output.

The voice information bit string (a2) and the error detection flag (e3) are input into the bit separator/scalable decoding controller 300 of the voice decoder and are subjected to voice decoding processing per 1 voice encoding frame (20 [ms]) (32 bits) as will be described in the following.

First, the bit separator/scalable decoding controller 300 separates the received voice information bit string (a2) into respective parameters (step S201). Here, a periodic/aperiodic pitch-voiced/voiceless information code (which will be output later as f8), a high range voiced/voiceless flag (which will be output later as g8), an LSF parameter index (which will be output later as h8), gain information (which will be output later as j8) are separated as the parameters. Next, the bit separator/scalable decoding controller 300 determines the scalable decoding mode by using the error detection flag (e3) (step S202). Specifically, frequency that the error detection flag (a3) indicates "Error Present" is observed as indicated in the following and a degree of transmission error occurrence is estimated, and thereby the scalable decoding mode is determined on the basis of it. For example, the error detection flags (e3) for 10 past frames counted from the current voice encoding frame are stored and when the frame number for which the error detection flag (e3) indicates "Error Present" is 0 frame in 10 frames, it is determined as the scalable decoding mode 1, it is determined as the scalable decoding mode 2 when it is 1 to 4 frames, it is determined as the scalable decoding mode 3 when it is at least 5 frames. Owing to scalable decoding, it becomes possible to suppress quality deterioration of the reproduced voice caused by an increase in influence of transmission error which would occur in the bit in the extension layer on which error protection is not performed or the bit in the core layer to which an error correction code which is weak in correction capability is applied. In the scalable decoding processing, the following processes are executed on the basis of the scalable decoding mode determined in step S202 (step S203).

In a case of the scalable decoding mode 1 in which the voice is decoded using the information of all the layers, the following processes are executed.

Step S204: The bit separator/scalable decoding controller 300 outputs Switch inf., Stage1, Stage2 and Stage3 as the LSF parameter index (h8). In addition, a Stage2_3_ON/OFF control signal (i8) is set ON and it is informed to an LSF decoder 2_301, and thereby the LSF coefficient is decoded by using Switch inf., Stage1, Stage2 and Stage3 in the LSF decoder 2_301. That is, the reproduction vector is generated by using the vector in the codebook 1 which corresponds to the aforementioned Stage1, the vector in the codebook 2 which corresponds to Stage2 and the vector in the codebook 3 which corresponds to Stage3.

Step S205: The bit separator/scalable decoding controller 300 outputs the gain information (j8) in through state.

Step S206: The bit separator/scalable decoding controller 300 outputs the periodic/aperiodic pitch-voiced/voiceless information code (f8) in through state.

Step S207: The bit separator/scalable decoding controller 300 outputs the high range voiced/voiceless flag (g8) in through state.

In a case of the scalable decoding mode 2, the following processes are executed in order to make voice decoding which uses the voice information bits in only the core layer 1 and the core layer 2possible.

Step S208: The bit separator/scalable decoding controller 300 outputs Switch inf., Stage1 as the LSF parameter index (h8). In addition, the Stage2_3_ON/OFF control signal (i8) is set OFF and it is informed to the LSF decoder 2_301, and thereby the LSF coefficient is decoded by using only Switch inf. and Stage 1 without using Stage 2, Stage3 which belong to the extension layer in the LSF decoder 2_301. Here, the LSF decoder 2_301 has a function that it can decode the LSF coefficient without using Stage2, Stage3. That is, it has the function of preparing the reproduction vector by using only the vector in the codebook 1 which corresponds to the aforementioned Stage1.

Step S209: The bit separator/scalable decoding controller 300 sets bit0 which belongs to the extension layer in the gain information to "0" and outputs (j8).

Step S210: The bit separator/scalable decoding controller 300 outputs the periodic/aperiodic pitch-voiced/voiceless information code (f8) in through state.

Step S211: The bit separator/scalable decoding controller 300 sets bit0 of the high range voiced/voiceless flag which belongs to the extension layer to "0" and outputs (g8).

In a case of the scalable decoding mode 3, the following processes are executed in order to make voice decoding possible by using the voice information bit in only the core layer 1.

Step S212: The bit separator/scalable decoding controller 300 outputs Switch inf., Stage1 as the LSF parameter index (h8). In addition, the Stage2_3_ON/OFF control signal (d7) is set OFF and it is informed to the LSF decoder 2_301, and thereby the LSF coefficient is decoded by using only Switch inf. and Stage 1 without using Stage2, Stage3 which belong to the extension layer in the LSF decoder 2_301. Here, the LSF decoder 2_301 has the function that it can decode the LSF coefficient without using Stage2, Stage3. That is, it has the function of preparing the reproduction vector by using only the vector in the codebook 1 which corresponds to the aforementioned Stage1.

Step S213: The bit separator/scalable decoding controller 300 sets bit2, bit1 which belong to the core layer 2 to 1, to "0" and bit0 which belongs to the extension layer to "0" respectively in the gain information and outputs (j8). Avoidance of the reduction in power (the loudness of the sound) of the reproduced voice is the reason why bit2 is set to "1".

Step S214: The bit separator/scalable decoding controller 300 sets bit4 to bit0 which belong to the core layer 2 in the periodic/aperiodic pitch-voiced/voiceless information code to "0s" and outputs (f8).

Step S215: The bit separator/scalable decoding controller 300 sets bit0 of the high range voiced/voiceless flag which belongs to the extension layer to "0" and outputs (g8).

An example of a result of measurement of the quality of the voices in the respective scalable decoding modes in FIG. 17 is shown in FIG. 20. The drawing shows the result of measurement of the sound articulation when there is no transmission error in the respective scalable decoding modes. It can be confirmed from the drawing that the sound articulation of at least 80% is obtained in the respective scalable decoding modes. However, as will be described in the following, there is the restriction in regard to the naturality of the reproduced voice and therefore it is not suitable for use by the general users that the naturality of the reproduced voice is seen as being important and it is desirable to apply it to the radio transceiver for business use and so forth that intelligibility is seen as being important.

In the scalable decoding mode 2, although it becomes slightly close to the synthetic voice in comparison with that in the scalable decoding mode 1, it has the quality which causes no trouble in the telephone call. However, the sound articulation thereof is deteriorated about 10%. It is thought to be due to the increase in strain of the LSF coefficient which is the characteristic parameter for expressing articulation characteristics in voice generation due to no use of Stage2, Stage3 of the LSF parameter.

In addition, in the scalable decoding mode 3, since voice decoding is performed without using bit4 to bit0 of the periodic/aperiodic pitch-voiced/voiceless information code, the information on pitch components for expressing the pitch of the voice is lost and therefore the reproduced voice which is monotonous and poor in naturality is made.

Figure 21:
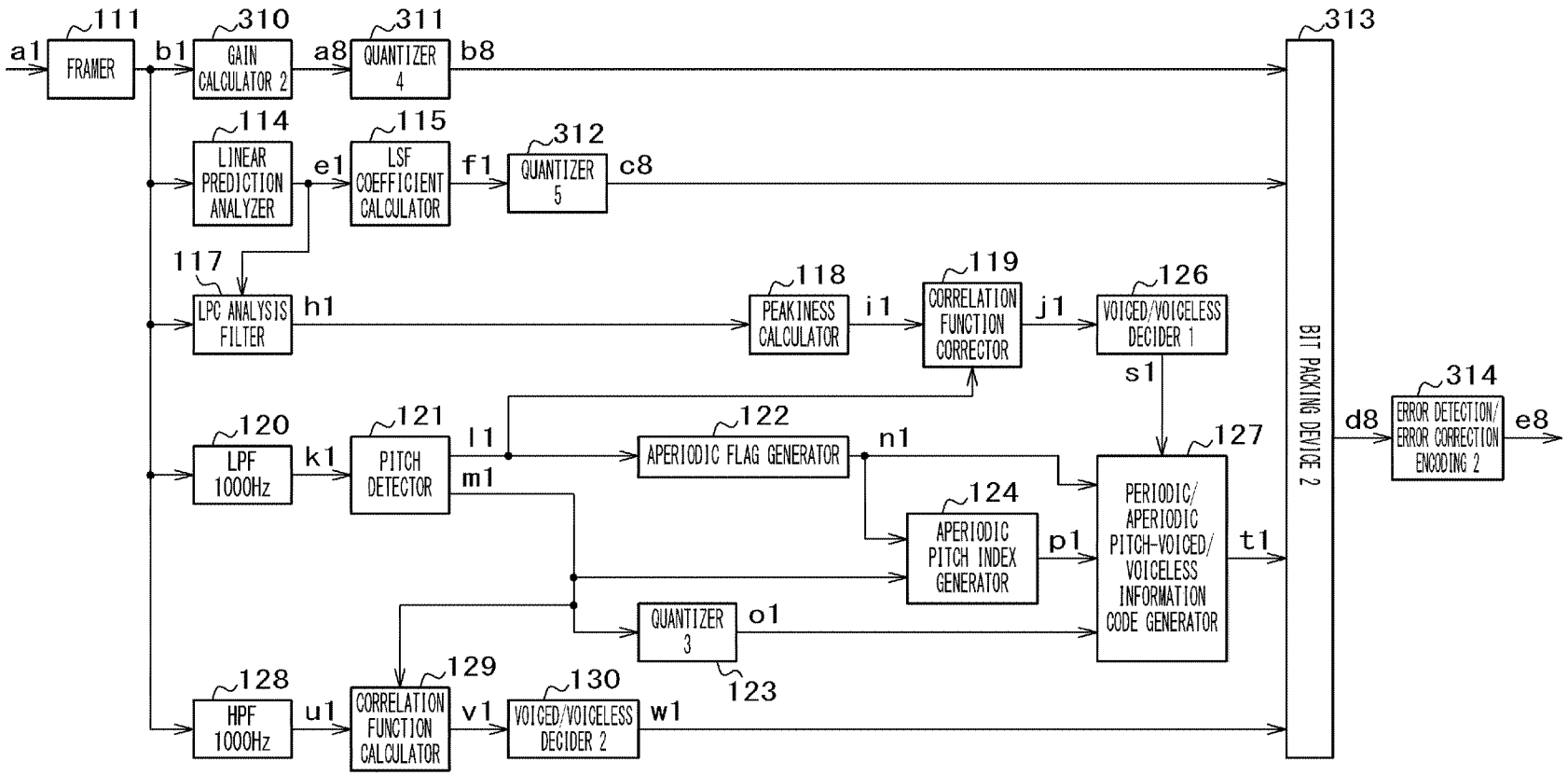
FIG. 21 is a diagram showing another example of the voice encoder and the error detection/error correction decoder according to the embodiment 2 of the present invention.
Figure 25:
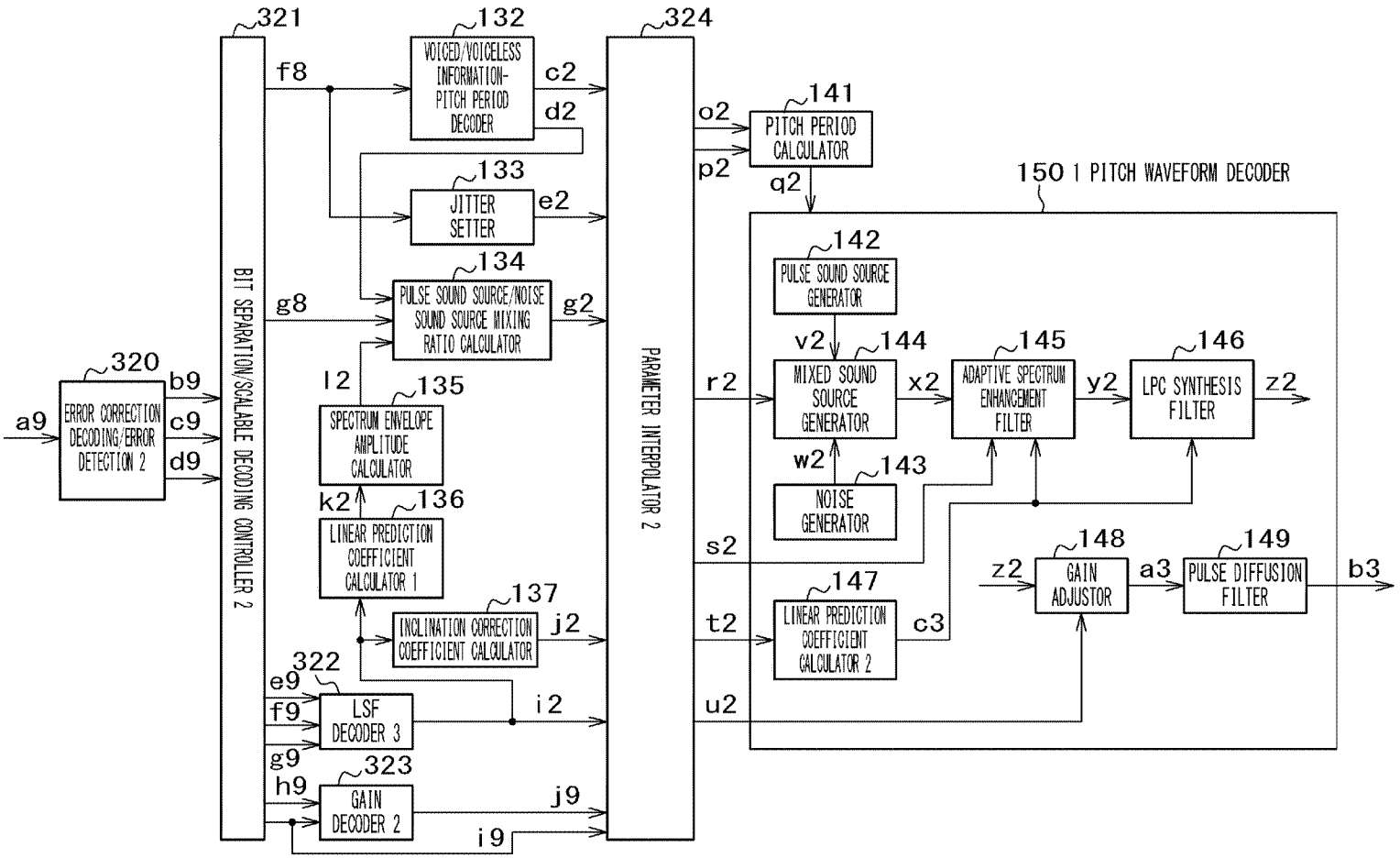
FIG. 25 is a diagram showing another example of the voice decoder and the error correction decoding/error detector according to the embodiment 2 of the present invention.
Figure 26:
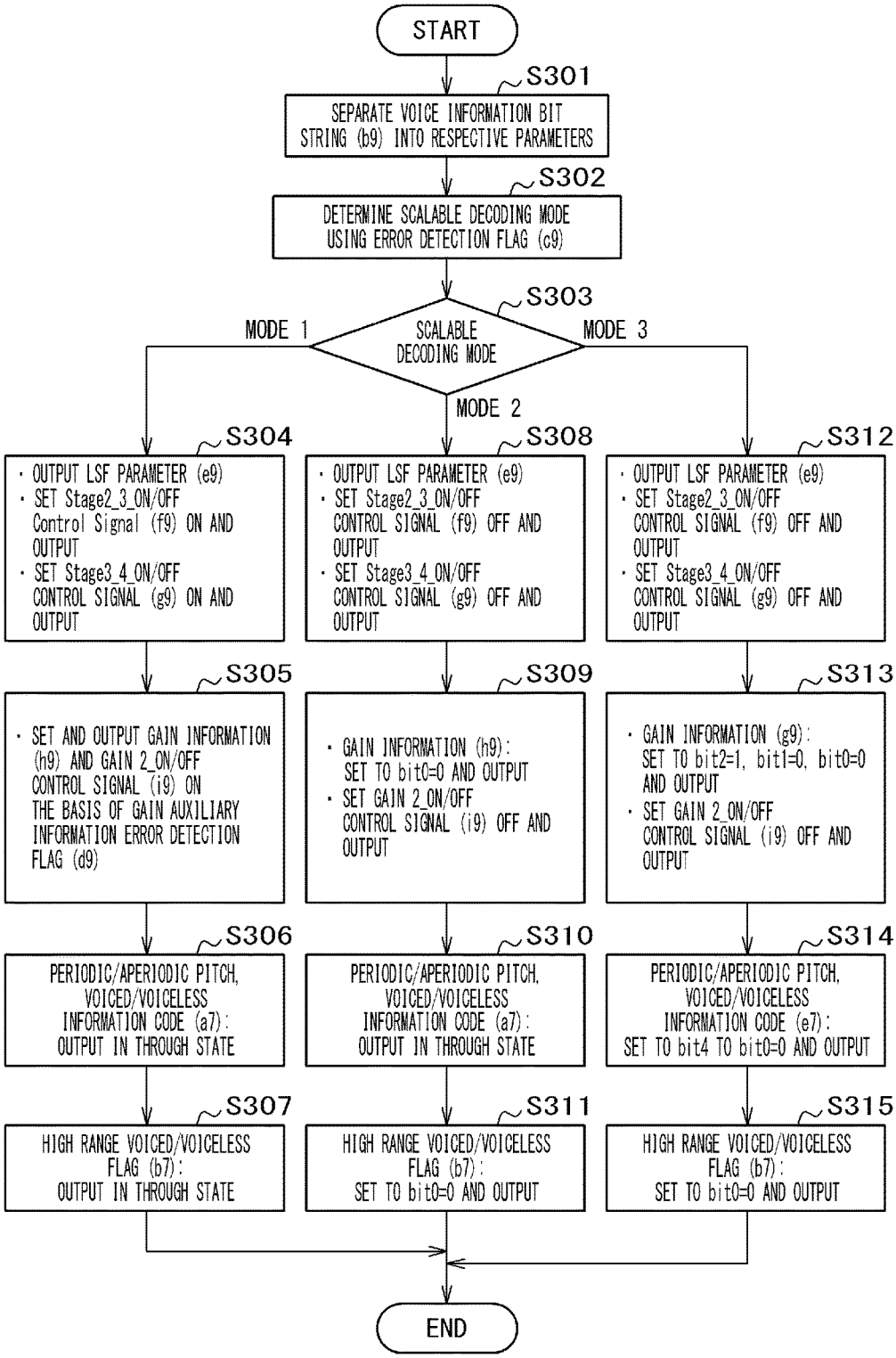
FIG. 26 is a flowchart showing an operation of a bit separator/scalable decoding controller 2 according to the embodiment 2 of the present invention.
Figure 27:
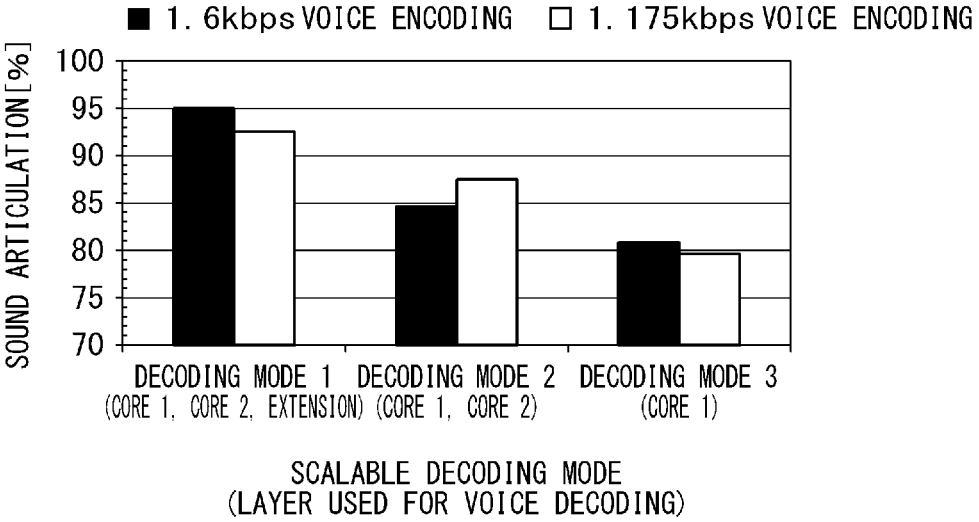
FIG. 27 is a graph showing a result of sound articulation measurement in the respective scalable decoding modes.

Next, a second example of the embodiment 2 of the present invention will be described using FIG. 21 to FIG. 27. FIG. 21 is a diagram showing another example of the voice encoder and the error detection/error correction decoder according to the embodiment 2 of the present invention. FIG. 22 is a diagram showing layer allocation of voice information bits. FIG. 23 is a diagram showing specifications of error detection/error correction encoding. FIG. 24 is a diagram showing layers used in the respective scalable decoding modes. FIG. 25 is a diagram showing another example of the voice decoder and the error correction decoding/error detector according to the embodiment 2 of the present invention. FIG. 26 is a flowchart showing an operation of a bit separator/scalable decoding controller 2 according to the embodiment 2 of the present invention. FIG. 27 is a graph showing a result of sound articulation measurement in the respective scalable decoding modes.

The second example of the embodiment 2 is an embodiment which aims to promote improvement of the quality of the reproduced voice in the scalable decoding mode 2 and to improve resistance to the transmission error in the first example of the above-described embodiment 2. Points of change in the second example of the embodiment 2 relative to the prior art, the first example of the embodiment 2 will be summarized in the following.

In a voice encoder in FIG. 21, the voice encoding frame length is changed from 20 ms in FIG. 14 to 40 ms and the voice information bit of 47 bits are output per 40 ms as shown in the column "NUMBER OF BITS PER 1 FRAME (40 ms)" in layer allocation of the voice information bit string in FIG. 22. Accordingly, each block of the voice encoder in FIG. 21 operates so as to perform encoding processing per voice encoding frame 40 ms and a voice information bit string (d8) of 47 bits (1,175 kbps in voice encoding rate) is output from a bit packing device 2(313) per 40 ms.

Here, the voice encoder and an error detection/error correction encoder in FIG. 21 are functionally different from those in FIG. 14 in the point that the gain calculator 112 is replaced with a gain calculator 2(310), the quantizer 1(113) is replaced with a quantizer 4(311), the quantizer 2(116) is replaced with a quantizer 5(312), the bit packing device (125) is replaced with a bit packing device 2(313), the error detection/error correction encoder (201) is replaced with an error detection/error correction encoder 2(314) respectively except the point that the voice encoding frame length is changed from 20 ms to 40 ms and operations thereof will be described in the following.

The gain calculator 2(310) in FIG. 21 calculates also gain auxiliary information together with the gain information which is calculated in the first example of the embodiment 2 and outputs it as (a8). The aforementioned gain information is calculated by placing the central point of a calculation object range at the central position of the voice encoding frame. On the other hand, the gain auxiliary information is calculated by shifting the central point of the calculation object range in a past direction by 1/4 frame from the central position of the voice encoding frame. Thereby, the gain information is transmitted by extracting it 2 times per 1 frame and thereby it becomes possible to suppress a reduction in expression accuracy of power change caused by doubling of the frame length to 40 ms. The quantizer 4(311) inputs the gain information and the gain auxiliary information (a8), quantizes the gain information with 5 bits and quantizes the gain auxiliary information with 8 bits and outputs them as (b8). Then, the gain auxiliary information is input into the error detection/error correction encoder 2(314) via the bit packing device 2(313) and is sent to the reception side as an 8-bit bit string which is subjected to error detection/error correction encoding using a BCH (7,4) code and an even-numbered parity 1 bit separately from other voice information bits. Single error correction, double error correction become possible by applying the BCH (7,4) code and the even-numbered parity 1 bit. The 8-bit gain auxiliary information (after application of BCH (7,4)+the even-numbered parity 1 bit) can be classified as the extension layer and transmitted as shown in FIG. 22 by protecting the gain information from errors independently in this way, even though the gain auxiliary information is high in transmission error sensitivity. On the reception side, it is used in voice decoding only in a case where no error is detected in the gain auxiliary information. This function improves the voice quality in the scalable decoding mode 1 which is selected when the line quality is favorable. Here, the above-described gain information and gain auxiliary information (a8) are also called first gain information and second gain information respectively.

The quantizer 5(312) in FIG. 21 is a quantizer for the LSF coefficient and the following alterations are made on the first example of the embodiment 2 in the second example of the embodiment 2.

Switching between the memoryless vector quantization and the prediction (memory) vector quantization is not performed and only the memoryless vector quantization is used. Thereby, error propagation is eliminated by removing elements which are called prediction by the previous frame and switching and thereby the transmission error resistance can be improved.

The number of multi-stages of the memoryless vector quantization is increased from 3 stages to 4 stages to be made as the 4-stage (8,6,6,6 bits) one. Thereby, although the number of quantization bits of the LSF coefficient is increased from 19 bits (3 stages (7,6,5 bits) to 26 bits (4 stages (8,6,6,6 bits), it becomes possible to avoid a reduction in quantization accuracy caused by no use of the prediction (memory) vector quantization and changing of the frame length from 20 ms to 40 ms. Description of the operation of the 4-stage (8,6,6,6 bits) multi-stage vector quantization is omitted because description of the aforementioned multi-stage vector quantization of 3 stages (7,6,5 bits) may be used by extending it to 4 stages.

From the above, in the LSF parameters in the column "NUMBER OF BITS PER ONE FRAME (40 ms)" in the layer allocation of the voice information bits in FIG. 22, Switch inf. is deleted and Stage1, Stage2, Stge3, Stage4 are set. In addition, the bit of Stage2 is added to the core layer 2. Thereby, improvement of the reproduced voice quality in the scalable decoding mode 2 in which voice decoding is performed using only the core layer 1 and core layer 2 becomes possible.

The error detection/error correction encoder 2(314) independently performs error protection on the gain auxiliary information as described above and executes error detection/error correction (RCPC) encoding on the voice information bits in the class 1 (corresponding to the core layer 1) and the class 2 (corresponding to the core layer 2) per 40 ms as shown in the specifications of the error detection/error correction encoding in FIG. 23. The encoding ratio of the 4-bit CRC code to the RCPC code including 8 tail bits for protection of the class 2 is 1/3, the encoding ratio for the class 1 which is moderate in error sensitivity is 13/34 and the number of bits output from the RCPC encoder is 128 bits/40 ms (3.2 kbps in bit rate). The bit rate of the output from the RCPC encoder is the same as that in the first example of the embodiment 2. However, while the voice encoding rate in the first example of the embodiment 2 is 1.6 kbps, it is highly compressed to 1.175 kbps in the second example of the embodiment 2 and therefore the encoding ratios of the RCPC encoder for the core layer 1 and the core layer 2 are set smaller and more bits are allocated to error correction. Thereby, the transmission error resistance can be improved. The error-protected bit string (e8) which is output from the error detection/error correction encoder 2(314) is sent to the reception side. Here, the above-described error detection/error correction encoder 2(314) is configured to have both of the function of the first error detection/error correction encoder and the function of the second error detection/error correction encoder in combination.

The layers used in the respective scalable decoding modes in the second example of the embodiment 2 are shown in FIG. 24. Similarly to the first example of the embodiment 2, error detection processing is performed on the bit string in the core layer 1 (the same as the class 2) after error correction decoding on the reception side, on the basis of the frequency that the error is detected, when the frequency is low, the voice is decoded by using all the bit strings in the core layer 1, the core layer 2 and the extension layer (the scalable decoding mode 1), when the frequency is moderate, the voice is decoded by using only the bits in the core layer 1 and the core layer 2 (the scalable decoding mode 2) and when the frequency is high, the voice is decoded by using only those in the core layer 1 (the scalable decoding mode 3). The voice encoding rates in the respective scalable decoding modes are different from those in the first example of the embodiment 2 as shown in the drawing.

Next, configurations of a voice decoder and an error correction decoding/error detector of the second example of the embodiment 2 will be described by using FIG. 25. In the drawing, the point which is different from that of the first example of the embodiment 2 is only the point that the error correction decoding/error detector (202) in FIG. 18 is replaced with an error correction decoding/error detector 2(320), the bit separator/scalable decoding controller (300) is replaced with a bit separator/scalable decoding controller 2(321), the LSF decoder 2(301) is replaced with an LSF decoder 3(322), a gain decoder (139) is replaced with a gain decoder 2(323) and a parameter interpolator (140) is replaced with a parameter interpolator 2(324). In the following, operations thereof will be described.

The error correction decoding/error detector 2(320) receives the bit string (e8) sent from the reception side in FIG. 21 as (a9) and executes error correction decoding and error detection processing thereon. In the error correction decoding to be performed on the bits in the core layer 1 and the core layer 2, soft decision Viterbi decoding is executed per error correction encoding frame 40 [ms] and error correction decoding and error detection processing is executed also on the gain auxiliary information which is protected by using the BCH(7,4) code and the even-numbered parity 1 bit and a voice information bit string (b9) for 1 (47 bits) voice encoding frame (40 [ms]) is output. In addition, an error detection flag (c9) which is a result of error detection for the class 2 voice information bit string which is subjected to error correction decoding and a gain auxiliary information error detection flag (d9) which is a result of error detection for the gain auxiliary information are output. Here, the above-described error correction decoding/error detector 2(320) is configured to have both of the function of the first error correction decoding/error detector and the function of the second error correction decoding/error detector in combination.

In the following, the operation of the bit separator/scalable decoding controller 2(321) will be described by using FIG. 26. In addition, description will be made by also including the LSF decoder 3(322) therein.

In the bit separator/scalable decoding controller 2(321), first, the received voice information bit string (b9) is separated into the respective parameters (step S301). Here, the periodic/aperiodic pitch-voiced/voiceless information code (will be output later as f8), the high range voiced/voiceless flag (will be output later as g8), the LSF parameter index (will be output later as e9), the gain information (will be output later as h9) are separated as the parameters. Next, the scalable decoding mode is determined (step S302) using the error detection flag (c9). Specifically, the frequency that the error detection flag (c9) indicates "Error Present" is observed and the degree of transmission error occurrence is estimated, and thereby the scalable decoding mode is determined on the basis of it as will be described in the following. For example, the error detection flags (c9) for past 10 frames counted from the current voice encoding frame are stored and when the frame number for which the error detection flag (c9) indicates "Error Present" is 0 frame in 10 frames, it is determined as the scalable decoding mode 1, it is determined as the scalable decoding mode 2 when it is 1 to 4 frames and it is determined as the scalable decoding mode 3 when it is at least 5 frames. Owing to scalable decoding, it becomes possible to suppress quality deterioration of the reproduced voice caused by the increase in influence of transmission error which would occur in the bit in the extension layer on which error protection is not performed or the bit in the core layer to which the error correction code which is weak in correction capability is applied. In the scalable decoding processing, the following processes are executed on the basis of the scalable decoding mode determined in step S302 (step S303).

In a case of the scalable decoding mode 1 in which the voice is decoded using the information of all the layers, the following processes are executed.

Step S304: Stage1, Stage2, Stage3 and Stage 4 are output as an LSF parameter index (e9). In addition, a Stage2_3_ON/OFF control signal (f9) is set ON, a Stage3_4_ON/OFF control signal (g9) is set ON and it is informed to the LSF decoder 3 (322), and thereby the LSF coefficient is decoded by using Stage1, Stage2, Stage3 and Stage 4 in the LSF decoder 3 (322). That is, the reproduction vector is generated by using the vector in the codebook 1 which corresponds to Stage1, the vector in the codebook 2 which corresponds to Stage2, the vector in the codebook 3 which corresponds to Stage3 and the vector in the codebook 4 which corresponds to Stage4.

Step S305: Gain information (h9) and a gain 2_ON/OFF control signal (i9) are output on the basis of the gain auxiliary information error detection flag (d9). Specifically, when the gain auxiliary information error detection flag (d9) indicates "Error Absent", the gain information (h9) which includes the gain auxiliary information is output as the gain information (h9) and the gain 2_ON/OFF control signal (i9) is set ON and output, and when the gain auxiliary information error detection flag (d9) indicates "Error Present", the gain information (h9) which does not include the gain auxiliary information is output and the gain 2_ON/OFF control signal (i9) is set OFF and output.

Step S306: The periodic/aperiodic pitch-voiced/voiceless information code (a7) is output in through state.

Step S307: The high range voiced/voiceless flag (b7) is output in through state.

In a case of the scalable decoding mode 2, the following processes are executed in order to make voice decoding which uses the voice information bits in only the core layer 1 and the core layer 2 possible.

Step S308: Stage1, Stage2 are output as the LSF parameter index (e9). In addition, the Stage2_ON/OFF control signal (f9) is set ON, the Stage3_4_ON/OFF control signal (g9) is set OFF and it is informed to the LSF decoder 3 (322), and thereby the LSF coefficient is decoded by using only Stage 1, Stage2 without using Stage3, Stage4 I which belong to the extension layer in the LSF decoder 3 (322). Here, the LSF decoder 3 (322) has a function that it can decode the LSF coefficient without using Stage3, Stage4. That is, it has the function of preparing the reproduction vector by using only the vector in the codebook 1 which corresponds to the aforementioned Stage1 and the vector in the codebook 2 which corresponds to Stage2.

Step S309: bit0 which belongs to the extension layer in the gain information is set to "0" and (h9) is output. In addition, the gain 2_ON/OFF control signal (i9) is set OFF and output.

Step S310: The periodic/aperiodic pitch-voiced/voiceless information code (a7) is output in through state.

Step S311: bit0 of the high range voiced/voiceless flag which belongs to the extension layer is set to "0" and (b7) is output.

In a case of the scalable decoding mode 3, the following processes are executed in order to make voice decoding possible by using the voice information bits in only the core layer 1.

Step S312: Stage1 is output as the LSF parameter index (e9). In addition, the Stage2_ON/OFF control signal (f9) is set OFF, the Stage3_4_ON/OFF control signal (g9) is set OFF and it is informed to the LSF decoder (322), and thereby the LSF coefficient is decoded by using only Stage1 without using Stage2, Stage3, Stage 4 which belong to the core layer 2 and the extension layer in the LSF decoder (322). Here, the LSF decoder (322) has a function that it can decode the LSF coefficient without using Stage2, Stage3, Stage4. That is, it has the function of preparing the reproduction vector by using only the vector in the codebook 1 which corresponds to the aforementioned Stage1.

Step S313: bit2, bit 1 which belong to the core layer 2 are set to 1, to "0" and bit0 which belongs to the extension layer is set to "0" respectively in the gain information and (h9) is output. Avoidance of the reduction in power (the loudness of the sound) of the reproduced voice is the reason why bit2 is set to "1". In addition, the gain 2_ON/OFF control signal (i9) is set OFF and output.

Step S314: bit4 to bit0 which belong to the core layer 2 in the periodic/aperiodic pitch-voiced/voiceless information code are set to "0s" and (f8) is output.

Step S315: bit0 in the high range voiced/voiceless flag which belongs to the extension layer is set to "0" and (g8) is output.

The gain decoder 2(323) inputs the gain information (h9) and the gain 2_ON/OFF control signal (i9) from the bit separator/scalable decoding controller 2(321), and in a case where the gain 2_ON/OFF control signal (i9) indicates ON, performs decoding processing of the gain information and the gain auxiliary information and outputs the decoded gain information (j9) and in a case where the gain 2_ON/OFF control signal (i9) indicates OFF, performs decoding processing on only the gain information and outputs the decoded gain information (j9).

The parameter interpolator 2(324) linearly interpolates respective parameters (c2), (e2), (g2), (j2), (i2) and (j9) respectively in synchronization with the pitch period and outputs (o2), (p2), (r2), (s2), (t2) and (u2). Linear interpolation processing here is performed in accordance with (Formula 6).

$$\text{Parameter after interpolation} = \text{Parameter of current frame} \times \text{int} + \text{Parameter of previous frame } (1.0 - \text{int}) \quad \text{(Formula 6)}$$

Here, the parameter of the current frame corresponds to each of (c2), (e2), (g2), (j2), (i2) and (j9) and the parameter after interpolation corresponds to each of (o2), (p2), (r2), (s2), (t2) and u2). The parameter of the previous frame is given by holding (c2), (e2), (g2), (i2) and (j9) in the previous frame.

int is an interpolation coefficient and is obtained from (Formula 7).

$$\text{int} = \text{to}/320 \quad \text{(Formula 7)}$$

Here, "320" is the number of samples per voice decoding frame length (40 ms), to is a start sample point of 1 pitch period in the decoding frame and is updated by adding the pitch period thereof every time the reproduced voice for 1 pitch period is decoded. When to exceeds "320", it means termination of the decoding processing of that frame and "320" is subtracted from to. The second example of the embodiment 2 is different from the first example of the embodiment 2 in the way of performing gain information interpolation processing in addition to the point that the processing is in the form that the voice decoding frame length is changed to 40 ms as described above. In a case where the gain 2_ON/OFF control signal (i9) indicates OFF, the parameter interpolator 2(324) obtains gain information after interpolation by using the following (Formula 8) similarly to that in the first example of the embodiment 2.

Gain information after interpolation=Gain information of current frame×int+Gain information of previous frame×(1.0−int) (Formula 8)

Here, the gain information of the current frame corresponds to the gain information (j9).

On the other hand, in a case where the gain 2_ON/OFF control signal (i9) indicates ON, the gain information after interpolation is obtained using the following (Formula 9), (Formula 10) by utilizing also the gain auxiliary information included in the gain information (j9).

In a case where to <160:

int2=to/160

Gain information after interpolation=Gain auxiliary information of current frame×int2+Gain information of previous frame×(1.0−int2) (Formula 9)

In a case where to ≤160:

int2=(to −160)/160

Gain information after interpolation=Gain information of current frame×int2+Gain information of previous frame×(1.0−int2) (Formula 10)

int2 is an interpolation coefficient in (Formula 9), (Formula 10).

As shown in (Formula 9), (Formula 10), in a case where the gain 2_ON/OFF control signal (i9) indicates ON, it becomes possible to express a change in power of the voice signal with a higher accuracy by interpolating the first half of the frame by using the gain information of the previous frame and the gain auxiliary information of the current frame and interpolating the second half thereof by using the gain auxiliary information and the gain information of the current frame.

An example of a result of measurement of the voice quality (a result of measurement of sound articulation when there is no transmission error) in each scalable transmission mode in FIG. 24 is shown in FIG. 27. The measurement result in the first example of the embodiment 2 in FIG. 20 (FIG. 17) is also shown in the drawing, 1.6 kbps voice encoding is noted for the first example of the embodiment 2 and 1.175 kbps voice encoding is noted for the second example of the embodiment 2. From FIG. 27, the sound articulation is improved in comparison with that in the first example of the embodiment 2 by adding Stage2 of the LSF coefficient to the core layer 2 in the scalable decoding mode 2. In addition, the sound articulation of at least 90% can be maintained by sending the gain auxiliary information in the scalable decoding mode 1 even when the frame length is doubled to 40 ms. In addition, although no measurement result is shown, in a case where the transmission error is present, since in the second example of the embodiment 2, the encoding rate for error correction for the information in the core layer 1 and the core layer 2 is set small in comparison with that of the first example of the embodiment 2 as described above and more bits are allocated to error correction, it is excellent in transmission error resistance.

In the following, the embodiment 2 will be summarized.

The sound articulation of at least 80% can be maintained by using the 3.2 kbps encoding Codec technology including the prior art error correction in wireless communication, irrespective of occurrence of the transmission error of 7%. However, in a case where the transmission error rate exceeds 7%, the influence of the transmission error which occurs in the bit which belongs to the class on which no error protection is performed or the bit which belongs to the class to which the error correction code which is weak in correction capability is applied is increased and the quality deterioration of the reproduced voice becomes remarkable.

In order to solve this issue, the embodiment 2 proposes a voice communication system having a voice encoding decoder having a scalable structure that voice decoding is possible without using the bit on which no error protection is performed and the bit to which the error correction code which is weak in correction capability is applied in a case where the transmission error rate is high on the reception side.

The voice communication system of the embodiment 2 is equipped with a voice encoder which performs encoding processing on a voice signal per frame which is a predetermined time unit and outputs voice information bits, an error detection/error correction encoder which adds error detection codes to all or some of the voice information bits and sends a bit string that error correction encoding is performed on a string of the bits to which the error detection codes are added, an error correction decoding/error detector which receives the bit string which is subjected to error correction encoding, performs error correction decoding on the received bit string which is subjected to error correction encoding and performs error detection on the voice information bit string after error correction decoding and a voice decoder which reproduces a voice signal from the voice information bit string after error correction decoding and, on that occasion, in a case where an error is detected as a result of error detection by the error correction decoding/error detector, replaces the voice information bit string after error correction with a voice information bit string in a past error-free frame and thereafter reproduces the voice signal, in which the voice encoder performs classification in accordance with a degree of importance which is the magnitude of auditory influence when an error occurs in each bit of the voice information bit string, classifies a group of bits which are high in degree of importance into a core layer and classifies a group of bits which are not high into an extension layer, the error detection/error correction encoder sends the bit string which is subjected to error correction encoding after addition of the error detection codes as for the bits which are classified into the core layer and sends the bit string without performing addition of the error detection codes and error correction encoding as for the bits which are classified into the extension layer, the error correction decoding/error detector receives the bit string sent from the error detection/error correction encoder and performs error correction decoding-error detection processing on the bit string in the core layer, and the voice decoder decodes a voice by using the bit strings in both of the core layer and the extension layer on the basis of frequency that the error is detected by the error detection processing and when the frequency is low and decodes the voice using all bits or only some bets in the core layer when the frequency is high.

In addition, in the voice communication system of the above-described embodiment 2, the error detection/error correction encoder is equipped with a first error detection/error correction encoder and a second error detection/error correction encoder, the voice encoder obtains spectrum envelope information, low frequency band voiced/voiceless discrimination information, high frequency band voiced/voiceless discrimination information, pitch period information and first gain information and outputs a voice information bit string which is a result of encoding of them, the first error detection/error correction encoder adds the error detection codes to all or some of them in the voice information bit string and thereafter outputs the bit string which is subjected to error correction encoding, and the voice encoder obtains second gain information and outputs a second gain information bit string which is a result of encoding thereof, and the second error detection/error correction encoder sends a bit string that error detection/error correction encoding is performed on the second gain information bit string.

In addition, in the voice communication system of the above-described embodiment 2, the error correction decoding/error detector is equipped with a first error correction decoding/error detector and a second error correction decoding/error detector, the first error correction decoding/error detector receives the bit string sent from the error detection/error correction encoder, performs error correction encoding and error detection on a bit which is error-protected by the first error detection/error correction encoder in the received bit string and outputs the voice information bit string after error correction, the voice decoder separates and decodes respective parameters of the spectrum envelope information, the low frequency band voiced/voiceless discrimination information, the high frequency band voiced/voiceless discrimination information, the pitch period information and the first gain information included in the voice information bit string after error correction, the second error correction encoding/error detector receives the bit string that the second information is subjected to error detection/correction encoding and performs correction decoding and error detection thereon and thereafter the voice decoder decodes the second gain information, further the voice decoder in the low frequency band, determines a mixing ratio when mixing a pitch pulse which is generated in a pitch period that the pitch period information indicates with a white noise on the basis of the low frequency band voiced/voiceless discrimination information and prepares a low frequency band mixed signal, and in the high frequency band, obtains a spectrum envelope amplitude from the spectrum envelope information, obtains an average value of the spectrum envelope amplitudes per band which is divided on a frequency axis, determines the mixing ratio when mixing the pitch pulse with the white noise per band on the basis of a result of determination of a band in which the average value of the spectrum envelope amplitudes is maximized and the high frequency band voiced/voiceless discrimination information and generates a mixed signal, and adds together the mixed signals in all bands which are divided in the high frequency band and generates a high frequency band mixed signal, adds together the low frequency band mixed signal and the high frequency band mixed signal and generates a mixed sound source signal, adds the spectrum envelope information to the mixed sound source signal, thereafter in a case where an error is not detected as a result of error detection of the second gain information, adds both of the first gain information and second gain information thereto and generates a reproduced voice, and in a case where the error is detected, adds only the first gain information thereto and generates the reproduced voice.

According to the embodiment 2, when using the voice communication system in an inferior radio wave environment (for example, the environment in which the transmission error rate exceeds 7%), it becomes possible to perform scalable voice decoding without using the bit on which no error protection is performed, or the bit to which the error correction code which is weak in correction capability is applied and it becomes possible to reduce the quality deterioration of the reproduced voice caused by the increase in influence of the transmission error which would occur in these bits.

<Embodiment 3>

Figure 28:
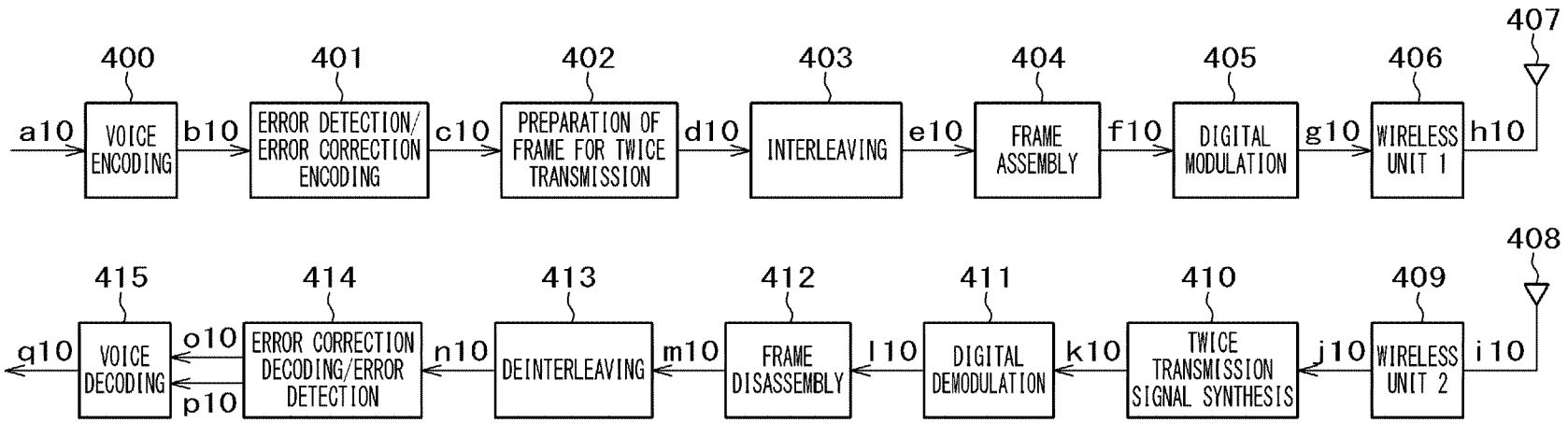
FIG. 28 is a diagram showing one example of a voice communication system according to an embodiment 3 of the present invention.
Figure 30:
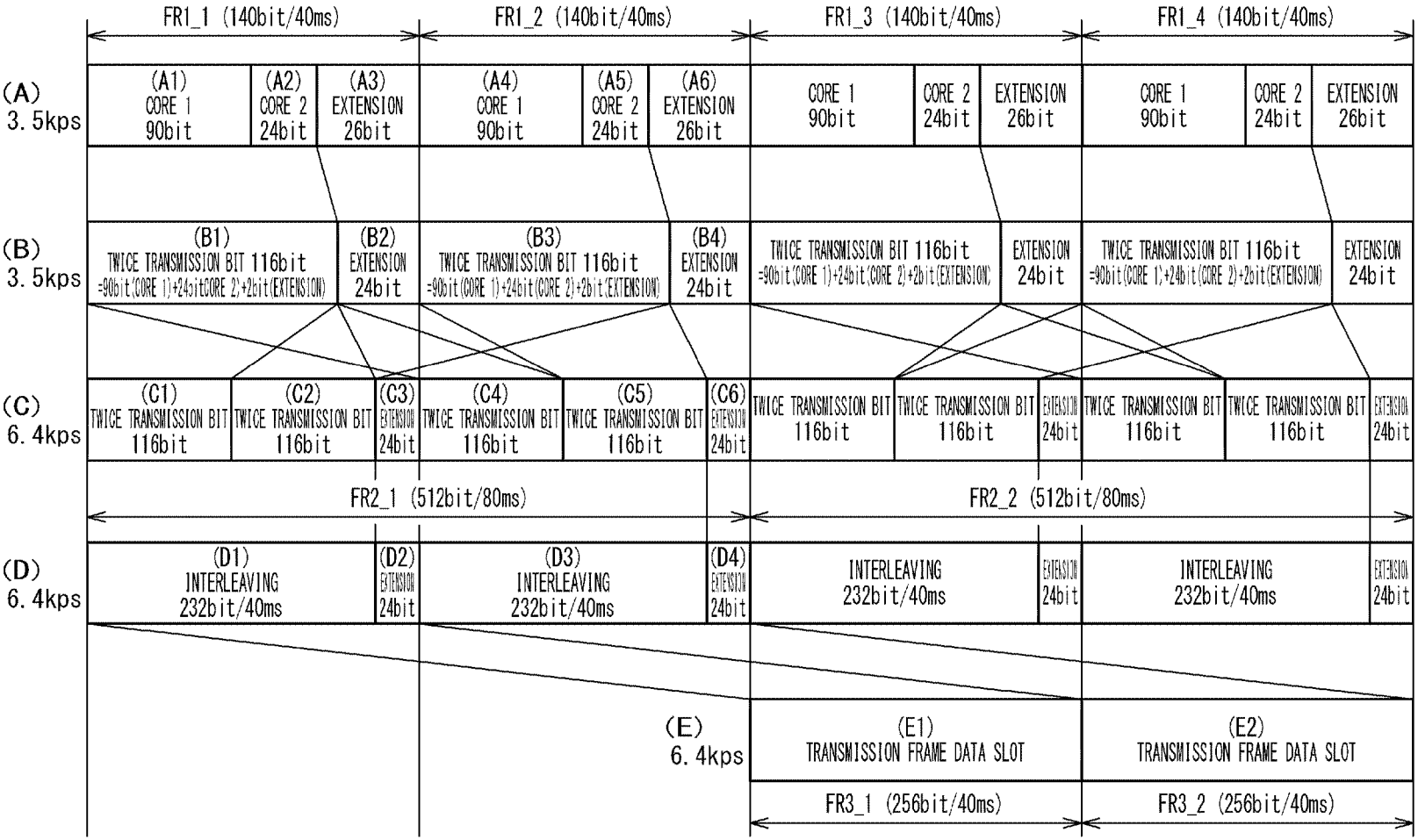
FIG. 30 is an explanatory diagram of an operation of the voice communication system according to the embodiment 3 of the present invention.
Figure 31:
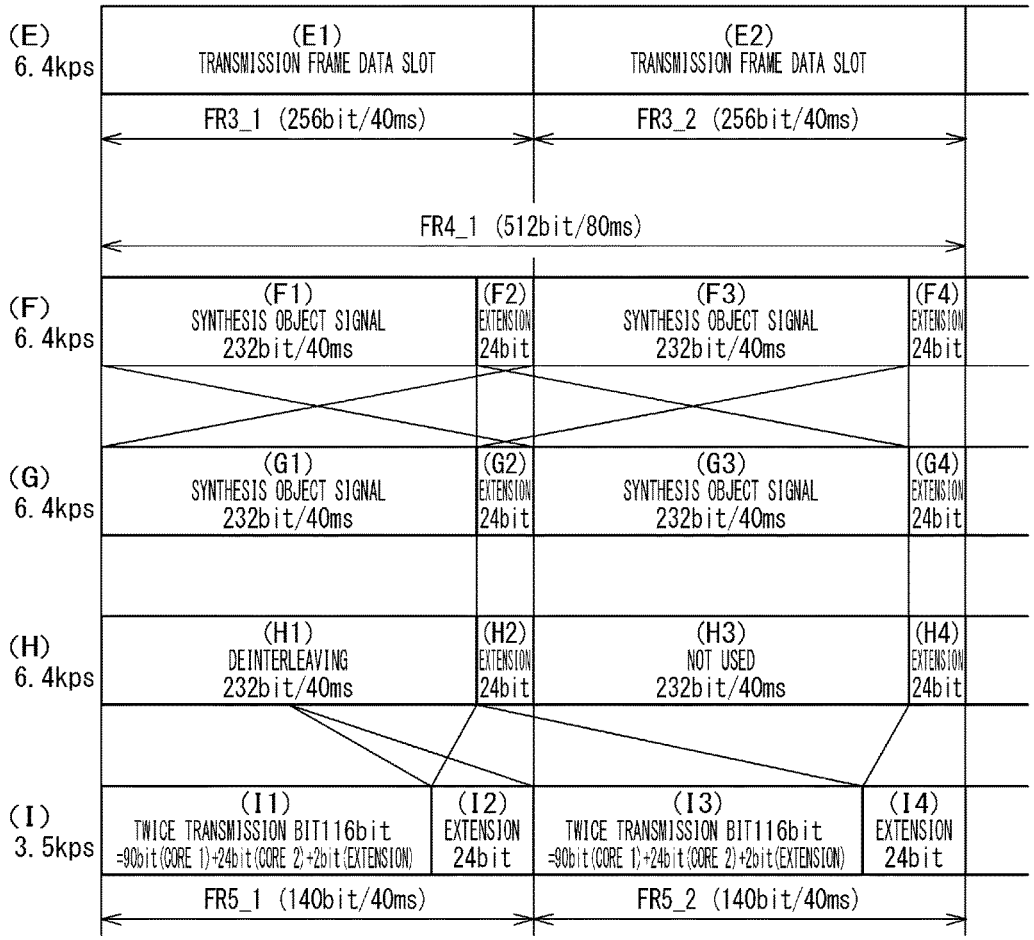
FIG. 31 is an explanatory diagram of the operation of the voice communication system according to the embodiment 3 of the present invention.

The embodiment 3 of the present invention will be described by using FIG. 28 to FIG. 31. FIG. 28 is a diagram showing one example of a voice communication system according to an embodiment 3 of the present invention. FIG. 29 is a diagram showing specifications of error detection/error correction encoding/repetitive transmission. FIG. 30 is an explanatory diagram of an operation of the voice communication system according to the embodiment 3 of the present invention. FIG. 31 is an explanatory diagram of the operation of the voice communication system according to the embodiment 3 of the present invention. (400) to (407) in FIG. 28 show processes on the transmission side and (408) to (415) show processes on the reception side.

A voice encoder (400) performs voice encoding processing on an input voice sample (a10) which is bandlimited at 100 to 3800 Hz, thereafter is sampled at 8 kHz and is quantized with an accuracy of at least 12 bits and outputs a voice information bit string (b10) which is a result thereof. The operation of the voice encoder (400) is the same as that of the voice encoder of the first example of the embodiment 2 shown in FIG. 14. In the embodiment 3, layer allocation which will be described in the following is performed on the voice information bit string (b10). Allocation of the voice information bits to the respective layers is the same as that in FIG. 15. However, the layer allocation is classification for defining the transmission frequency in repetitive transmission which will be described later.

In an error detection/error correction encoder (401), the voice information bit strings (b10) for 2 frames are gathered per 40 ms, addition of the error detection code using the CRC code and error correction encoding using the RCPC code are performed and a bit string (c10) after interpolation which is a result thereof is output similarly to the conventional system. Thereafter, twice-transmission-use frame preparation is executed. The specifications for defining the operations of the error detection/error correction encoder (401) and a twice-transmission-use frame preparation unit (402) are shown in FIG. 29. In the present embodiment, error detection/error correction (RCPC) encoding is executed on the voice information bits in the class 2 (corresponding to the core layer 1) and the class 1 (corresponding to the core layer 2) per 40 ms. The encoding ratio of the 4-bit CRC code to the RCPC code including 8 tail bits for protection of the class 2 is 2/5, the encoding ratio for the class 1 which is moderate in error sensitivity is 7/12 and the number of bits output from the RCPC encoder is 140 bits/40 ms (3.5 kbps in bit rate). Then, the bits which belong to the core layer 1 and the core layer 2 are repetitively transmitted twice as shown in the column "TRANSMISSION FREQUENCY" in the drawing. Accordingly, the number of transmission bits is doubled as shown in the column "NUMBER OF TRANSMISSION BITS". As for the bit which belongs to the extension layer, only the high range voiced/voiceless flag (1 bit/frame) is transmitted twice. Therefore, the number of transmission bits amounts to 28 bits (=26 bits+1 bit×2). Here, 1 bit×2 which is an increment corresponds to the high range voiced/voiceless flags (1 bit/frame) of 2 voice encoding frames. The number of transmission bits in twice transmission amounts to 256 bits/40 ms (6.4 kbps in bit rate).

The bit which is high in degree of importance is transmitted twice as described above and received signals which correspond thereto are subjected to synthesis processing on the reception side as will be described in the following, and thereby a carrier-to-noise ratio (C/N) of a result of demodulation of the bit which is transmitted twice is improved by 3 db in BER (Bit Error Rate) characteristic and therefore robustness to the transmission error can be improved.

In the following, an operation of the voice communication system of the embodiment 3 in FIG. 28 will be described using FIGS. 30, 31.

A bit string (c7) after error-correction which is an output from the error detection/error correction encoder (401) in FIG. 28 is shown in FIG. 30(A). An error correction frame (FR1_1) is an output (140 bits/40 ms, 3.5 kbps in bit rate) from the RCPC encoder, and bits (A1) in the core layer 1 are configured by 90 bits, bits (A2) in the core layer 2 are configured by 24 bits, bits (A3) in the extension layer are configured by 26 bits. The same is true of succeeding error correction frames (FR1_2, FR1_3, . . . ).

FIGS. 30(B) and 30(C) show operations of the twice-transmission-use frame preparation unit (402). In FIG. 30(B), a bit which is transmitted twice and a bit which is transmitted only once per error correction frame are classified. In the error correction frame (FR1_1), 90 bits of the bits (A1) in the core layer, 24 bits of the bits (A2) in the core layer 2 and the 2 voice encoding frame high range voiced/voiceless flags (1 bit×2) in 26 bits of the bits (3) in the extension layer are classified as twice transmission bits (B1) and the remaining 24 bits of the bits (A3) in the extension layer are classified as bits (B2) which are not repetitively transmitted (transmitted once). Likewise, also in the error correction frame (FR1_2), bits (A4) in the core layer 1, bits (A5) in the core layer 2 and bits (A6) in the extension layer are classified into twice transmission bits (B3) and once transmission bits (B4).

FIG. 30(C) shows a configuration of a frame which is prepared by the twice-transmission-use frame preparation unit (402). A twice-transmission-use frame (R2_1) ((d7) in FIG. 28) is configured by bits of the 2 error correction frames (FR1_1, FR1_2) and becomes 512 bits/80 ms (6.4 kbps in bit rate). Here, the twice transmission bit (B1) is copied to a bit (C1) and a bit (C4), the twice transmission bit (B3) is copied to a bit (C2) and a bit (C5), the once transmission bit (B2) is copied to a bit (C3) and the once transmission bit (B4) is copied to a bit (C6). Also, a subsequent twice-transmission-use frame (FR2_2) is configured by bits of 2 error correction frames (FR1_3, FR1_4) similarly.

Next, an interleaving unit (403) in FIG. 28 performs interleaving on a twice-transmission-use frame (d10) and outputs (e10). In interleaving, the same processing is respectively executed on bit strings (D1) and (D2) to be transmitted twice as shown in FIG. 30(D). Therefore, the twice transmission bit strings (D1) and (D3) are the bit strings which are exactly the same as each other also after interleaved. Here, the twice transmission bit string (D1) corresponds to the bits (C1) and C2), the twice transmission bit string (D3) corresponds to the bits (C4) and (C5) and they are 232 bits/40 ms. In addition, a once transmission bit string (D2) (corresponding to the bit (C3)) and a once transmission bit string (D4) (corresponding to the bit (C6)) are output without being interleaved. The subsequent twice-transmission-use frame (FR2_2) is also processed similarly.

A frame assembly unit (404) in FIG. 28 inserts an output (e10) from the interleaving unit (403) into a data slot in a transmission frame and outputs (f10). The transmission frame is configured by synchronization bits, control bits and the data slot into which data is inserted to be transmitted. The data transmission capacity in the data slot is 256 bits/40 ms. Here, the numbers of the synchronization bits and the control bits and details thereof are not defined and made optional. As shown in FIG. 30 (E), the twice transmission bit string (D1) and the once transmission bit string (D2) are inserted into a data slot (E1) in a transmission frame (FR3_1) and the twice transmission bit string (D3) and the once transmission bit string (D4) are inserted into a data slot (E2) in a transmission frame (FR3_2).

A digital modulation unit (405) digitally modulates the output data (f10) from the frame assembly unit (404) by using, for example, a differential encoding n/4-QPSK synchronous detection system and an output (g10) therefrom is input into a wireless unit 1(406). Although illustration of an internal configuration thereof is omitted, the wireless unit 1(406) performs transmission filtering processing, quadrature modulation processing for up-converting to a carrier frequency on the modulated signal (g10) and outputs a signal (h10) which is amplified by a power amplifier. The signal (h10) is sent to the reception side through a transmission antenna (407).

The reception side receives the radio wave sent from the transmission side by a reception antenna (408), processes it by a wireless unit 2(409) and outputs a received transmission frame (j10). Although illustration of an internal configuration thereof is omitted, the wireless unit 2(409) includes functions of an LNA, quadrature demodulation processing for down-converting to a base band frequency, receive filter processing, synchronization processing and carrier reproduction processing.

Next, received signals which correspond to the bit which is repetitively transmitted twice are synthesized by a twice transmission synthesis processing unit (410) and a signal (k10) which is a result thereof is output. As shown in FIG. 31(F), the twice transmission synthesis processing is executed for every 2 transmission frames. In FIG. 31(F), the twice transmission bit string (D1) inserted and transmitted in the data slot (E1) of the transmission frame (FR3_1) and the twice transmission bit string (D3) in the data slot (E2) which is transmitted in the transmission frame (FR3_2) which are shown in FIGS. 31 (E),(D) are respectively inserted into a frame (FR4_1) for twice transmission synthesis processing as synthesis object signals (F1) and (F3). Here, the synthesis object signals (F1) and (F3) are signal strings which correspond to bit strings which are exactly the same as each other. In addition, signals corresponding to the once transmission bit string (D2) in the data slot (E1) and the once transmission bit string (D4) in the data slot (E2) which are transmitted only once are inserted into extension signals (F2), (F4) respectively. (F1) and (F3 ) which are the synthesis object signals are added together and a result thereof is inserted into signals after synthesis (G1) and (G3) in a frame for signals after synthesis (corresponding to (k10) in FIG. 28) in FIG. 31(G). The signals after synthesis (G1) and (G3) are signal strings which are exactly the same as each other. In addition, the extension signals (F2) and (F4) are respectively inserted into extension signals (G2) and (G4). Here, frames shown in FIG. 31 (F), (G) only show data slots in the transmission frames and illustration of other synchronization bits and control bits is omitted.

The bit which is transmitted twice is improved in carrier-to-noise ratio (C/N) by 3 dB in the BER (Bit Error Rate) characteristic and is improved in robustness to the transmission error owing to the above-described twice transmission synthesis processing.

(k10) in FIG. 28 which is a result of the twice transmission synthesis processing is subjected to demodulation processing by a digital demodulation unit (411). The bit string (110) which has been subjected to demodulation processing is output as a bit string (m10) that only the data slot part is extracted from the transmission frame by a frame disassembly unit (412).

Deinterleave processing is performed on the bit string (m10) as shown in FIG. 31(H). Here, bit strings (H1), (H2), (H3), (H4) in the drawing are bit strings which correspond to the bit strings (G1), (G2), (G3), (G4) and are subjected to demodulation processing in the drawing. The bit strings (H1) and (H3) which are bits to be deinterleaved are the bit strings which are exactly the same as each other and therefore deinterleave processing is executed only on the bit string (H1) (the bit string (H3) is not used). The first half of the bit string after interleave (H1) in FIG. 31 corresponds to the bit string (C1) in FIG. 30 (C) and the second half of the bit string (H1) corresponds to the bit string (C2), the bit string (H2) corresponds to the bit string (C3), the bit string (H4) corresponds to the bit string (C6) and therefore the one in FIG. 31 (I) which has the same structure as the one in FIG. 30 (B) is reproduced. Here, twice transmission bits (I1), (I2), (I3), (I4) in FIG. 31 (I) correspond to twice transmission bits (B1), (B2), (B3), (B4) in FIG. 30(B). Frames (FR5_1, FR5_2) in FIG. 31(I) are 140 bits/40 ms and the bit rate thereof is 3.5 kbps. Further, a bit string ((n10) in FIG. 28) which has the same structure as the one in FIG. 30 (A) is reproduced from the one in FIG. 31(I) and is output.

Error correction decoding, error detection is performed on the bit string (n10) by an error correction decoding/error detector (414). Here, the soft decision Viterbi decoding is executed per error correction encoding frame 40 [ms] and a voice information bit string (o10) for two voice encoding frames (20 [ms]) (32 bits×2) is output. In addition, error detection is performed on a voice information bit string in the class 2 which has been subjected to error correction decoding and an error detection flag (p10) which is a result thereof is output.

The voice information bit string (o10) and the error detection flag (p10) are input into a voice decoder (415) and are decoded and reproduced by processing which is the same as that of the prior art voice decoder in FIG. 5, and are output as a reproduced voice (q10).

In the following, the embodiment 3 will be summarized.

The sound articulation of at least 80% can be maintained by using the 3.2 kbps voice encoding Codec technology including the prior art error correction in the wireless communication, irrespective of occurrence of the transmission error of 7%. However, in a case where the transmission error rate exceeds 7%, the error correction does not effectively function and the quality deterioration of the reproduced voice becomes remarkable, when the transmission error rate is further heightened, the erroneous correction (error worsening due to not effective functioning of the error correction) frequently occurs and voice decoding becomes difficult. In order to solve this issue, the embodiment 3 of the present invention proposes a robust transmission method for a voice signal which can also cope with the inferior propagation environment in which high transmission error occurs.

The voice communication system of the embodiment 3 is equipped with a voice encoder which performs encoding processing on a voice signal per frame which is a predetermined time unit and outputs voice information bits, an error detection/error correction encoder which adds error detection codes to all or some of the voice information bits and sends a bit string that error correction encoding is performed on a string of the bits to which the error detection codes are added, an error correction decoding/error detector which receives the bit string which is subjected to error correction encoding, performs error correction decoding on the received bit string which is subjected to error correction encoding and performs error detection on the voice information bit string after error correction and a voice decoder which reproduces a voice signal from the voice information bit string after error correction decoding and, on that occasion, in a case where an error is detected as a result of error detection by the error correction decoding/error detector, replaces the voice information bit string after error correction decoding with a voice information bit string in a past error-free frame and thereafter reproduces the voice signal, in which the voice encoder performs classification in accordance with the degree of importance which is the magnitude of auditory influence when an error occurs in each bit of the voice information bit string, classifies a group of bits which are high in degree of importance into a core layer and classifies a group of bits which are not high into an extension layer, the error detection/error correction encoder sends the bit string on which error correction encoding is performed a plurality of times repetitively after addition of the error detection codes as for the bits which are classified into the core layer and sends it one time or the plurality of times repetitively without performing addition of the error detection codes and error correction encoding as for the bits which are classified into the extension layer, and the error correction decoding/error detector receives the bit string sent from the error detection/error correction encoder and, as for the bit string in the core layer, synthesizes a received signal which corresponds to the bit which is transmitted the plurality of times repetitively and thereafter performs error correction decoding-error detection processing thereon and, as for the bit in the extension layer, in a case where it is transmitted the plurality of times repetitively, synthesizes a received signal which corresponds the bit which is transmitted the plurality of times repetitively and thereafter uses it for voice decoding together with the core-layer bit string which is subjected to error correction decoding, error detection processing.

According to the embodiment 3, when using the voice communication wireless system in the inferior radio wave environment (for example, the environment in which the transmission error rate exceeds 7%), it becomes possible to realize robust voice communication by repetitively transmitting the bit which is high in transmission error sensitivity (the degree of importance).

<Embodiment 4>

Figure 32:
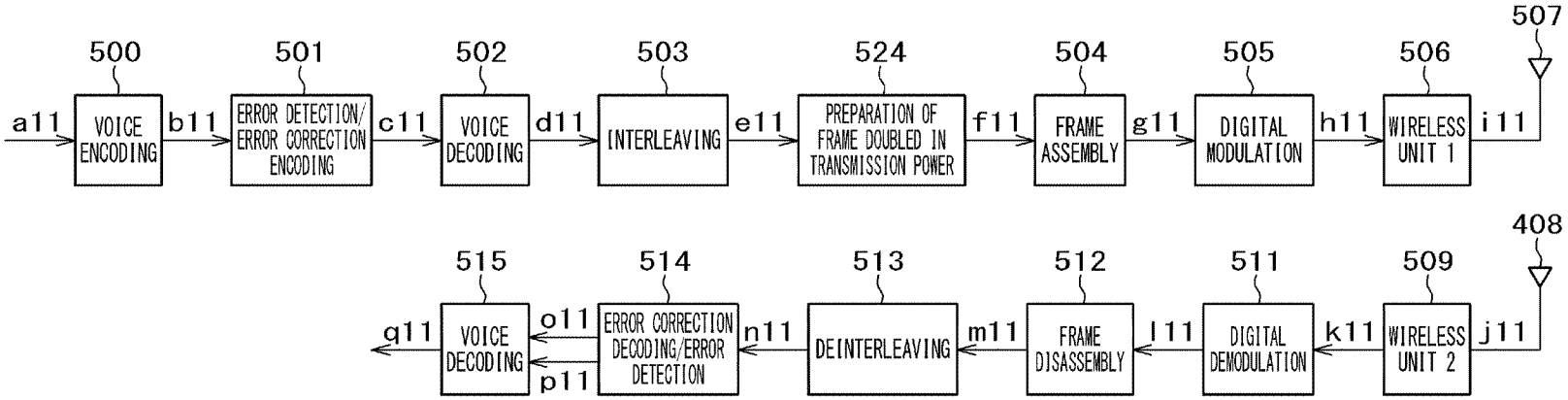
FIG. 32 is a diagram showing one example of a voice communication system according to an embodiment 4 of the present invention.
Figure 34:
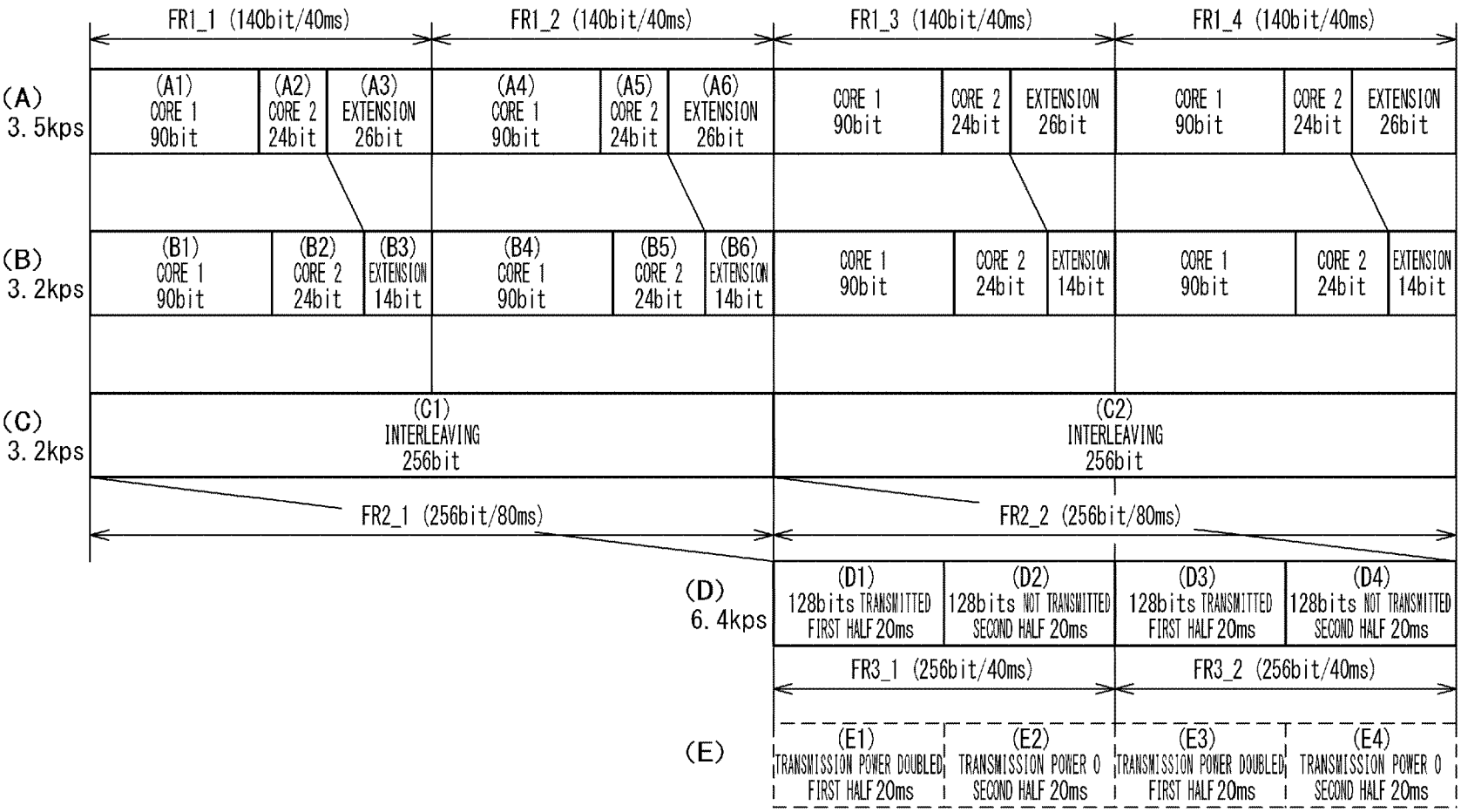
FIG. 34 is an explanatory diagram of an operation of the voice communication system according to the embodiment 4 of the present invention.
Figure 35:
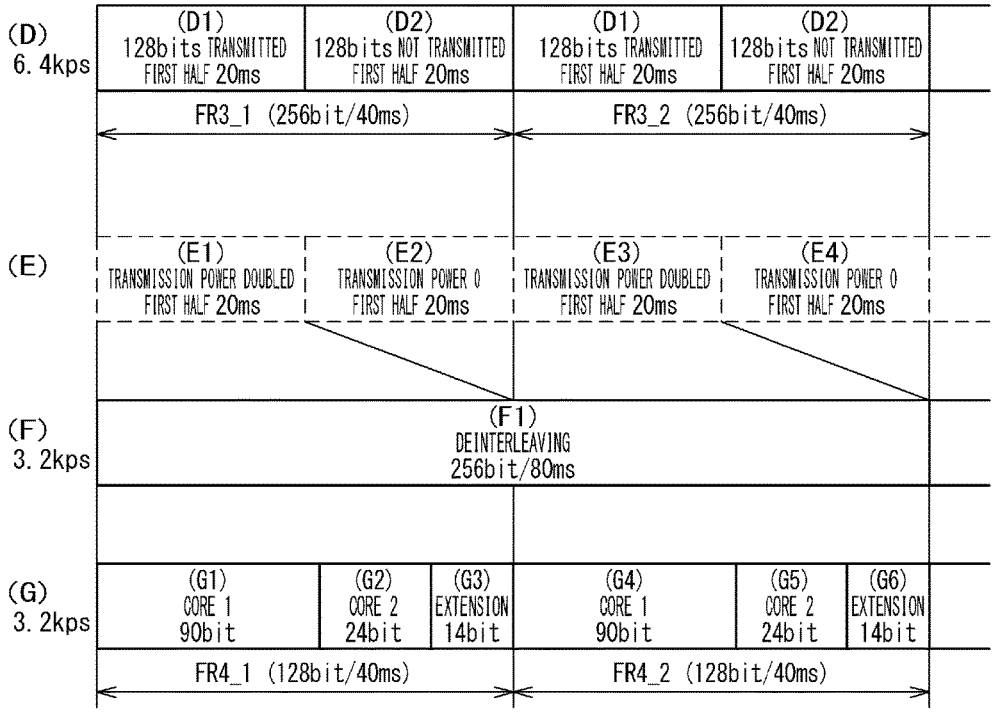
FIG. 35 is an explanatory diagram of the operation of the voice communication system according to the embodiment 4 of the present invention.

The embodiment 4 of the present invention will be described by using FIG. 32 to FIG. 35. FIG. 32 is a diagram showing one example of a voice communication system according to the embodiment 4 of the present invention. FIG. 33 is a diagram showing specifications of error detection/error correction encoding/transmit power. FIG. 34 is an explanatory diagram of an operation of the voice communication system according to the embodiment 4 of the present invention. FIG. 35 is an explanatory diagram of an operation of the voice communication system according to the embodiment 4 of the present invention. (500) to (508) in FIG. 32 show processes on the transmission side and (509) to (515) therein show processes on the reception side.

In a voice encoder (500), voice encoding processing is performed on an input voice sample which is bandlimited at 100 to 3800 Hz, then is sampled at 8 kHz and is quantized with an accuracy of at least 12 bits and a voice information bit string (b11) which is a result thereof is output. The operation of the voice encoder (500) is the same as that of the voice encoder of the conventional system shown in FIG. 1. In the embodiment 4, layer allocation which will be described in the following is performed on the voice information bit string (b11). Allocation of the voice information bits to the respective layers is the same as that in FIG. 15. However, the layer allocation is classification for defining a transmission power multiple which will be described later.

In an error detection/error correction encoder (501), the voice information bit strings (b11) for 2 frames are gathered per 40 ms, addition of the error detection code using the CRC code and error correction encoding using the RCPC code are performed and a bit string after error correction (c11) which is a result thereof is output similarly to the conventional system. Thereafter, a bit reduction processing, an interleaving processing and a transmission-power-doubled frame preparation are executed by a bit reduction processing unit (502), an interleaving unit (503), a transmission-power-doubled frame preparation unit (524). Specifications for defining the operations of the error detection/error correction encoder (501), the bit reduction processing unit (502) and the transmission-power-doubled frame preparation unit (504) are shown in FIG. 33 (FIG. 17). In the embodiment 4, error detection/error correction (RCPC) encoding is executed on the voice information bits in the class 2 (corresponding to the core layer 1) and the class 1 (corresponding to the core layer 2) per 40 ms. The encoding ratio of the 4-bit CRC code to the RCPC code including 8 tail bits for protection of the class 2 is 2/5, the encoding ratio for the class 1 which is moderate in error sensitivity is 7/12 and the number of bits output from the RCPC encoder is 140 bits/40 ms (3.5 kbps in bit rate). Then, as for the bits which belong to the core layer 1 and the core layer 2, they are transmitted by setting the transmission power to 2 times the transmission power in the prior art as shown in the column "MULTIPLE OF TRANSMISSION POWER" in the drawing (Table). As for the bits which belong to the extension layer, bit reduction processing is performed thereon and thereafter they are transmitted by setting it to 2 times the transmission power. As the bit reduction processing, only 14 bits (LSP Stage2 (12 bits=6 bits×2) in the extension layer (26 bits=13 bits×2) and the high range voiced/voiceless flag (2 bits=1 bit×2) are transmitted. Here, "×2" indicates that the voice information bit strings for 2 voice encoding frames are gathered and the error detection/error correction processing is performed per 40 ms as described above. As a result of the bit reduction processing, the number of transmission bits becomes 128 bits/40 ms (3.2 kbps in bit rate) as shown in the column "NUMBER OF TRANSMISSION BITS" in the drawing.

Since the carrier-to-noise ratio (C/N) is improved by 3 dB in the BER (Bit Error Rate) characteristic which is the result of demodulation by transmitting the bit which is high in degree of importance with the doubled transmission power as described above, the robustness to the transmission error can be improved. As for the bits which are classified into the extension layer, although some are transmitted with the doubled transmission power, reducing bits by the bit reduction processing is equivalent to setting the transmission power to 0 and therefore it is transmitted using low transmission power for the extension layer. Although the number of the bits in the extension layer is reduced by bit reduction processing, the degree of importance of these bits is low and therefore the quality deterioration of the reproduced voice caused by bit reduction is suppressed within an allowable range.

In the following, an operation of the voice communication system of the embodiment 4 in FIG. 32 will be described using FIGS. 34, 35.

A bit string after error correction (c11) which is an output from the error detection/error correction encoder (501) in FIG. 32 is shown in FIG. 34(A). The error correction frame (FR1_1) is an output (140 bits/40 ms, 3.6 kbps in bit rate) from the RCPC encoder and the bits (A1) in the core layer 1 are configured by 90 bits, the bits (A2) in the core layer 2 are configured by 24 bits, the bits (A3) in the extension layer are configured by 26 bits. The same is true of the succeeding error correction frames (FR1_2, FR1_3, . . . ).

FIG. 34(B) shows an operation of the bit reduction processing unit (502). In the frame (R1_1), 26 bits of the bits (A3) in the extension layer are reduced to 14 bits of the bits (B3) as described above. Since the bits (B1) in the core layer 1 and the bits (B2) in the core layer 2 are not reduced, the number of bits is not changed. The same processing is performed also in the succeeding frames (FR1_2, FR1_3, . . . ). The output (d7) from the bit reduction processing unit (502) becomes 128 bits/40 ms and the bit rate becomes 3.2 kbps.

The interleaving unit (503) performs interleave processing on the output (d11) from the bit reduction processing unit (502) and outputs (e11) which is a result thereof. As shown in FIG. 34(C), the interleave processing is executed for every 2 error correction frames. The interleave processing in the interleave-use frame (FR2_1) is executed in units of the bit strings (B1) to (B6) in the frames (FR1_1) and (FR1_2).

Next, the transmission-power-doubled frame preparation unit (524) creates a transmission-power-doubled frame with respect to an output (e11) from the interleaving unit (503) and (f11) which is a result thereof is output. A frame configuration thereof is shown in FIG. 34(D). The bit string after interleave (C1) is divided into 128 bits for the first half and the second half and they are inserted into intervals (D1) and (D2) respectively. Data to be transmitted with the doubled power is arranged on the first halves of the frames (FR3_1) and (FR3_2) and the second halves are formed as the intervals (D2)(D4) with the transmission power 0 and no data is inserted into them in this way. 256 bits/40 ms becomes necessary as the transmission rate in FIG. 34(D) and the bit rate thereof becomes 6.4 kbps. As shown in the intervals (E1) to (E4) in FIG. 34(E), the first half intervals (D1), (D3) of the frames (FR3_1) and (FR3_2) are transmitted with the doubled transmission power and the second half intervals (D2), (D4) are transmitted with the transmission power 0. Thereby, when averaging power for the intervals (E1) to (E4), the transmission power becomes 1 time (the same as that in the prior art).

Since the carrier-to-noise ratio (C/N) is improved by 3 dB in the BER (Bit Error Rate) characteristic by transmitting the bit which is high in degree of importance with the doubled transmission power as described above, the robustness to the transmission error can be improved. As for the bits which are classified into the extension layer, although only some (LSP Stage2 (12 bits=6 bits×2) and the high range voiced/voiceless flag (2 bits=1 bit×2)) are transmitted with the doubled transmission power, the bit which has been reduced by the bit reduction processing is equivalent to setting the transmission power to 0 and therefore it is transmitted using the low transmission power for the extension layer. Although the bits in the extension layer are reduced by bit reduction processing, the degree of importance of these bits is low and therefore the quality deterioration of the reproduced voice caused by bit reduction is suppressed within the allowable range.

The frame assembly unit (504) in FIG. 32 inserts an output (f11) from the transmission-power-doubled frame preparation unit (524) into the data slot in the transmission frame and outputs a transmission frame (g11). Although illustration thereof is omitted, the transmission frame is configured by the synchronization bits, the control bits and the data slot into which data is inserted to be transmitted. The data transmission capacity in the data slot is 256 bits/40 ms. Pieces of data in (FR3_1) and then (FR3_2) in FIG. 36 (D) are inserted thereinto per 40 ms. Here, the numbers of bits and details of the synchronization bits, the control bits are not defined and are made optional.

Output data (g11) from the flame assembly unit (504) is subjected to digital modulation unit (505) by using, for example, the differential encoding n/4-QPSK synchronous detection system and an output (h11) therefrom is input into a wireless unit 1(506). Although illustration of an internal configuration thereof is omitted, the wireless unit 1(506) performs transmission filtering processing, quadrature modulation processing for up-converting to the carrier frequency on the modulated signal (h11) and outputs a signal (i11) which is amplified by a power amplifier. (i11) is sent to the reception side through a transmission antenna (507).

The reception side receives the radio wave sent from the transmission side by a reception antenna (508), processes it by a wireless unit 2(509) and outputs a received transmission frame (k11). Although illustration of an internal configuration thereof is omitted, the wireless unit 2(509) includes the functions of the LNA, the quadrature demodulation processing for down-converting to the base band frequency, the receive filter processing, the synchronization processing and the carrier reproduction processing.

The output (k11) from the wireless unit 2(509) is subjected to demodulation processing by a digital demodulation unit (510). A bit string (111) which has been subjected to the demodulation processing is output as a bit string (m1) that only the data slot part is extracted from the transmission frame by a frame disassembly unit (511).

Deinterleaving processing is performed on the bit string (m11) as shown in FIG. 35(F). Here, data corresponding to the transmitted (D1) is inserted into the first half of (F1) of a deinterleaving frame and data corresponding to (D3) is inserted into the second half thereof and the deinterleaving processing is executed. The bit rate in FIG. 35(F) becomes 3.2 kbps.

Details of FIG. 35(F) after deinterleaving are shown in FIG. 35(G). The bit strings (G1) to (G6) have the same details as (B1) to (B6) in FIG. 34(B) and the transmission bit string is reproduced. The frames (FR4_1, FR4_2) in FIG. 35(F) are 128 bits/40 ms and the bit rate thereof is 3.2 kbps.

Error correction decoding, error detection is performed on the bit string after interleaving (n11) by an error correction decoding/error detector (513). Here, the soft decision Viterbi decoding is executed per error correction encoding frame 40 [ms] and a voice information bit string (o11) for two voice encoding frames (20 [ms]) (32 bits×2) is output. In addition, error detection is performed on the class-2 voice information bit string which has been subjected to error correction decoding and an error detection flag (p11) which is a result thereof is output.

The voice information bit string (o11) and the error detection flag (p11) are input into a voice decoding processor (514) and are decoded and reproduced by the processing which is the same as that by the prior art voice decoder in FIG. 5, and are output as a reproduced voice (q11).

In the following, the embodiment 4 will be summarized.

The sound articulation of at least 80% can be maintained by using the 3.2 kbps voice encoding Codec technology including the prior art error correction in the wireless communication, irrespective of occurrence of the transmission error of 7%. However, in a case where the transmission error rate exceeds 7%, the error correction does not effectively function and the quality deterioration of the reproduced voice becomes remarkable, when the transmission error rate is further heightened, erroneous correction (error worsening due to not effective functioning of the error correction) frequently occurs and voice decoding becomes difficult. In order to solve this issue, the present invention proposes a robust transmission method for a voice signal which can also cope with the inferior propagation environment in which high transmission error occurs.

The voice communication system of the embodiment 4 is equipped with a voice encoder which performs encoding processing on a voice signal per frame which is a predetermined time unit and outputs voice information bits, an error detection/error correction encoder which adds error detection codes to all or some of the voice information bits and sends a bit string that error correction encoding is performed on a string of the bits to which the error detection codes are added, an error correction decoding/error detector which receives the bit string which is subjected to error correction encoding, performs error correction decoding on the received bit string which is subjected to error correction encoding and performs error detection on the voice information bit string after error correction and a voice decoder which reproduces a voice signal from the voice information bit string after error correction and, on that occasion, in a case where an error is detected as a result of error detection by the error correction decoding/error detector, replaces the voice information bit string after error correction with a voice information bit string in a past error-free frame and thereafter reproduces the voice signal, in which the voice encoder performs classification in accordance with a degree of importance which is the magnitude of auditory influence when an error occurs in each bit of the voice information bit string, classifies a group of bits which are high in degree of importance into a core layer and classifies a group of bits which are not high into an extension layer, and the error detection/error correction encoder, as for the bits classified into the core layer, adds error detection codes thereto and thereafter transmits the bit string which is subjected to error correction encoding using high transmission power, and as for the bits classified into the extension layer, transmits them using low transmission power without performing addition of the error detection codes and error correction encoding thereon.

According to the embodiment 4, when using the voice communication wireless system in the inferior radio wave environment (for example, the environment in which the transmission error rate exceeds 7%), the robust voice communication can be realized by setting the transmission power of the bit which is high in transmission error sensitivity (the degree of importance) high.

The embodiments 1 to 4 of the present invention can be realized with ease by a DSP (Digital Signal Processor).

Although the embodiments of the present invention have been described in detail as above, the present invention is not limited to the above-described embodiments and can be performed by modifying in a variety of ways within a range not deviating from the gist of the present invention.

INDUSTRIAL APPLICABILITY

The present invention can be utilized in the voice encoding decoding device, the voice communication system.

REFERENCE SIGNS LIST

111: framer, 112: gain calculator, 113: quantizer, 114: linear prediction analyzer, 115: LSF coefficient calculator, 116: quantizer, 117: LPC analysis filter, 118: peakiness calculator, 119: correlation function corrector, 120: low-pass filter, 121: pitch detector, 122: aperiodic flag generator, 123: quantizer, 124: aperiodic pitch index generator, 125: bit packing device, 126: voiced/voiceless decider 1, 127: periodic/aperiodic pitch and voiced/voiceless information code generator, 128: HPF, 129: correlation function calculator, 130: voiced/voiceless decider, 131: bit separator, 132: voiced/voiceless information-pitch period decoder, 133: jitter setter, 134: pulse sound source/noise sound source mixing ratio calculator, 135: spectrum envelope amplitude calculator, 136: linear prediction coefficient calculator 1, 137: inclination correction coefficient calculator, 138: LSF decoder, 139: gain decoder, 140: parameter interpolator, 141: pitch period calculator, 142: pulse sound source generator, 143: noise generator, 144: mixed sound source generator, 145: adaptive spectrum enhancement filter, 146: LPC synthesis filter, 147: linear prediction coefficient calculator 2, 148: gain adjustor, 149: pulse diffusion filter, 150: 1 pitch waveform decoder, 161: sub-bands 2, 3, 4 average amplitude calculator, 162: sub-band selector, 163: sub-bands 2, 3, 4 voiced strength table (for voiced one), 164: sub-bands 2, 3, 4 voiced strength table (for voiceless one), 165: switch 1, 166: switch 2, 167: switch 3, 168: mixing ratio calculator, 170: LPF 1, 171: LPF 2, 172: BPF 1, 173: BPF 2, 174: BPF 3, 175: BPF 4, 176: HPF 1, 177: HPF 2, 178: multiplier 1, 178: multiplier 1, 179: multiplier 2, 180: multiplier 3, 181: multiplier 4, 182: multiplier 5, 183: multiplier 6, 184: multiplier 7, 185: multiplier 8, 186: adder 1, 189: adder 2, 190: adder 3, 191: adder 4, 192: adder 5, 200: scalable bit packing device, 201: error detection/error correction encoder, 202: error correction decoding/error detector, 210: bit separation/scalable controller, 211: LSF decoder, 300: bit separator/scalable decoding controller, 310: gain calculator, 311: quantizer 4, 312: quantizer 5, 313: bit packing device, 320: error correction decoding/error detector 2, 321: bit separator/scalable decoding controller 2, 322: LSF decoder 3, 323: gain decoder 2, 324: parameter interpolator 2.

The invention claimed is:

1. A voice communication system comprising:

a voice encoder which performs encoding processing on a voice signal per frame which is a predetermined time unit and outputs voice information bits;

an error detection/error correction encoder which adds error detection codes to all or some of the voice information bits and sends a bit string that error correction encoding is performed on a string of the bits to which the error detection codes are added;

an error correction decoding/error detector which receives the bit string which is subjected to error correction encoding, performs error correction decoding on the received bit string which is subjected to error correction encoding and performs error detection on the voice information bit string after error correction decoding; and a voice decoder which reproduces a voice signal from the voice information bit string after error correction decoding and, on that occasion, in a case where an error is detected as a result of error detection by the error correction decoding/error detector, replaces the voice information bit string after error correction with a voice information bit string in a past error-free frame and thereafter reproduces the voice signal, wherein the voice encoder performs classification in accordance with a degree of importance which is the magnitude of auditory influence when an error occurs in each bit of the voice information bit string, classifies a group of bits which are high in degree of importance into a core layer and classifies a group of bits which are not high into an extension layer, wherein the error detection/error correction encoder sends the bit string which is subjected to error correction encoding after addition of the error detection codes as for the bits which are classified into the core layer and sends the bit string without performing addition of the error detection codes and error correction encoding as for the bits which are classified into the extension layer, wherein the error correction decoding/error detector receives the bit string sent from the error detection/error correction encoder and performs error correction decoding-error detection processing on the bit string in the core layer, wherein the voice decoder decodes a voice by using the bit strings in both of the core layer and the extension layer on the basis of frequency that the error is detected by the error detection processing and when the frequency is low and decodes the voice using all bits or only some bits in the core layer when the frequency is high, wherein the error detection/error correction encoder is equipped with a first error detection/error correction encoder and a second error detection/error correction encoder, wherein the voice encoder obtains spectrum envelope information, low frequency band voiced/voiceless discrimination information, high frequency band voiced/voiceless discrimination information, pitch period information and first gain information and outputs a voice information bit string which is a result of encoding of them, wherein the first error detection/error correction encoder adds the error detection codes to all or some of them in the voice information bit string and thereafter outputs the bit string which is subjected to error correction encoding, wherein the voice encoder obtains second gain information and outputs a second gain information bit string which is a result of encoding thereof, and wherein the second error detection/error correction encoder sends a bit string that error detection/error correction encoding is performed on the second gain information bit string.

2. The voice communication system according to claim 1, wherein the error correction decoding/error detector is equipped with a first error correction decoding/error detector and a second error correction decoding/error detector, the first error correction decoding/error detector receives the bit string sent from the error detection/error correction encoder, performs error correction encoding and error detection on a bit which is error-protected by the first error detection/error correction encoder in the received bit string and outputs the voice information bit string after error correction, the voice decoder separates and decodes respective parameters of the spectrum envelope information, the low frequency band voiced/voiceless discrimination information, the high frequency band voiced/voiceless discrimination information, the pitch period information and the first gain information included in the voice information bit string after error correction, the second error correction encoding/error detector receives the bit string that the second information is subjected to error detection/correction encoding and performs correction decoding and error detection thereon and thereafter the voice decoder decodes the second gain information, and further the voice decoder in the low frequency band, determines a mixing ratio when mixing a pitch pulse which is generated in a pitch period that the pitch period information indicates with a white noise on the basis of the low frequency band voiced/voiceless discrimination information and prepares a low frequency band mixed signal, in the high frequency band, obtains a spectrum envelope amplitude from the spectrum envelope information, obtains an average value of the spectrum envelope amplitudes per band which is divided on a frequency axis, determines the mixing ratio when mixing the pitch pulse with the white noise per band on the basis of a result of determination of a band in which the average value of the spectrum envelope amplitudes is maximized and the high frequency band voiced/voiceless discrimination information and generates a mixed signal, and adds together the mixed signals in all bands which are divided in the high frequency band and generates a high frequency band mixed signal, adds together the low frequency band mixed signal and the high frequency band mixed signal and generates a mixed sound source signal, and adds the spectrum envelope information to the mixed sound source signal, thereafter in a case where an error is not detected as a result of error detection of the second gain information, adds both of the first gain information and second gain information thereto and generates a reproduced voice, and in a case where the error is detected, adds only the first gain information thereto and generates the reproduced voice.

3. The voice communication system according to claim 1, wherein the voice encoder obtains the spectrum envelope information, the low frequency band voice/voiceless discrimination information, the high frequency band voiced/voiceless discrimination information, the pitch period information and the first gain information by linear predication analysis-synthesis system voice encoding and outputs the voice information bit string which is the result of encoding thereof.

4. A voice communication system comprising:

a voice encoder which performs encoding processing on a voice signal per frame which is a predetermined time unit and outputs voice information bits;

an error detection/error correction encoder which adds error detection codes to all or some of the voice information bits and sends a bit string that error correction encoding is performed on a string of the bits to which the error detection codes are added;

an error correction decoding/error detector which receives the bit string which is subjected to error correction encoding, performs error correction decoding on the received bit string which is subjected to error correction encoding and performs error detection on the voice information bit string after error correction decoding; and a voice decoder which reproduces a voice signal from the voice information bit string after error correction decoding and, on that occasion, in a case where an error is detected as a result of error detection by the error correction decoding/error detector, replaces the voice information bit string after error correction with a voice information bit string in a past error-free frame and thereafter reproduces the voice signal, wherein the voice encoder performs classification in accordance with a degree of importance which is the magnitude of auditory influence when an error occurs in each bit of the voice information bit string, classifies a group of bits which are high in degree of importance into a core layer and classifies a group of bits which are not high into an extension layer, wherein the error detection/error correction encoder sends the bit string which is subjected to error correction encoding after addition of the error detection codes as for the bits which are classified into the core layer and sends the bit string without performing addition of the error detection codes and error correction encoding as for the bits which are classified into the extension layer, wherein the error correction decoding/error detector receives the bit string sent from the error detection/error correction encoder and performs error correction decoding-error detection processing on the bit string in the core layer, and wherein the voice decoder decodes a voice by using the bit strings in both of the core layer and the extension layer on the basis of frequency that the error is detected by the error detection processing and when the frequency is low and decodes the voice using all bits or only some bits in the core layer when the frequency is high, separates and decodes respective parameters of spectrum envelope information, low frequency band voiced/voiceless discrimination information, high frequency band voiced/voiceless discrimination information, pitch period information and gain information included in the voice information bit string, in the low frequency band, determines a mixing ratio when mixing a pitch pulse which is generated in a pitch period that the pitch period information indicates with a white noise on the basis of the low frequency band voiced/voiceless discrimination information and prepares a mixed signal in the low frequency band, in the high frequency band, obtains a spectrum envelope amplitude from the spectrum envelope information, obtains an average value of the spectrum envelope amplitudes per band which is divided on a frequency axis, determines the mixing ratio when mixing the pitch pulse with the white noise per band on the basis of a result of determination of a band in which the average value of the spectrum envelope amplitudes is maximized and the high frequency band voiced/voiceless discrimination information and generates the mixed signal, and adds together the mixed signals in all bands which are divided in the high frequency band and generates the mixed signal in the high frequency band, and adds together the mixed signal in the low frequency band and the mixed signal in the high frequency band and generates a mixed sound source signal, and adds the spectrum envelope information and the gain information to the mixed sound source signal and generates a reproduced voice.

5. The voice communication system according to claim 4, wherein the voice encoder obtains the spectrum envelope information, the low frequency band voice/voiceless discrimination information, the high frequency band voiced/voiceless discrimination information, the pitch period information and the gain information by linear predication analysis-synthesis system voice encoding and outputs a voice information bit string which is a result of encoding thereof.

* * * * *